US012370421B2

(12) United States Patent
Bacon et al.

(10) Patent No.: US 12,370,421 B2
(45) Date of Patent: Jul. 29, 2025

(54) GOLF CLUB HEAD WITH OPTIMIZED MOMENT OF INERTIA

(71) Applicant: KARSTEN MANUFACTURING CORPORATION, Phoenix, AZ (US)

(72) Inventors: Cory S. Bacon, Scottsdale, AZ (US); Evan R. Greer, Peoria, AZ (US); Travis D. Milleman, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 18/353,354

(22) Filed: Jul. 17, 2023

(65) Prior Publication Data

US 2024/0017139 A1 Jan. 18, 2024

Related U.S. Application Data

(60) Provisional application No. 63/503,134, filed on May 18, 2023, provisional application No. 63/370,482, filed on Aug. 4, 2022, provisional application No. 63/368,626, filed on Jul. 15, 2022.

(51) Int. Cl.
*A63B 53/04* (2015.01)
*A63B 53/08* (2015.01)

(52) U.S. Cl.
CPC ..... *A63B 53/08* (2013.01); *A63B 53/0412* (2020.08); *A63B 53/0433* (2020.08); *A63B 53/0437* (2020.08); *A63B 53/0466* (2013.01); *A63B 2053/0491* (2013.01)

(58) Field of Classification Search
CPC ..... A63B 53/04; A63B 2053/0491; A63B 53/0408
See application file for complete search history.

(56) References Cited

U.S. PATENT DOCUMENTS 6,315,678 B1 * 11/2001 Teramoto ..... A63B 53/10 473/291
7,462,109 B2 12/2008 Erickson
7,674,187 B2 3/2010 Cackett
8,100,781 B2 1/2012 Burnett
8,272,974 B2 9/2012 Mickelson
8,337,327 B2 12/2012 Dawson
8,517,855 B2 8/2013 Beach
8,616,999 B2 12/2013 Greaney
(Continued)

OTHER PUBLICATIONS

International Search Report/Written Opinion for Int'l Patent Application No. PCT/US2023/27887, filed on Dec. 1, 2023.

*Primary Examiner* — Alvin A Hunter

(57) ABSTRACT

A driver-type golf club head comprising a cube-like body shape, wherein a ratio between the body height and the body depth is between 0.5 and 0.75, and a ratio between the body height and the body width is between 0.5 and 0.75. The golf club head further comprises a mass distribution wherein a large portion of the club head mass is located within a central mass zone centered about the Y'-axis. The golf club head further comprises an Ixx and an Iyy moment of inertia, wherein and Ixx/Iyy ratio is greater than 0.8. In many embodiments, the golf club head further comprises optimized bulge and roll curvatures determined by the Ixx, Iyy, CG position, coefficient of restitution, and/or other characteristics.

19 Claims, 26 Drawing Sheets

(56) References Cited

U.S. PATENT DOCUMENTS

| | | | | |
|---|---|---|---|---|
| 8,684,865 | B1 | 4/2014 | Dawson | |
| 8,900,069 | B2 | 12/2014 | Beach | |
| 9,474,946 | B2 | 10/2016 | Bennett | |
| 10,974,102 | B2 | 4/2021 | Penney | |
| 11,701,559 | B2 | 7/2023 | Bennett | |
| 2002/0010034 | A1* | 1/2002 | Reyes | A63B 53/02 473/345 |
| 2002/0049097 | A1* | 4/2002 | Murphy | A63B 53/04 473/345 |
| 2002/0094884 | A1* | 7/2002 | Hocknell | A63B 53/04 473/347 |
| 2002/0103041 | A1* | 8/2002 | Murphy | B29C 70/865 473/345 |
| 2002/0113338 | A1* | 8/2002 | Murphy | B29C 70/342 425/398 |
| 2002/0142861 | A1* | 10/2002 | Helmstetter | A63B 53/04 473/342 |
| 2004/0116208 | A1* | 6/2004 | De Shiell | A63B 60/00 473/345 |
| 2009/0017938 | A1 | 1/2009 | Yokota | |
| 2014/0080631 | A1* | 3/2014 | Deshmukh | A63B 53/04 473/345 |
| 2014/0274453 | A1* | 9/2014 | Curtis | A63B 53/0466 473/332 |
| 2017/0312595 | A1* | 11/2017 | Stokke | A63B 53/08 |
| 2018/0133564 | A1* | 5/2018 | Simone | A63B 53/04 |
| 2020/0114229 | A1* | 4/2020 | Milleman | A63B 60/02 |

* cited by examiner

GOLF CLUB HEAD WITH OPTIMIZED MOMENT OF INERTIA

CROSS REFERENCE PRIORITIES

This claims priority to U.S. Provisional Application No. 63/503,134 filed May 18, 2023, U.S. Provisional Application No. 63/370,482 filed Aug. 4, 2022, and U.S. Provisional Application No. 63/368,626 filed Jul. 15, 2022, all of which are incorporated in their entirety.

TECHNICAL FIELD

The present disclosure relates generally to golf equipment, and more particularly, to golf heads. In particular, the present invention is to a golf club head with optimized moments of inertia and/or optimized bulge and roll curvatures.

BACKGROUND

Historically, golf club head designs, particularly wood-type golf club heads, trend toward increasing club head moment of inertia to offer more forgiveness and minimize decreases in ball speed for mis-hits. Most commonly, prior-art club head designs cater toward increasing Iyy moment of inertia (i.e. the moment of inertia about a Y-axis extending vertically through the club head center of gravity), as Iyy is a main contributor to club head performance and forgiveness, particularly on shots mis-hit toward the heel or the toe. Such club heads are designed to achieve the highest Iyy possible. Prior art club head designs that seek to maximize Iyy often include flat body profiles with high amounts of perimeter weighting that place discretionary mass away from the Y-axis. However, in maximizing Iyy, prior-art club head designs can often neglect other properties, such as Ixx moment inertia (i.e. the moment of inertia about an X-axis extending through the club head center of gravity), or bulge and roll curvatures. An excessively low Ixx and/or bulge and roll curvatures that are not optimized for a given club head can reduce forgiveness and distance on mis-hits, even with a high Iyy.

In certain cases, it may be desirable to provide a wood-type club head that achieves a specific Iyy target value. In many cases, an Iyy target that is lower than the Iyy of a typical prior-art club head may be desired. In some instances, a low Iyy target may be desirable to tailor the club head to a specific player or subset of players. Designing a club head to a low Iyy target, however, can have negative impacts on club head forgiveness and performance, as Iyy is a significant contributor to both. There is a need in the art to maximize club head performance with respect to a club head that achieves a target Iyy. In particular, there is a need in the art to maximize said performance with respect to a club head that achieves a target Iyy lower than the Iyy of a typical prior-art club head, by balancing Ixx, Iyy, CG position, and bulge and roll curvatures.

Figure 1:
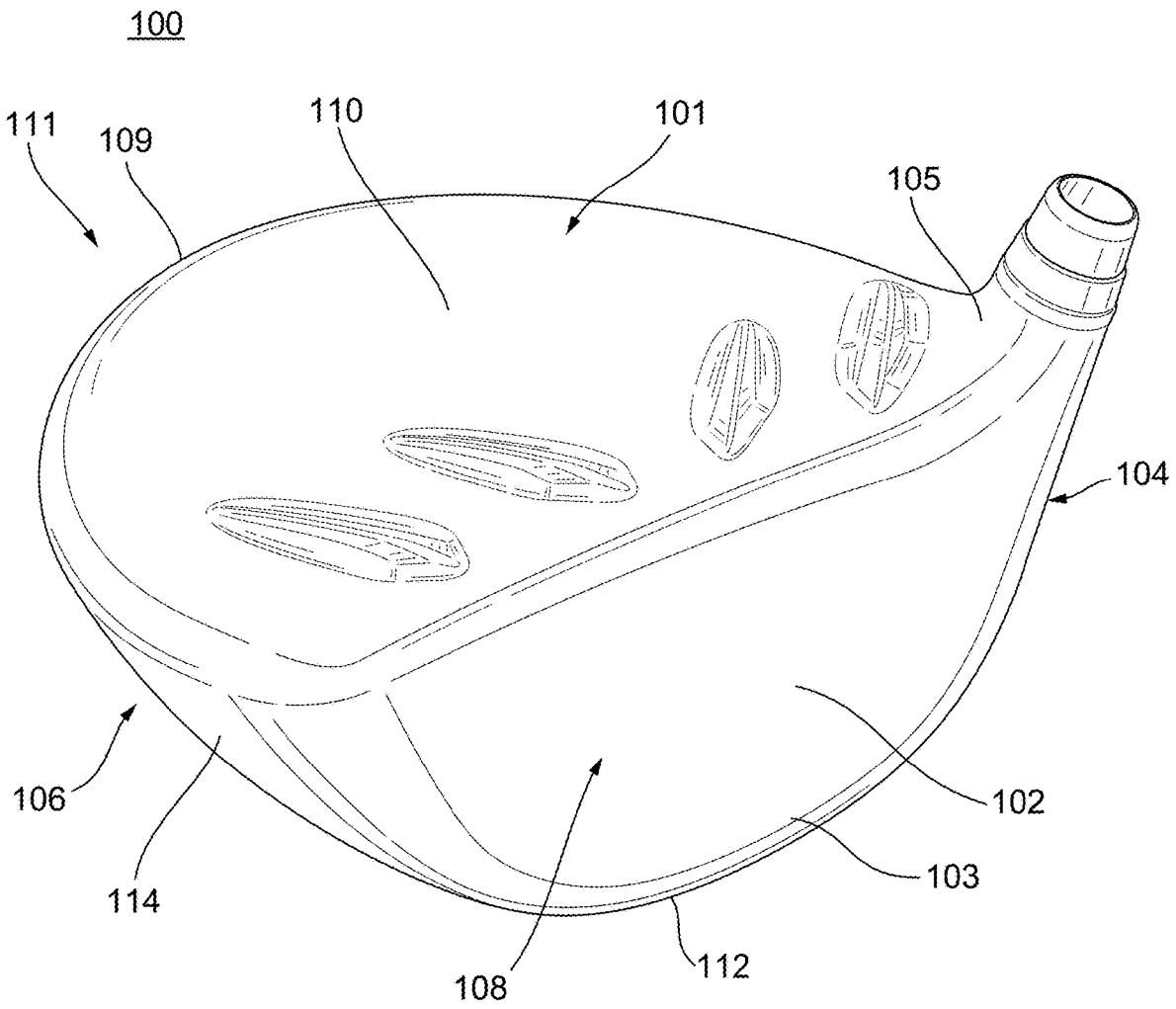
FIG. 1 illustrates a front perspective view of a golf club head according to the present invention.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

Definitions

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

Various embodiments of a golf club are illustrated in the figures. A golf club is generally understood to comprise a club head, which is configured to receive a shaft. A golf club further comprises a grip, which is secured to the shaft.

FIGS. 1-6 schematically illustrate various embodiments of a driver-type golf club head in various views. The features discussed below are demonstrated on club head 100. For ease of discussion, the features shown on club head 100 are applicable to various embodiments of the club head according to the present invention. Any one or more of the features described in the various embodiments below can be used in combination with one another. Further, while different embodiments may comprise different numbering schemes (i.e. 1xx, 2xx, 3xx numbering schemes, etc.) similar elements are numbered similarly between embodiments (i.e. club head 100 comprises a crown 110 and a sole 112, whereas club head 200 comprises a crown 210 and a sole 212).

The club head 100 can comprise a strike face 102 and a body 101 secured together to define a substantially closed/hollow interior cavity. The club head 100 comprises a crown 110, a sole 112 opposite the crown 110, a heel 104, a toe 106 opposite the heel 104, a front end 108, and a rear end 111 opposite the front end 108. The body 110 can further include a skirt 114 and/or a trailing edge 109 located between and adjoining the crown 110 and the sole 112. The skirt 114 can extend from near the heel 104 to near the toe 106 of the club head 100.

The club head 100 can comprise one or more body materials such as steel, stainless steel, tungsten, aluminum, titanium, vanadium, chromium, cobalt, nickel, other metals, or metal alloys. In some embodiments, the body material can comprise a Ti-8Al-1Mo-1V alloy, or a 17-4 stainless steel. In some embodiments, the body material can be formed from C300, C350, Ni (Nickel)-Co(Cobalt)-Cr(Chromium)-Steel Alloy, 565 Steel, AISI type 304 or AISI type 630 stainless steel, 17-4 stainless steel, a titanium alloy, for example, but not limited to Ti-6-4, Ti-3-8-6-4-4, Ti-10-2-3, Ti 15-3-3-3, Ti 15-5-3, Ti185, Ti 6-6-2, Ti-7s, Ti-9s, Ti-92, or Ti-8-1-1 titanium alloy, an amorphous metal alloy, or other similar metals. In some embodiments, one or more portions of the club head 100 can comprise a non-metallic material.

Figure 2:
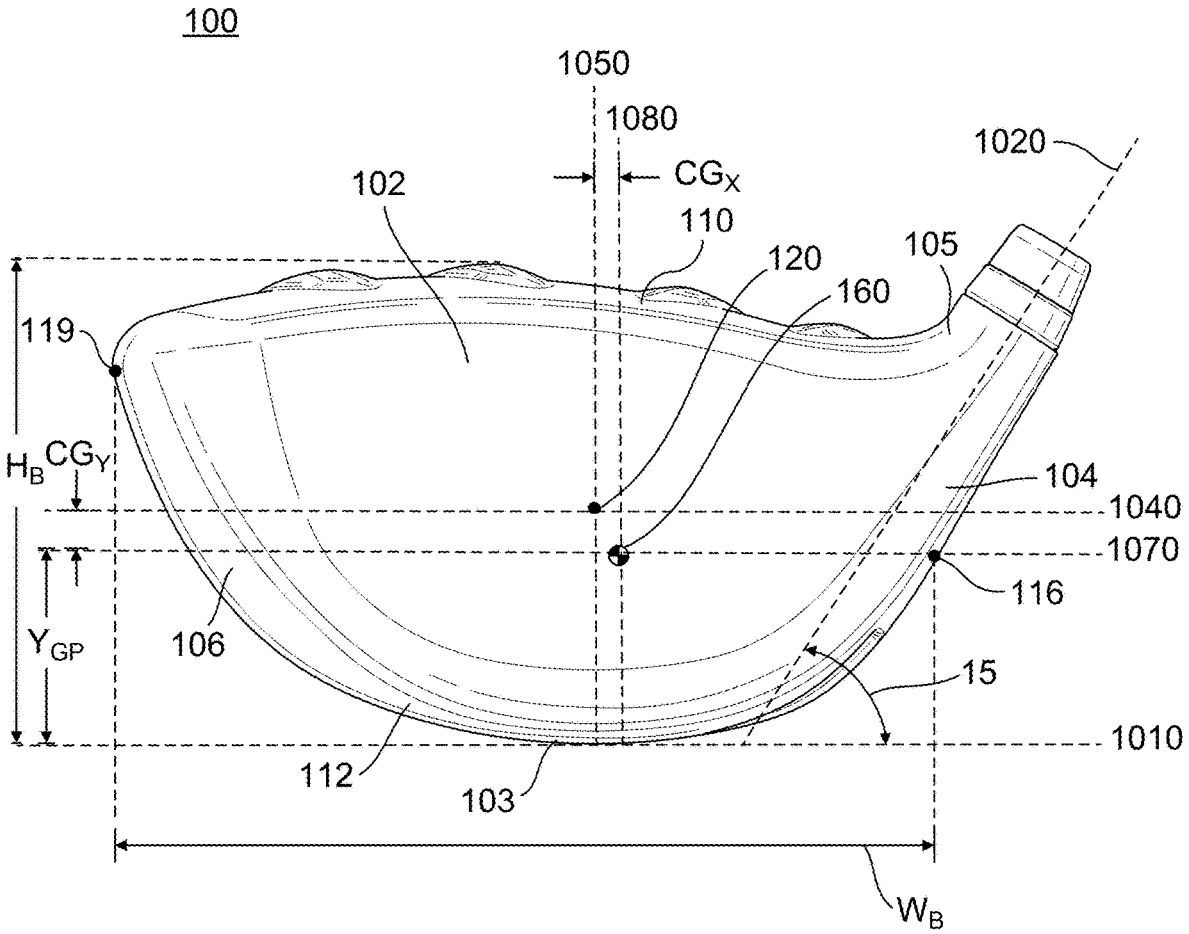
FIG. 2 illustrates a front view of the golf club head of FIG. 1, highlighting the club head coordinate axes.

The "ground plane," as used herein, refers to a reference plane associated with the surface on which a golf ball is placed. The ground plane 1010 can be a horizontal plane tangent to the sole at an address position. Address position is defined in further detail below. The ground plane 1010 is illustrated in FIG. 2.

Figure 3:
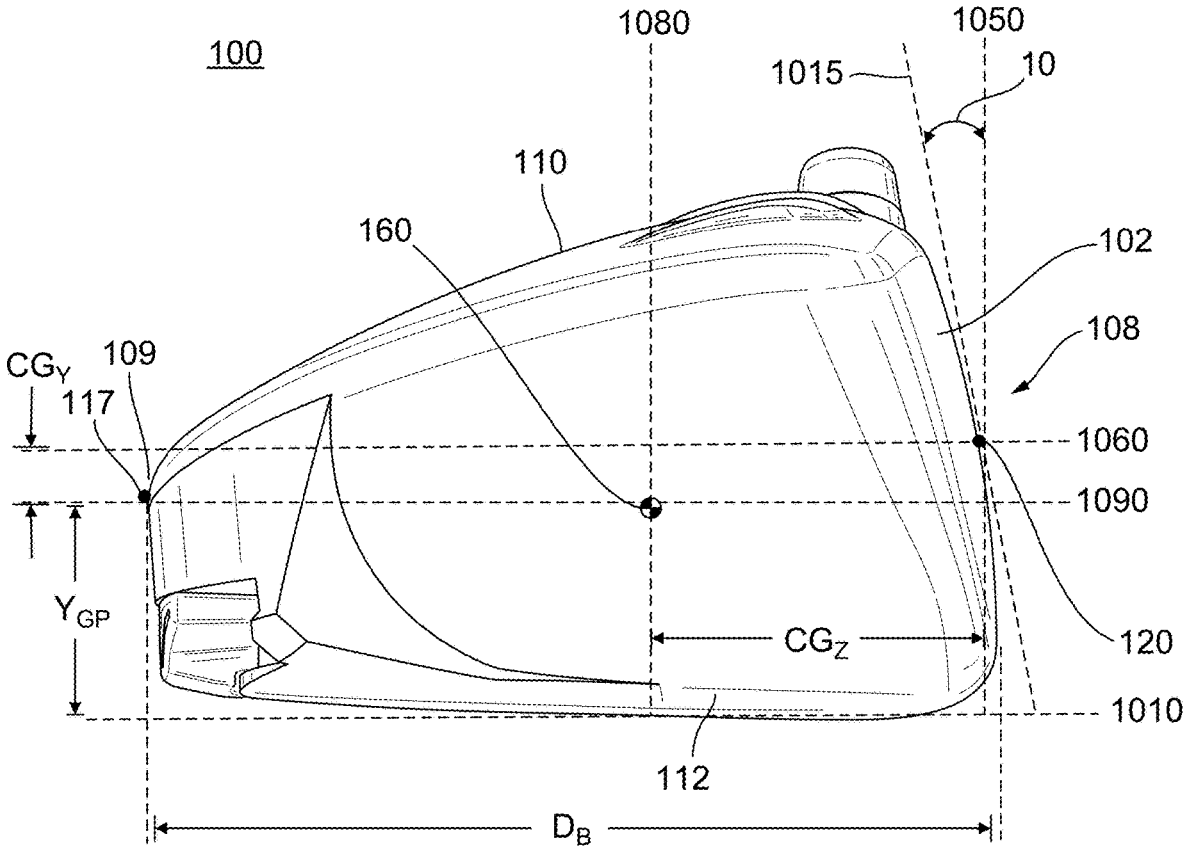
FIG. 3 illustrates a toe-side view of the golf club head of FIG. 1, highlighting the club head coordinate axes.

The "loft plane," as used herein, refers to a reference plane that is tangent to the geometric center of the strike face (the "geometric center" is described in further detail below). Loft plane 1015 is illustrated in FIG. 3.

The term "loft angle," as used herein, can refer to an angle measured between the loft plane 1015 and the XY plane (defined below). Loft angle 10 is illustrated in FIG. 3.

The term "lie angle," as used herein, can refer to an angle between a hosel axis 1020, extending through the hosel 105, and the ground plane. The lie angle 15 is measured from a front view of the club head, as illustrated in FIG. 2.

The club head 100 can define an "address position" (also referred to as "address"), wherein the club head is oriented such that club head forms its intended loft angle 10 and lie angle 15. For example, at address position, the loft plane 1015 and the XY plane form the intended loft angle 10 between one another. Likewise, at address position, the hosel axis 1020 and the ground plane 1010 form the intended lie angle 15 between one another.

As illustrated in FIGS. 2 and 3, the club head 100 can define a primary coordinate system centered about the geometric center 120 of the strike face 102. The primary coordinate system can comprise an X-axis 1040, a Y-axis 1050, and a Z-axis 1060. The X-axis 1040 can extend in a heel-to-toe direction, parallel to the ground plane 1010. The X-axis 1040 can be positive towards the heel 104 and negative towards the toe 106. The Y-axis 1050 can extend in a crown-to-sole direction and can be orthogonal to both the ground plane 1010 and the X-axis 1040. The Y-axis 1050 can be positive towards the crown 110 and negative towards the sole 112. The Z-axis 1060 can extend in front-to-rear direction, parallel to the ground plane 1010, and can be orthogonal to both the X-axis 1040 and the Y-axis 1050. The Z-axis 1060 can be positive towards the strike face 102 and negative towards the rear end 108.

The primary coordinate system, as described herein, defines an XY plane as a vertical plane extending along the X-axis 1040 and the Y-axis 1050. The primary coordinate system defines an XZ plane as a horizontal plane extending along the X-axis 1040 and the Z-axis 1060. The primary coordinate system further defines a YZ plane as a vertical plane extending along the Y-axis 1050 and the Z-axis 1060. The XY plane, the XZ plane, and the YZ plane are all perpendicular to one another and intersect at the primary coordinate system origin located at the geometric center 120 of the strike face 102. In these or other embodiments, the club head 100 can be viewed from a front view when the strike face 102 is viewed from a direction perpendicular to the XY plane. Further, in these or other embodiments, the club head 100 can be viewed from a side view or side cross-sectional view when the heel 104 or toe 106 is viewed from a direction perpendicular to the YZ plane.

Figure 4:
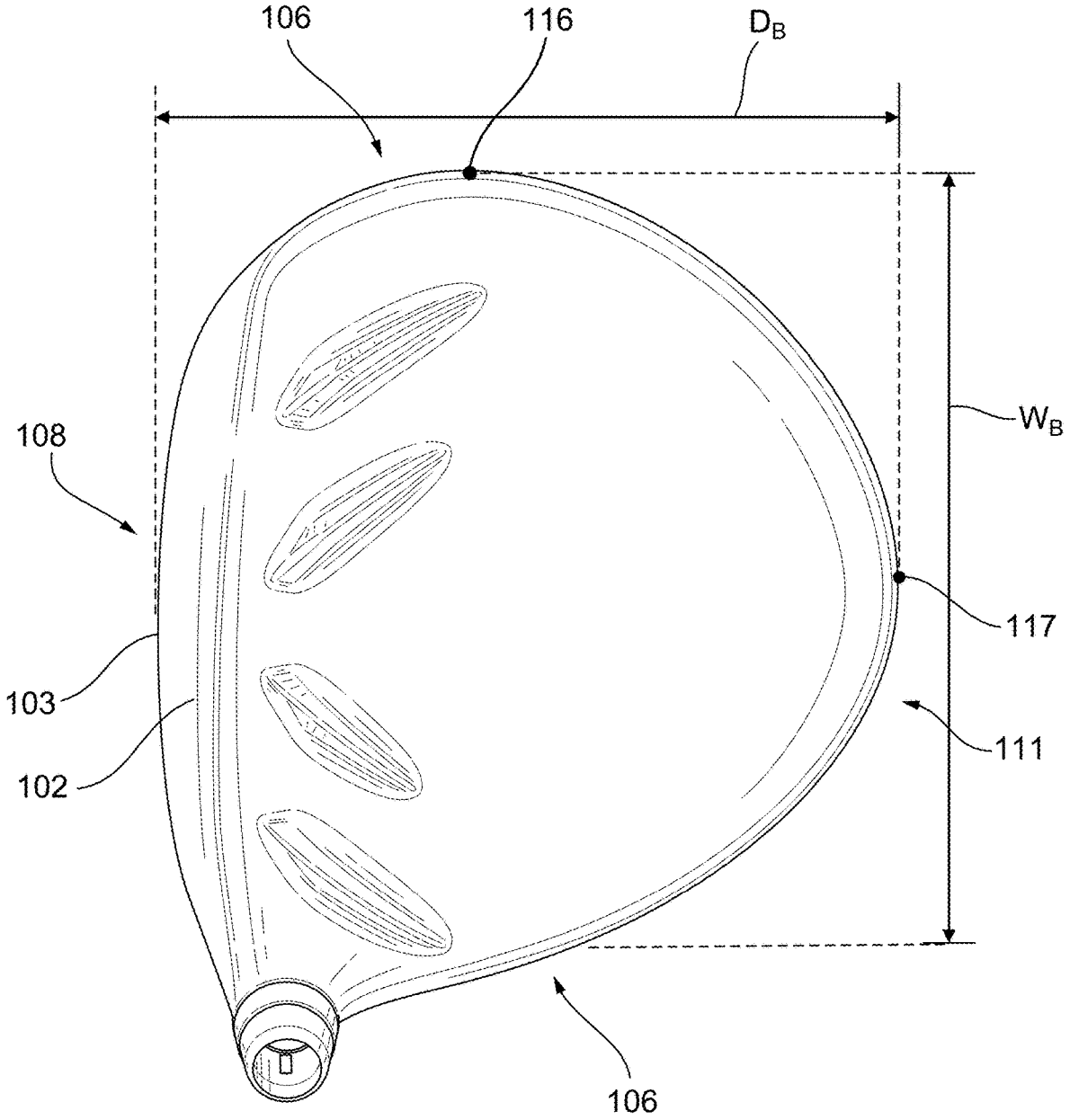
FIG. 4 illustrates a top view of the golf club head of FIG. 1, highlighting the club head body dimensions.

The "body depth," or "depth" $D_B$ of the club head 100, as used herein, refers to a front-to-rear dimension measured across the body 101. Referring to FIGS. 3 and 4, the body depth $D_B$ is measured parallel to the Z-axis 1060 from the leading edge 103 to the rearward-most point 117 of the body 101.

The "body height," or "height" $H_B$ of the club head 100, as described herein, can refer to a crown-to-sole dimension measured across the body 101. Referring to FIG. 2, the body height $H_B$ can be measured as a vertical distance (parallel to the Y-axis 1050) between the ground plane 1010 and the highest point of the crown 110. In many embodiments, the body height $H_B$ can be measured according to a golf governing body such as the United States Golf Association (USGA).

The "body width," or "width" $W_B$ of the club head 100, as described herein, can refer to a heel-to-toe dimension measured across the body 101. Referring to FIG. 2, the body width $W_B$ can be measured parallel to the X-axis 1040 from the heel apex 116 to a toe apex 119. The toe apex 119 is defined as the toeward-most point of the body 101. The heel apex 116 is heelward-most point of the heel 104 that is located at a height 0.875 mm from the ground plane 1010. In many embodiments, the body width $W_B$ can be measured according to a golf governing body such as the United States Golf Association (USGA). The ranges specified for the body depth $D_B$, body height $H_B$, and body width $W_B$ can be designed in accordance with the USGA regulations.

The "center of gravity" or "CG" of the club head, as described herein, can refer to the point at which the mass is centered within the club head. The CG 160 is illustrated in FIGS. 2 and 3.

The term or phrase "center of gravity position" or "CG location" can refer to the location of the club head center of gravity (CG) with respect to the primary coordinate system, wherein the CG position is characterized by locations along the X-axis 1040, the Y-axis 1050, and the Z-axis 1060. The term "CGx" can refer to the CG location along the X-axis 1040, measured from the geometric center 120. The term "CG height" can refer to the CG location along the Y-axis 1050, measured from the geometric center 120. The term "CGy" can be synonymous with the CG height. The term "CG depth" can refer to the CG location along the Z-axis 1060, measured from the geometric center 120. The term "CGz" can be synonymous with the CG depth.

The golf club head further comprises a secondary coordinate system centered about the center of gravity 160. As illustrated in FIGS. 2 and 3, the secondary coordinate system comprises an X'-axis 1070, a Y'-axis 1080, and a Z'-axis 1090. The X'-axis 1070 extends in a heel-to-toe direction. The X'-axis 1070 is positive towards the heel 104 and negative towards the toe 106. The Y'-axis 1080 extends in a sole-to-crown direction and is orthogonal to both the Z'-axis 1090 and the X'-axis 1070. The Y'-axis 1080 is positive towards the crown 110 and negative towards the sole 112. The Z'-axis 1090 extends front-to-rear, parallel to the ground plane 1010 and is orthogonal to both the X'-axis 1070 and the Y'-axis 1080. The Z'-axis 1090 is positive towards the strike face 102 and negative towards the rear end 111.

The term or phrase "moment of inertia" (hereafter "MOI") can refer to a value derived using the center of gravity (CG) location. The term "$MOI_{xx}$" or "$I_{xx}$" can refer to the MOI measured about the X'-axis 1070. The term "MOIyy " or "$I_{yy}$" can refer to the MOI measured about the Y'-axis 1080. The term "MOIzz " or "$I_{zz}$" can refer to the MOI measured about the Z'-axis 1090. The MOI values MOIxx, MOIyy, and MOIzz determine how forgiving the club head 100 is for off-center impacts with a golf ball.

MOI is a measurement of an object's resistance to twisting about a given axis and is calculated according to Equation 1 below.

$$I=\int r^2 dm \quad \text{(Eqn. 1)}$$

Equation 1 defines MOI, represented by I, of an object as the integral, with respect to mass (represented by dm), of the perpendicular distance between the axis about which MOI is being measured and the location of the mass of the object, represented by r, squared. It is generally known that, if the center of gravity (CG) of an object is known, that object may be treated as a point mass located at said CG. Treating an object as a point mass allows Equation 1 to be simplified to the following equation, Equation 2.

$$I=\Sigma m_i r_i^2 = (Eqn.\ 2)$$

Equation 2 describes that the moment of inertia, I, of an object about a given axis is equal to the sum of the masses of all point masses of that object multiplied by the perpendicular distance between the axis about which MOI is being measured and each of the point masses.

The term "strike face," as used herein, refers to a club head front surface that is configured to strike a golf ball. The term strike face can be used interchangeably with the term "face."

Figure 5:
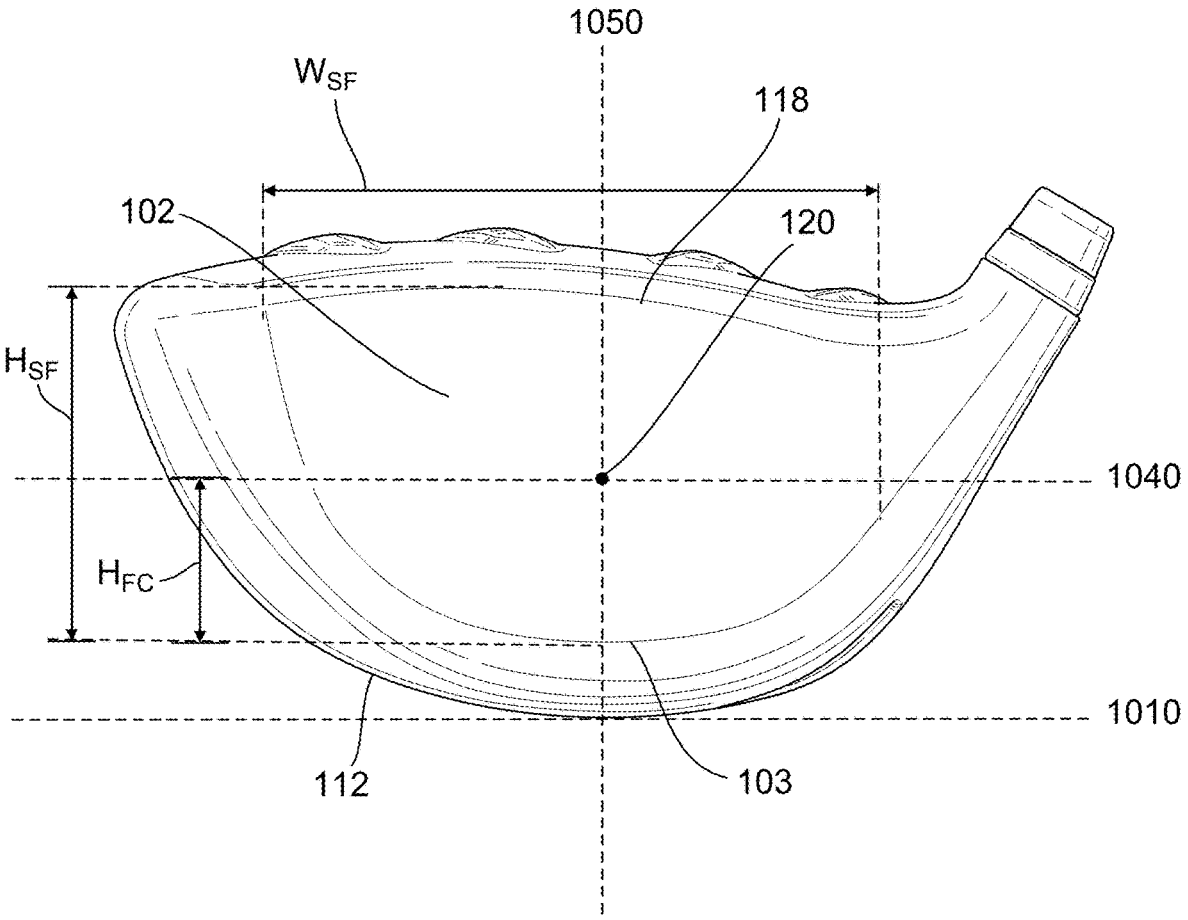
FIG. 5 illustrates a front view of the golf club head of FIG. 1, highlighting the strike face dimensions.

The term "strike face perimeter," as used herein, can refer to an edge of the strike face. The strike face perimeter can be located along an outer edge of the strike face where the curvature of the club head deviates from a bulge and/or roll curvature of the strike face (defined below). Referring to FIG. 5, the strike face perimeter includes an upper edge 118, which defines a highest point on the strike face 102. The strike face perimeter further includes a leading edge 103, which defines a lowest point on the strike face 102. The strike face perimeter is the outermost bound of the strike face 102.

The "leading edge" of the club head, as described herein, can be identified as the most sole-ward portion of the strike face perimeter. For example, as illustrated in FIG. 5, the leading edge 103 is the transition from the strike face 102 to the sole 112 of the club head 100.

Figure 6:
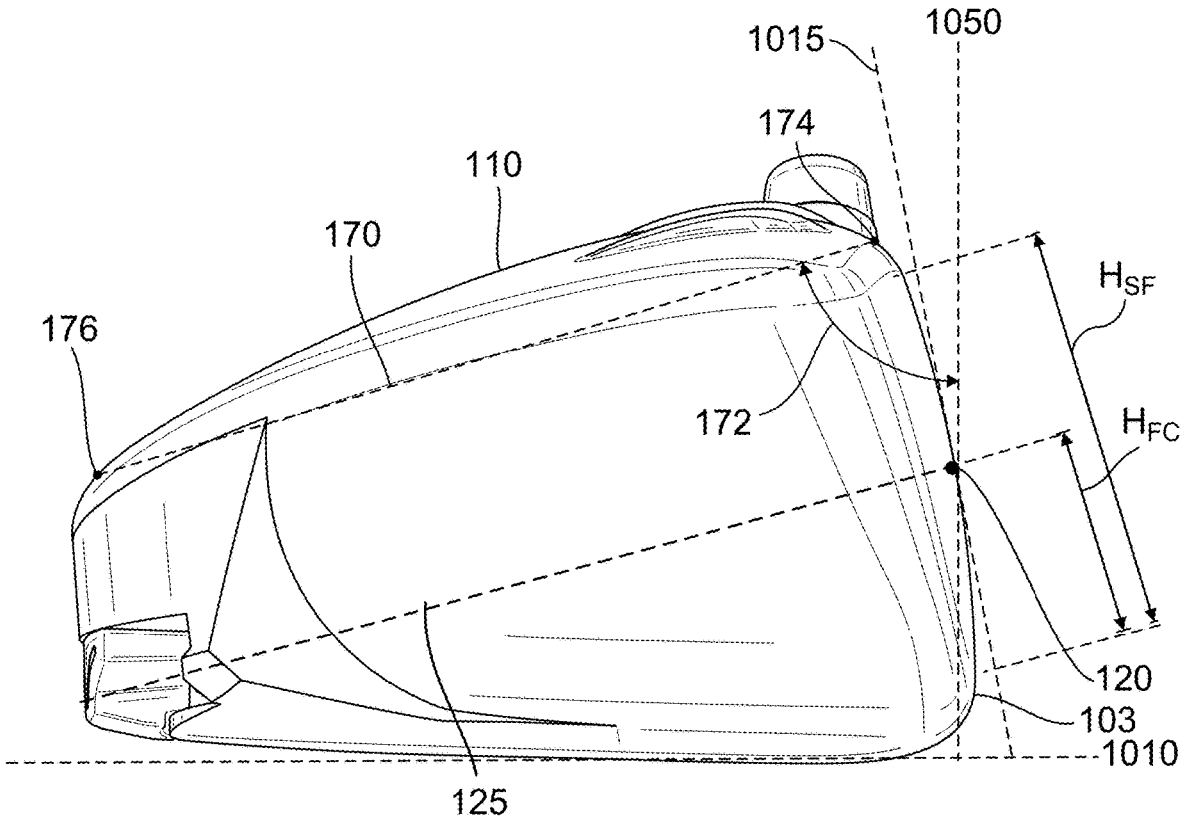
FIG. 6 illustrates a toe-side view of the golf club head of FIG. 1, highlighting the strike face dimensions and crown angle.

The "strike face height" $H_{SF}$ of the club head, as used herein, refers to a distance measured from the lowest point of the strike face perimeter to the highest point of the strike face perimeter. Referring to FIGS. 5 and 6, the height $H_{SF}$ can be measured parallel to the loft plane 1015, from the leading edge 103 to the upper edge 118 of the strike face 102, wherein the upper edge 118 represents the most crown-ward portion of the strike face 102 perimeter.

The "strike face width" $W_{SF}$ of the club head, as used herein, refers to a horizontal distance measured across the strike face in a heel-to-toe direction. Referring to FIG. 5, the strike face width $W_{SF}$ can be measured parallel to the ground plane 1010, from a heel-most extent of the strike face perimeter to a toe-most extent of the strike face perimeter.

The "geometric center" of the strike face, as used herein, refers to a geometric centerpoint of the strike face perimeter, illustrated in FIGS. 2 and 5. The geometric centerpoint 120 of the strike face 102 can be located in accordance with the definition of a golf governing body such as the United States Golf Association (USGA).

As illustrated in FIG. 6, the strike face 102 comprises a geometric center height $H_{FC}$. The geometric center height $H_{FC}$ is measured from the leading edge 103 to the geometric center 120, parallel to the loft plane 1015.

The strike face comprises a "bulge curvature", and a "roll curvature". The bulge curvature is the curvature of the strike face in the heel-to-toe direction. The roll curvature is the curvature of the strike face in a crown-to-sole direction. The bulge curvature and the roll curvature each respectively comprise a "bulge radius" and a "roll radius" defining the radii of curvature associated with each of the bulge curvature and the roll curvature. The bulge curvature and/or the roll curvature can comprise one or more radii.

As illustrated in FIG. 6, the club head 100 further comprises a force line 125 intersecting the geometric center 120 and extending parallel to the loft plane 1015. The launch characteristics of a golf ball are dependent on the relationship between the force line 125 and the CG 160. The closer the CG 160 is to the force line 125, the greater the energy transfer between the club head 100 and the golf ball at impact. The launch characteristics of the club head 100 at impact remain substantially consistent as long as the distance between the CG 160 and the force line 125 is constant, even if the CG 160 moves relative to the rest of the club head 100.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

DETAILED DESCRIPTION

The golf club head described herein comprises various features and characteristics to maximize performance in view of a specific moment of inertia target value. In particular, the club head described below may be designed to achieve a particular Iyy target value and maximize performance and forgiveness relative to the limits of said Iyy target. In general, a higher Iyy provides a more forgiving club head. A club head with a higher Iyy has a greater resistance to rotation at impact for shots that are heelward or toeward of center. A higher Iyy club head also retains more energy at impact on a heelward or toeward mis-hit. Therefore, a higher Iyy club head generally provides greater ball speeds and distances on heelward or toeward mis-hits. However, there are other contributing factors to club head forgiveness and overall performance, such as the Ixx moment of inertia and bulge and roll curvatures. The embodiments described herein provide features and characteristics that increase Ixx relative to the Iyy target. The embodiments described herein further comprise optimized bulge and roll curvatures determined by the Iyy target combined with other club head properties (i.e. Ixx, CG position, coefficient of restitution, etc.) Increasing the Ixx can provide increased forgiveness and distance on crownward or sole-ward mis-hits. Optimizing the bulge and roll curvatures can further increase forgiveness in distance by counteracting the gearing effect imparted on the golf ball on an off-center strike. In particular, the embodiments described herein are directed to driver-type golf club heads (designed to be primarily used to hit a golf ball off of a tee) comprising a specific Iyy target value. The present embodiments are not directed to fairway wood-type, hybrid-type, or iron-type club heads. Although the driver-type club heads described herein are intended to hit a golf ball off of a tee, said club heads may also be suitable for hitting the golf ball off of the ground.

As described above, there are two main club head characteristics that provide improved performance relative to a fixed Iyy target: 1) Ixx moment of inertia and 2) bulge and roll curvatures. The club head of the present disclosure provides a high Ixx moment of inertia relative to the Iyy target. In many embodiments, the club head can comprise an Ixx/Iyy ratio greater than 0.80. Providing a high Ixx relative to the Iyy target increases the overall forgiveness of the club head. Ixx represents the club head's resistance to rotation about the X'-axis on golf shots that are struck above or below center. As described in the definitions above, the X'-axis is a heel-to-toe axis with respect to a coordinate system centered about the club head CG. The X'-axis extends horizontally through the CG in a heel-to-toe direction. In particular, a higher Ixx/Iyy ratio provides a club head with increased resistance to rotation about the X'-axis at impact for shots that are crownward or soleward of center. Increasing the Ixx/Iyy ratio reduces the effect of the club head rotation about the X'-axis and balances the backspin on the golf ball, thereby increasing golf shot distance on crownward or sole-ward mis-hits.

The present club head maximizes the Ixx/Iyy ratio through "cube-like" shaping and distributing a large portion of the club head mass near the Y'-axis. The club head comprises a cube-like profile wherein the body width, body height, and body depth are more similar to one another than the width, height, and depth of a prior art club head. The cube-like profile of the club head spaces the mass of the crown and the sole away from the X'-axis, thereby increasing Ixx without contributing to Iyy. Most prior art club heads, particularly modern club heads comprise a flatter, wider, and deeper profile, wherein the body height is significantly smaller than the body width or body depth. Such prior-art club heads give preference to increasing Iyy without regard for Ixx. These prior art club head shapes efficiently increase Iyy, by spacing club head mass away from the Y'-axis via shaping. However, such designs do not prioritize the amount of structural mass away from the X'-axis, and therefore the Ixx/Iyy ratio is not maximized.

To maximize the Ixx/Iyy ratio, the present club head efficiently distributes mass to contribute to Ixx without contributing to Iyy. The club head can distribute a large proportion of mass near the Y'-axis, yet far from the X'-axis. To achieve this mass distribution, the club head can comprise one or more weighting features such as internal mass pads or removable weights located near the the Y'-axis and far from the X'-axis. Any such features can serve to provide a significant increase in Ixx relative to Iyy, thereby providing an increased Ixx/Iyy ratio.

The club head can further comprise a strike face with optimized bulge and roll curvatures to increase performance and forgiveness. The bulge and roll curvatures can be specifically tailored to a specific club head based on properties of said club head, including Ixx, Iyy, CG position, coefficient of restitution, and/or other club head characteristics. The present club head can satisfy one or more bulge radius or roll radius relationships to maximize distance and forgiveness. The bulge and roll radii of the present club head counteract the gearing effect imparted on the golf ball on an off-center strike. Providing bulge and roll radii as a function of the club head characteristics can increase forgiveness and distance to provide a higher-performing club head, even in cases where the Iyy target is substantially low. In embodiments wherein the Iyy target is substantially low, the optimized bulge and roll radii can compensate for losses in forgiveness and ball speed associated with the low Iyy target.

In many embodiments, the club head can further comprise an adjustable swing weight system that provides a plurality of available club head builds at a consistent Iyy target. The adjustable swing weight system includes a plurality of interchangeable and/or removable weight inserts that are each configured to provide a consistent Iyy contribution. The adjustable swing weight system provides the ability to vary the total club head mass by more than 25 grams while keeping Iyy consistent between different builds.

I. Iyy Target and Mass Properties

As described above, the club head of the present invention is designed to achieve a designated target value for Iyy moment of inertia (hereafter "Iyy target"). In some embodiments, the Iyy target value can coincide substantially with the moment of inertia limits imposed by the USGA with respect to a conforming club head. In many embodiments, however, the Iyy target value can be lower than the USGA limit. Club heads designed to achieve an Iyy target at or near the USGA limit can be referred to herein as "high-MOI" club heads, whereas club heads designed to achieve an Iyy target significantly lower than the USGA limit can be referred to herein as "low-MOI" club heads. The embodiments and examples herein are primarily directed to low-MOI club heads, however any combination of the principles, properties, features, elements, or methods disclosed below can be applicable to high-MOI club heads as well. Unless otherwise specified, the mass properties described herein, including moment of inertia values and CG positions, reflect a "fully built" club head. A fully built club head includes all applicable weight inserts, removable weights, permanent weights, swing weights, filler material, and/or any other removable components such as those associated with an adjustable hosel assembly.

In high-MOI club head embodiments, the Iyy target can be between 4000 g*cm$^3$ and 8000 g*cm$^3$. In some high-MOI club head embodiments, the Iyy target can be between 4000 g*cm$^3$ and 4200 g*cm$^3$, between 4200 g*cm$^3$ and 4400 g*cm$^3$, between 4400 g*cm$^3$ and 4600 g*cm$^3$, between 4600 g*cm$^3$ and 4800 g*cm$^3$, between 4800 g*cm$^3$ and 5000 g*cm$^3$, between 5000 g*cm$^3$ and 5200 g*cm$^3$, between 5200 g*cm$^3$ and 5400 g*cm$^3$, between 5400 g*cm$^3$ and 5600 g*cm$^3$, between 5600 g*cm$^3$ and 5800 g*cm$^3$, or between 5800 g*cm$^3$ and 6000 g*cm$^3$, between 6000 g*cm$^3$ and 6500 g*cm$^3$, between 6500 g*cm$^3$ and 7000 g*cm$^3$, between 7000 g*cm$^3$ and 7500 g*cm$^3$, or between 7500 g*cm$^3$ and 8000 g*cm$^3$. In some high-MOI club head embodiments, the Iyy target can be greater than 4000 g*cm$^3$, greater than 4200 g*cm$^3$, greater than 4400 g*cm$^3$, greater than 4600 g*cm$^3$, greater than 4800 g*cm$^3$, greater than 5000 g*cm$^3$, greater than 5200 g*cm$^3$, greater than 5400 g*cm$^3$, greater than 5600 g*cm$^3$, or greater than 5800 g*cm$^3$, greater than 6000 g*cm$^3$, greater than 6500 g*cm$^3$, greater than 7000 g*cm$^3$, greater than 7500 g*cm$^3$, or greater than 8000 g*cm$^3$. Embodiments of a high-MOI club head can comprise an Iyy moment of inertia within any of the Iyy target ranges listed above.

In low-MOI club head embodiments, the Iyy target can be between 2000 g*cm$^3$ and 4000 g*cm$^3$. In some low-MOI club head embodiments, the Iyy target can be between 2000 g*cm$^3$ and 2200 g*cm$^3$, between 2200 g*cm$^3$ and 2400 g*cm$^3$, between 2400 g*cm$^3$ and 2600 g*cm$^3$, between 2600 g*cm$^3$ and 2800 g*cm$^3$, between 2800 g*cm$^3$ and 3000 g*cm$^3$, between 3000 g*cm$^3$ and 3200 g*cm$^3$, between 3200 g*cm$^3$ and 3400 g*cm$^3$, between 3400 g*cm$^3$ and 3600 g*cm$^3$, between 3600 g*cm$^3$ and 3800 g*cm$^3$, or between 3800 g*cm$^3$ and 4000 g*cm$^3$. In some low-MOI club head embodiments, the Iyy target can be less than 4000 g*cm$^3$, less than 3800 g*cm$^3$, less than 3600 g*cm$^3$, less than 3400 g*cm$^3$, less than 3200 g*cm$^3$, less than 3000 g*cm$^3$, less than 2800 g*cm$^3$, less than 2600 g*cm$^3$, less than 2400 g*cm$^3$, less than 2200 g*cm$^3$, or less than 2000 g*cm$^3$. Embodiments of a low-MOI club head can comprise an Iyy moment of inertia within any of the Iyy target ranges listed above.

As described above, the club heads described herein achieve a high Ixx/Iyy ratio (greater than 0.80) through cube-like shaping and distributing a large portion of the club head mass near the Y'-axis. The club head can therefore comprise an Ixx value substantially near the Iyy target value. In high-MOI club head embodiments, the club head can comprise an Ixx between 3200 g*cm$^3$ and 7200 g*cm$^3$. In some high-MOI club head embodiments, the Ixx can be between 3200 g*cm$^3$ and 3600 g*cm$^3$, between 3600 g*cm$^3$ and 4000 g*cm$^3$, between 4000 g*cm$^3$ and 4400 g*cm$^3$, between 4400 g*cm$^3$ and 4800 g*cm$^3$, between 4800 g*cm$^3$ and 5200 g*cm$^3$, between 5200 g*cm$^3$ and 5600 g*cm$^3$, between 5600 g*cm$^3$ and 6000 g*cm$^3$, between 6000 g*cm$^3$ and 6400 g*cm$^3$, between 6400 g*cm$^3$ and 6800 g*cm$^3$, or between 6800 g*cm$^3$ and 7200 g*cm$^3$. In some high-MOI club head embodiments, the Ixx can be greater than 3200 g*cm$^3$, greater than 3600 g*cm$^3$, greater than 4000 g*cm$^3$, greater than 4400 g*cm$^3$, greater than 4800 g*cm$^3$, greater than 5200 g*cm$^3$, greater than 5600 g*cm$^3$, greater than 6000 g*cm$^3$, greater than 6400 g*cm$^3$, greater than 6800 g*cm$^3$, or greater than 7200 g*cm$^3$.

In low-MOI club head embodiments, the club head can comprise an Ixx between 1400 g*cm$^3$ and 3600 g*cm$^3$. In some low-MOI club head embodiments, the Ixx can be between 1400 g*cm$^3$ and 1600 g*cm$^3$, between 1600 g*cm$^3$ and 1800 g*cm$^3$, between 1800 g*cm$^3$ and 2000 g*cm$^3$, between 2000 g*cm$^3$ and 2200 g*cm$^3$, between 2200 g*cm$^3$ and 2400 g*cm$^3$, between 2400 g*cm$^3$ and 2600 g*cm$^3$, between 2600 g*cm$^3$ and 2800 g*cm$^3$, between 2800 g*cm$^3$ and 3000 g*cm$^3$, between 3000 g*cm$^3$ and 3200 g*cm$^3$, between 3200 g*cm$^3$ and 3400 g*cm$^3$, or between 3400 g*cm$^3$ and 3600 g*cm$^3$. In some low-MOI club head embodiments, the Ixx can be greater than 1400 g*cm$^3$, greater than 1600 g*cm$^3$, greater than 1800 g*cm$^3$, greater than 2000 g*cm$^3$, greater than 2200 g*cm$^3$, greater than 2400 g*cm$^3$, greater than 2600 g*cm$^3$, greater than 2800 g*cm$^3$, greater than 3000 g*cm$^3$, greater than 3200 g*cm$^3$, greater than 3400 g*cm$^3$, or greater than 3600 g*cm$^3$.

The CG 160 position of the club head 100 can vary based on the Iyy target, the club head volume, and other factors. In high-MOI embodiments, the club head 100 can comprise a CGy position measured from the geometric center 120 of the strike face 102 between 0 inches and −0.5 inch. In some high-MOI embodiments, the CGy position can be between 0 inches and −0.05 inch, between −0.05 inch and −0.10 inch, between −0.10 inch and −0.15 inch, between −0.15 inch and −0.20 inch, between −0.20 inch and −0.25 inch, between −0.25 inch and −0.30 inch, between −0.35 inch and −0.40 inch, between −0.40 inch and −0.45 inch, or between −0.45 inch and −0.50 inch. In some high-MOI embodiments, the CGy position can be less than 0 inch, less than −0.05 inch, less than −0.10 inch, less than −0.15 inch, less than −0.20 inch, less than −0.25 inch, less than −0.30 inch, less than −0.35 inch, less than −0.40 inch, less than −0.45 inch, or less than −0.50 inch.

In high-MOI embodiments, the club head 100 can comprise a CGz position measured from the geometric center 120 of the strike face 102 between −1.25 inch and −2.0 inches. In some high-MOI embodiments, the CGz position can be between −1.25 inch and −1.30 inch, between −1.30 inch and −1.35 inch, between −1.35 inch and −1.40 inch, between −1.40 inch and −1.45 inch, between −1.45 inch and −1.50 inch, between −1.50 inch and −1.55 inch, between −1.55 inch and −1.60 inch, between −1.60 inch and −1.65 inch, between −1.65 inch and −1.70 inch, between −1.70 inch and −1.75 inch, between −1.75 inch and −1.80 inch, between −1.80 inch and −1.85 inch, between −1.85 inch and −1.90 inch, between −1.90 inch and −1.95 inch, or between −1.95 inch and −2.0 inches. In some high-MOI embodiments, the CGz position can be less than −1.25 inch, less than −1.30 inch, less than −1.35 inch, less than −1.40 inch, less than −1.45 inch, less than −1.50 inch, less than −1.55 inch, less than −1.60 inch, less than −1.65 inch, less than −1.70 inch, less than −1.75 inch, less than −1.80 inch, less than −1.85 inch, less than −1.90 inch, less than −1.95 inch, or less than −2.0 inches.

In low-MOI embodiments, the club head 100 can comprise a CGy position measured from the geometric center 120 of the strike face 102 between −0.30 inch and 0.30 inch. In some low-MOI embodiments, the CGy position can be between −0.30 inch and −0.25 inch, between −0.25 inch and −0.20 inch, between −0.20 inch and −0.15 inch, between −0.15 inch and −0.10 inch, between −0.10 inch and −0.05 inch, between −0.05 inch and 0 inches, between 0 inches and 0.05 inch, between 0.05 inch and 0.10 inch, between 0.10 inch and 0.15 inch, between 0.15 inch and 0.20 inch, between 0.20 inch and 0.25 inch, or between 0.25 inch and 0.30 inch. In some low-MOI embodiments, the CGy position can be less than 0.30 inch, less than 0.25 inch, less than 0.20 inch, less than 0.15 inch, less than 0.10 inch, less than 0.05 inch, less than 0 inches, less than −0.05 inch, less than −0.10 inch, less than −0.15 inch, less than −0.20 inch, less than −0.25 inch, or less than −0.30 inch.

In low-MOI embodiments, the club head 100 can comprise a CGz position measured from the geometric center 120 of the strike face 102 between −1.0 inch and −1.75 inch. In some low-MOI embodiments, the CGz position can be between −1.0 inch and −1.05 inch, between −1.05 inch and −1.10 inch, between −1.10 inch and −1.15 inch, between −1.15 inch and −1.20 inch, between −1.20 inch and −1.25 inch, between −1.25 inch and −1.30 inch, between −1.30 inch and −1.35 inch, between −1.35 inch and −1.40 inch, between −1.40 inch and −1.45 inch, between −1.45 inch and −1.50 inch, between −1.50 inch and −1.55 inch, between −1.55 inch and −1.60 inch, between −1.60 inch and −1.65 inch, between −1.65 inch and −1.70 inch, or between −1.70 inch and −1.75 inch. In some high-MOI embodiments, the CGz position can be less than −1.0 inch, less than −1.05 inch, less than −1.10 inch, less than −1.15 inch, less than −1.20 inch, less than −1.25 inch, less than −1.30 inch, less than −1.35 inch, less than −1.40 inch, less than −1.45 inch, less than −1.50 inch, less than −1.55 inch, less than −1.60 inch, less than −1.65 inch, less than −1.70 inch, or less than −1.75 inch.

In many embodiments (high-MOI or low-MOI), the CG 160 position can be characterized by a perpendicular distance between the CG 160 and the force line 125 (defined above as an axis extending through the geometric center 120 and parallel to the loft plane 1015). In many embodiments, the CG 160 is located substantially close to force line 125 to provide maximum transfer of energy between the club head 100 and the golf ball on shots struck at the geometric center 120. In many embodiments, the CG 160 can be located within 0.05 inch of the force line 125. In many embodiments, the CG 160 can be located within 0.045 inch, within 0.040 inch, within inch, within 0.030 inch, within 0.025 inch, within 0.020 inch, within 0.015 inch, or within inch of the force line 125.

II. Ixx/Iyy Ratio

The club head comprises a high Ixx moment of inertia relative to the Iyy target. Relative to a fixed Iyy target, increasing Ixx is crucial in increasing club head performance and forgiveness. As such, the club head comprises a high Ixx/Iyy ratio. In many embodiments, the club head can comprise an Ixx/Iyy ratio between 0.80 and 1.0. In some embodiments, the club head can comprise an Ixx/Iyy ratio greater than 0.82, greater than 0.84, greater than 0.85, greater than 0.86, greater than 0.88, or greater than 0.90. As illustrated in further detail in the examples below, the present club head can comprise an Ixx/Iyy ratio that is increased by more than 3%, more than 5%, more than 10%, more than 15%, more than 20%, more than 25%, more than 30%, more than 35%, more than 40%, more than 45%, or more than 50% relative to a prior-art club head that focuses only on maximizing Iyy. For example, many prior-art club heads comprise an Ixx/Iyy ratio between 0.6 and 0.77. Providing a club head with and Ixx/Iyy ratio of 0.8 therefore represents a 4% to 33% increase over the prior-art, depending on which prior-art club head is considered. Providing and even greater Ixx/Iyy ratio (greater than 0.82, greater than 0.84, etc.) represents an even greater increase over the prior art. This increased Ixx/Iyy can achieved by the cube-like shaping of the club head and by distributing a large portion of the club head mass near the Y'-axis.

a. Cube-Like Club Head Shaping

As described above, the club head comprising a given Iyy target value can comprise a high Ixx/Iyy ratio to improve performance. The shaping of the club head is fundamental to efficiently maximizing the Ixx/Iyy ratio. The club head body shape dictates where discretionary mass can be placed. FIGS. 1-10 illustrate a club head 100 comprising cube-like shape configured to increase the Ixx/Iyy ratio. The cube-like profile spaces more of the club head mass away from the X'-axis 1070 (i.e. toward the crown 110 and sole 112) and near the Y'-axis 1080. Spacing mass away from the X'-axis 1070 increases Ixx, thereby reducing the rotation about the X'-axis 1070 at impact and balancing the spin imparted on the golf ball. Providing mass near the Y'-axis 1080 provides a lower contribution to Iyy to keep the club head 100 at the desired Iyy target. The cube-like profile provides a relatively taller body height than the flatter prior-art club heads, which effectively increases the distance of the crown 110 and the sole 112 from the X'-axis 1070. Therefore, the mass of the crown 110 and the sole 112 provides an increased Ixx contribution without increasing the Iyy contribution. The cube-like profile increases Ixx without providing a significant increase in Iyy, thereby providing a higher Ixx/Iyy ratio. In contrast, prior-art club heads seek to maximize Iyy without much regard for Ixx. Such prior art club heads therefore tend to place discretionary mass deep (i.e. proximate the rear end 111) and wide (i.e. proximate the heel 104 and the toe 106) to provide mass as far away from the Y'-axis as possible.

Relative to flatter and wider prior art club heads, the club head of the present invention may comprise a body height $H_B$ that is substantially similar to the body width $W_B$ and the body depth $D_B$. Compared to the prior art, the cube-like body dimensions can be achieved by increasing the body height $H_B$, reducing the body width $W_B$ and body depth $D_B$, over the flatter designs of the prior art, or a combination thereof. Referring to FIG. 2, the club head 100 can comprise a body height $H_B$ (defined above) measured between the ground plane 1010 and the highest point of the crown 110. In some embodiments, the body height $H_B$ can be between 2.0 and 3.0 inches. In some embodiments, the body height $H_B$ can be between 2.0 and 2.1 inches, between 2.1 inches and 2.2 inches, between 2.2 inches and 2.3 inches, between 2.3 inches and 2.4 inches, between 2.4 inches and 2.5 inches, between 2.5 inches and 2.6 inches, between 2.6 inches and 2.7 inches, between 2.7 inches and 2.8 inches, between 2.8 inches and 2.9 inches, or between 2.9 inches and 3.0 inches. In some embodiments, the body height $H_B$ can be greater than 2.0 inches, greater than 2.1 inches, greater than 2.2 inches, greater than 2.3 inches, greater than 2.4 inches, greater than 2.5 inches, greater than 2.5 inches, greater than 2.6 inches, greater than 2.7 inches, greater than 2.8 inches, greater than 2.9 inches, or greater than 3.0 inches. In many embodiments, the body height $H_B$ can be substantially tall relative to the body width $W_B$ and body depth $D_B$.

The club head 100 can further comprise a body width $W_B$ (defined above) measured between the heel apex 116 and the toe apex 119. In some embodiments, the body width $W_B$ can be between 3 and 5 inches. In some embodiments, the body width $W_B$ can be between 3.0 inches and 3.2 inches, between 3.2 inches and 3.4 inches, between 3.4 inches and 3.6 inches, between 3.6 inches and 3.8 inches, between 3.8 inches and 4.0 inches, between 4.0 inches and 4.2 inches, between 4.2 inches and 4.4 inches, between 4.4 inches and 4.6 inches, between 4.6 inches and 4.8 inches, or between 4.8 inches and 5.0 inches. In some embodiments, the body width $W_B$ can be less than 5.0 inches, less than 4.8 inches, less than 4.6 inches, less than 4.4 inches, less than 4.2 inches, less than 4.0 inches, less than 3.8 inches, less than 3.6 inches, less than 3.4 inches, less than 3.2 inches, or less than 3.0 inches. In many low-MOI embodiments, the body width $W_B$ can be substantially narrow relative to the width of a prior art club head. In many low-MOI embodiments, the body width $W_B$ can be less than 4.5 inches.

Referring to FIG. 4, the club head 100 can further comprise a body depth $D_B$ (defined above) measured between the leading edge 103 and a rearward-most point 117 of the body 101. In some embodiments, the body depth $D_B$ can be between 3 and 5 inches. In some embodiments, the body depth $D_B$ can be between 3.0 inches and 3.2 inches, between 3.2 inches and 3.4 inches, between 3.4 inches and 3.6 inches, between 3.6 inches and 3.8 inches, between 3.8 inches and 4.0 inches, between 4.0 inches and 4.2 inches, between 4.2 inches and 4.4 inches, between 4.4 inches and 4.6 inches, between 4.6 inches and 4.8 inches, or between 4.8 inches and 5.0 inches. In some embodiments, the body depth $D_B$ can be less than 5.0 inches, less than 4.8 inches, less than 4.6 inches, less than 4.4 inches, less than 4.2 inches, less than 4.0 inches, less than 3.8 inches, less than 3.6 inches, less than 3.4 inches, less than 3.2 inches, or less than 3.0 inches. In many low-MOI embodiments, the body depth $D_B$ can be substantially narrow relative to the depth of a prior art club head. In many low-MOI embodiments, the body depth $D_B$ can be less than 4.0 inches.

The cube-like shape of the club head 100 can be characterized by a $H_B/W_B$ ratio defined as the body height $H_B$ divided by the body width $W_B$. In many embodiments, the $H_B/W_B$ ratio can be between 0.50 and 0.75. In some embodiments, the $H_B/W_B$ ratio can be between 0.50 and 0.55, between 0.55 and 0.60, between 0.60 and 0.65, between 0.65 and 0.70, or between 0.70 and 0.75. In some embodiments, the $H_B/W_B$ ratio can be greater than 0.50, greater than 0.55, greater than 0.60, greater than 0.65, greater than 0.70, or greater than 0.75. By providing a high $H_B/W_B$ ratio, the club head 100 is provided with a cube-like shape that spaces mass away from the X'-axis and near the Y'-axis.

Similarly, the cube-like shape of the club head 100 can be characterized by a $H_B/D_B$ ratio defined as the body height $H_B$ divided by the body depth $D_B$. In many embodiments, the $H_B/D_B$ ratio can be between 0.5 and 0.75. In some embodiments, the $H_B/D_B$ ratio can be between 0.50 and 0.55, between 0.55 and 0.60, between 0.60 and 0.65, between 0.65 and 0.70, or between 0.70 and 0.75. in some embodiments, the $H_B/D_B$ ratio can be greater than 0.50, greater than 0.55, greater than 0.60, greater than 0.65, greater than 0.70, or greater than 0.75. By providing a high $H_B/D_B$ ratio, the club head 100 is provided with a cube-like shape that spaces mass away from the X'-axis and near the Y'-axis. Accordingly, the cube-like shape increases the Ixx moment of inertia without providing a significant contribution to Iyy that would increase Iyy over the target value. In many embodiments, the $H_B/W_B$ ratio and the $H_B/D_B$ ratio can be substantially greater than the flatter prior-art club heads, which comprise $H_B/W_B$ ratios and $H_B/D_B$ ratios that are each less than or equal to 0.50.

The cube-like shape of the club head 100 can be further characterized by a summation of the $H_B/W_B$ ratio and the $H_B/D_B$ ratio. A perfectly cube-shaped club head would have a $H_B/W_B$ ratio and a $H_B/D_B$ ratio that are each equal to 1. Therefore, said perfectly cube-shaped club head would have a summation of the $H_B/W_B$ ratio and a $H_B/D_B$ ratio equal to 2. In many embodiments, the present club head 100 can comprise a summation of $H_B/W_B$ ratio and $H_B/D_B$ ratio between 1.2 and 1.5. In some embodiments, the club head 100 comprises a summation of $H_B/W_B$ ratio and $H_B/D_B$ ratio greater than 1.2, greater than 1.25, greater than 1.30, greater than 1.35, greater than 1.40, greater than 1.45, or greater than 1.50. Therefore, in many embodiments, the club head comprises a summation of $H_B/W_B$ ratio and $H_B/D_B$ ratio that can be between 60% and 75% of that of a perfectly cube-shaped club head. In many embodiments, the summation of the $H_B/W_B$ ratio and a $H_B/D_B$ ratio can be substantially greater than the flatter prior-art club heads, which tend to comprise a summation value less than or equal to 1.00.

Figure 7:
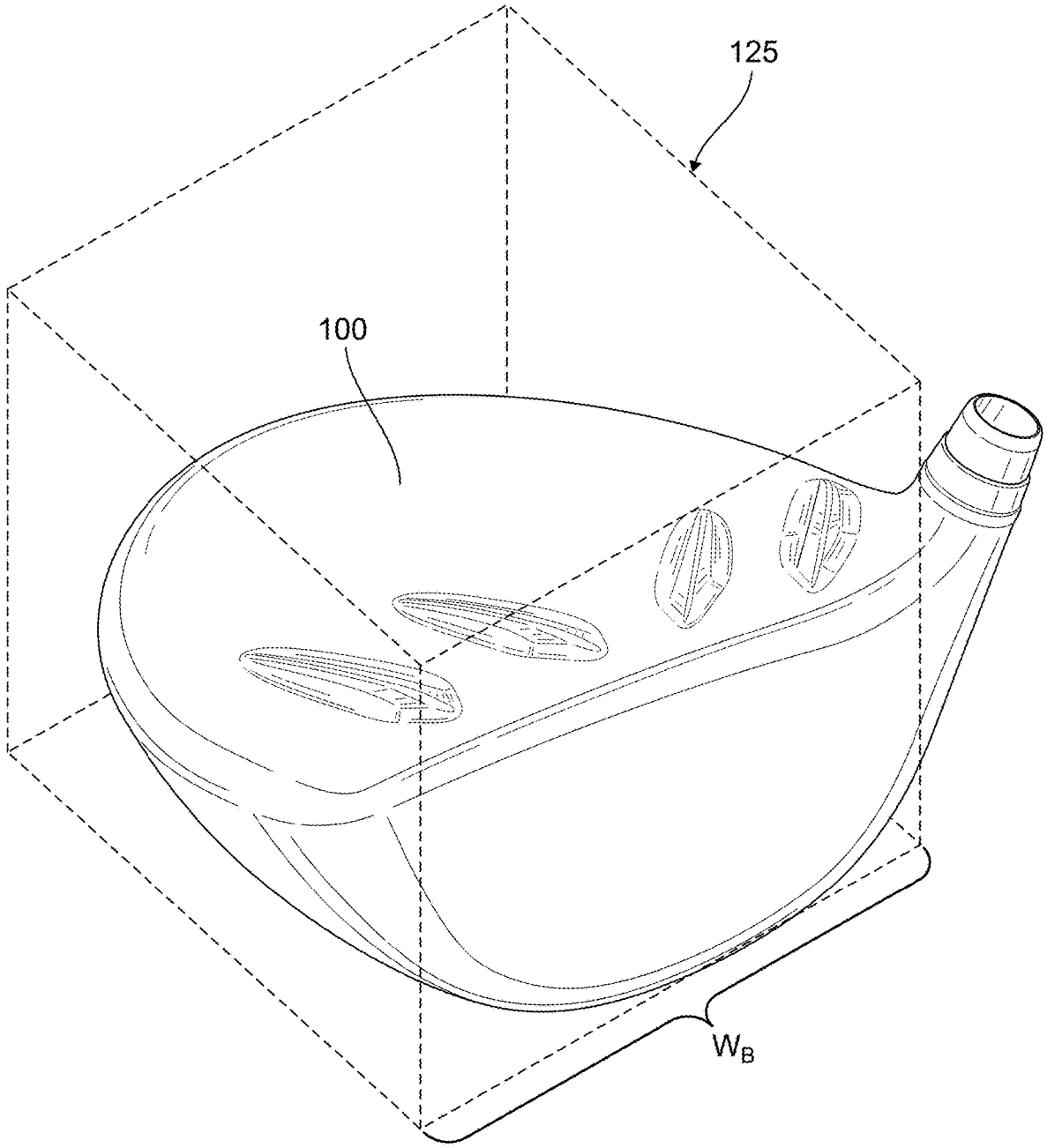
FIG. 7 illustrates a front perspective view of the golf club head of FIG. 1 within an imaginary reference cube.

Referring to FIG. 7, the cube-like shape of the club head 100 can be further characterized in relation to the volume of a reference cube 125. The club head 100 can define a reference cube 125 wherein each side of the reference cube 125 is equal in length to the body width $W_B$. The reference cube 125 thereby defines a cubical reference volume equal to the body width $W_B$ cubed ($W_B^3$). The club head 100 can define a cubical volume ratio defined as the club head volume divided by the cubical reference volume. In many embodiments, the club head 100 can comprise a cubical volume ratio between 0.28 and 0.40. In some embodiments, the club head 100 can comprise a cubical volume ratio greater than 0.28, greater than 0.29, greater than 0.30, greater than 0.31, greater than 0.32, greater than 0.33, greater than 0.34, greater than 0.35, greater than 0.36, greater than 0.37, greater than 0.38, greater than 0.39, or greater than 0.40.

The greater the cubical volume ratio, the more cube-like the shape of the club head 100. For example, the cube-shaped club head 100 comprises a tall body 101 relative to the body width $W_B$ and body depth $D_B$. Therefore, the cube-shaped club head 100 effectively "fills" a greater percentage of the reference cube 125. In contrast, many prior art club heads comprise shorter and flatter profiles. Such prior art club heads would therefore fill a lesser percentage of a reference cube defined by the prior art body width. Many prior art club heads comprising flatter body profiles comprise cubical volume ratios less than 0.25.

The club head 100 can further comprise a gradual crown angle 172 that contributes to the cube-like shape. As illustrated in FIG. 6, the club head 100 comprises a crown axis 170 that extends between a crown transition point 174 and a rear transition point 176. The crown transition point 174 and the rear transition point 176 can both be located within the YZ plane. The crown transition point 174 can be located at a forwardmost point of the crown 110 within the YZ plane. At the crown transition point 174, the curvature of the crown deviates to a transition curvature between the crown 110 and the strike face 102. The rear transition point 176 can be located at a rearmost point of the crown 110 within the YZ plane. At the rear transition point 176, the curvature of the crown deviates to a transition curvature between the crown 110 and the rear end 111.

The club head 100 comprises a crown angle 170 measured as the acute angle between the crown axis 170 and the Y-axis 1050. In many embodiments, the club head 100 comprises a crown angle 170 between 75° and 89° In some embodiments, the club head 100 comprises a crown angle 170 greater than 75°, greater than 76°, greater than 77°, greater than 78°, greater than 79°, greater than 80°, greater than 81°, greater than 82°, greater than 83°, greater than 84°, greater than 85°, greater than 86°, greater than 87°, greater than 88°, or greater than 89°.

A crown angle 170 within the ranges listed above can be substantially large in comparison to the prior art, as prior art club heads commonly comprise a steep crown angle to lower the club head center of gravity. The large crown angle 170 of the present club head 100 provides a gradually downward sloping crown 110 from the front end 108 to the rear end 111. The large crown angle 170 raises the CG 160, thereby increasing the Ixx contribution of any discretionary mass placed near the sole 112. Further, a larger crown angle 170 increases the distance between the mass forming the crown 110 and the X'-axis 1070 with negligible effect on the distance between the mass of the crown and the Y'-axis 1080. Therefore, an increased crown angle 170 provides a greater Ixx contribution with negligible contribution to Iyy, thereby increasing the Ixx/Iyy ratio.

Referring to FIGS. 5 and 6, the cube-like shape of the club head 100 can be further characterized by the dimensions of the strike face 102. The club head 100 can comprise a substantially square strike face profile wherein the strike face height $H_{SF}$ and the strike face width $W_{SF}$ are substantially similar to one another. As illustrated in FIGS. 5 and 6, the club head 100 can comprise a strike face height $H_{SF}$ (defined above) between 1.5 and 2.75 inches. In some embodiments, the strike face height $H_{SF}$ can be between 1.5 inches and 1.75 inches, between 1.75 inches and 2.0 inches, between 2.0 inches and 2.25 inches, between 2.25 inches and 2.50 inches, or between 2.50 inches and 2.75 inches. In some embodiments, the strike face height $H_{SF}$ can be greater than 1.5 inches, greater than 1.75 inches, greater than 2.0 inches, greater than 2.25 inches, greater than 2.50 inches, or greater than 2.75 inches. Due to the cube-like shape of the club head 100, the strike face height $H_{SF}$ can be substantially tall in relation to the strike face width $W_{SF}$, compared to the relative heights and widths of prior-art strike faces.

Further, the club head 100 can comprise a strike face width $W_{SF}$ (defined above) between 2.0 and 3.75 inches. In some embodiments, the strike face width $W_{SF}$ can be between 2.0 inches and 2.25 inches, between 2.25 inches and 2.50 inches, between 2.50 inches and 2.75 inches, between 2.75 inches and 3.0 inches, between 3.0 inches and 3.25 inches, between 3.25 inches and 3.50 inches, or between 3.50 inches and 3.75 inches. In some embodiments, the strike face width $W_{SF}$ can be less than 3.75 inches, less than 3.50 inches, less than 3.25 inches, less than 3.0 inches, less than 2.75 inches, less than 2.50 inches, less than 2.25 inches, or less than 2.0 inches. Due to the cube-like shape of the club head 100, the strike face width $W_{SF}$ can be substantially narrow in relation to the shorter and wider prior-art strike faces. In many low-MOI embodiments, the strike face width $W_{SF}$ can be less than 3.0 inches.

The substantially square profile of the strike face 102 can be characterized by a strike face aspect ratio. The strike face aspect ratio is defined as the ratio of the strike face height $H_{SF}$ divided by the strike face width $W_{SF}$. In many embodiments, the strike face aspect ratio can be between 0.70 and 0.90. In some embodiments, the strike face aspect ratio can be between 0.70 and 0.72, between 0.72 and 0.74, between 0.74 and 0.76, between 0.76 and 0.78, between 0.78 and 0.80, between 0.80 and 0.82, between 0.82 and 0.84, between 0.84 and 0.86, between 0.86 and 0.88, or between 0.88 and 0.90 In some embodiments, the strike face aspect ratio can be greater than 0.70, greater than 0.72, greater than 0.74, greater than 0.76, greater than 0.78, greater than 0.80, greater than 0.82, greater than 0.84, greater than 0.86, greater than 0.88, or greater than 0.90. The present club head 100 comprises a higher aspect ratio that the shorter, flatter strike faces of prior-art club heads. The substantially square profile of the strike face 102 corresponds to the cube-like shape of the overall club head profile, all of which contributes to an increase in the Ixx/Iyy ratio.

The club head 100 can comprise a club head volume suitable for a driver-type club head. For high-MOI embodiments, the club head 100 can comprise a volume between 350 $g*cm^3$ and 460 $g*cm^3$. In some high-MOI embodiments, the club head 100 can comprise a volume between 350 $g*cm^3$ and 370 $g*cm^3$, 370 $g*cm^3$ and 390 $g*cm^3$, 390 $g*cm^3$ and 410 $g*cm^3$, 410 $g*cm^3$ and 430 $g*cm^3$, 430 $g*cm^3$ and 450 $g*cm^3$, or 450 $g*cm^3$ and 460 $g*cm^3$. In some high-MOI embodiments, the club head 100 can comprise a volume greater than 350 $g*cm^3$, greater than 370 $g*cm^3$, greater than 390 $g*cm^3$, greater than 410 $g*cm^3$, greater than 430 $g*cm^3$, greater than 450 $g*cm^3$, or greater than 460 $g*cm^3$.

In low-MOI embodiments, the club head volume can be significantly lower than that of a typical prior-art club head. A high club head volume will naturally increase Iyy. Given a low Iyy target, providing a lower club head volume increases the ability to place discretionary mass in way that increases Ixx and provides a higher Ixx/Iyy ratio. In many embodiments. In many low-MOI embodiments, the club head 100 may comprise a volume between 200 and 350 $cm^3$. In some low-MOI embodiments, the club head 100 may comprise a volume between 200 and 220 $cm^3$, between 220 and 240 $cm^3$, between 240 and 260 $cm^3$, between 260 and 280 $cm^3$, between 280 and 300 $cm^3$, between 300 and 320 $cm^3$, between 320 and 340 $cm^3$, or between 340 and 350 $cm^3$. In some low-MOI embodiments, the club head 100 can comprise a volume less than 350 $cm^3$, less than 340 $cm^3$, less than 320 $cm^3$, less than 300 $cm^3$, less than 280 $cm^3$, less than 260 $cm^3$, less than 240 $cm^3$, less than 220 $cm^3$, or less than 200 $cm^3$.

The cube-like shaping of the club head body 101, as characterized above, provides a club head 100 with an increased Ixx/Iyy ratio. The unique shaping of the present club head can also affect the club head aerodynamic properties. Overall, in many low-MOI embodiments, the aerodynamic properties will be improved due to the smaller size of the club head 100. As described above, the low-MOI embodiments generally comprise a smaller club head volume, which is associated with smaller body dimensions (body height $H_B$, body depth $D_B$, and body width $W_B$, less surface area, and smaller projected areas. As such, the smaller club head profile reduces the amount of drag force on the club head 100 throughout the swing, allowing players to swing faster and hit the golf ball further. However, in some embodiments, a more cube-like body shape can be less aerodynamic than a flatter club head of the same volume. To compensate for any increased drag associated with the cube-like body shape, the club head 100 can further comprise one or more aerodynamic features or properties such as turbulators or aerodynamic transition curvatures, all of which are described in further detail below in the "Additional Features" section. Therefore, the club head 100 achieves a balance between the Ixx/Iyy ratio and aerodynamics.

III. Club Head Mass Distribution

In addition to shaping and body dimensions of the club head 100, the effectiveness in maximizing the Ixx/Iyy ratio depends on the club head's mass distribution. In particular, achieving a high Ixx/Iyy ratio depends on placing a large portion of the club head's discretionary mass proximate the Y'-axis 1080, yet spaced away from the X'-axis 1070. In doing so, said discretionary mass provides a significant contribution to increasing Ixx without raising Iyy over the target value. The club head therefore comprises a high percentage of its total mass around the Y'-axis 1080. In contrast, many prior-art club heads, which focus only on maximizing Iyy rather than the Ixx/Iyy ratio, seek to place all discretionary mass as far away from the Y'-axis as possible.

Figure 8:
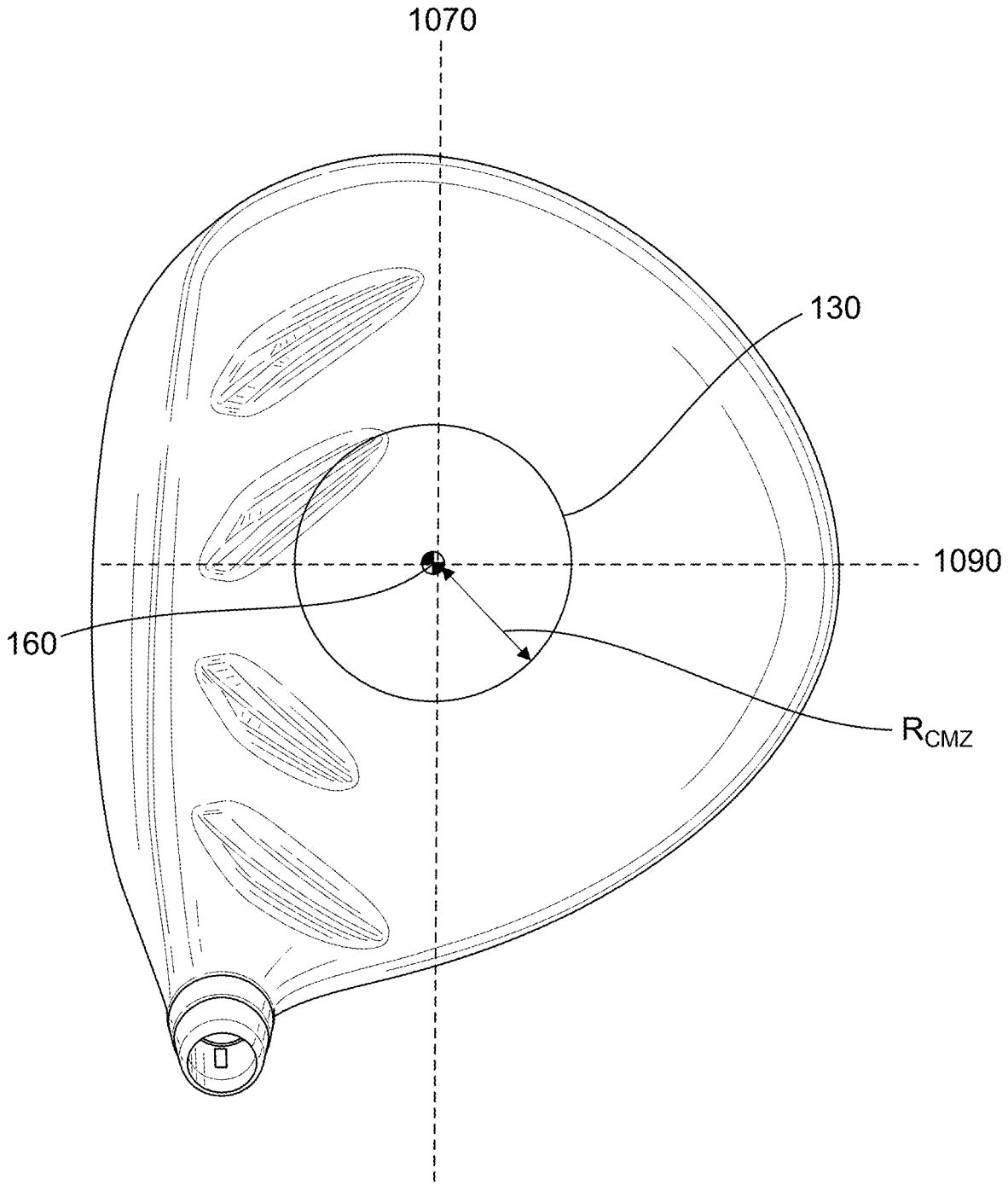
FIG. 8 illustrates a top view of the golf club head of FIG. 1, highlighting an imaginary central mass zone.
Figure 9:
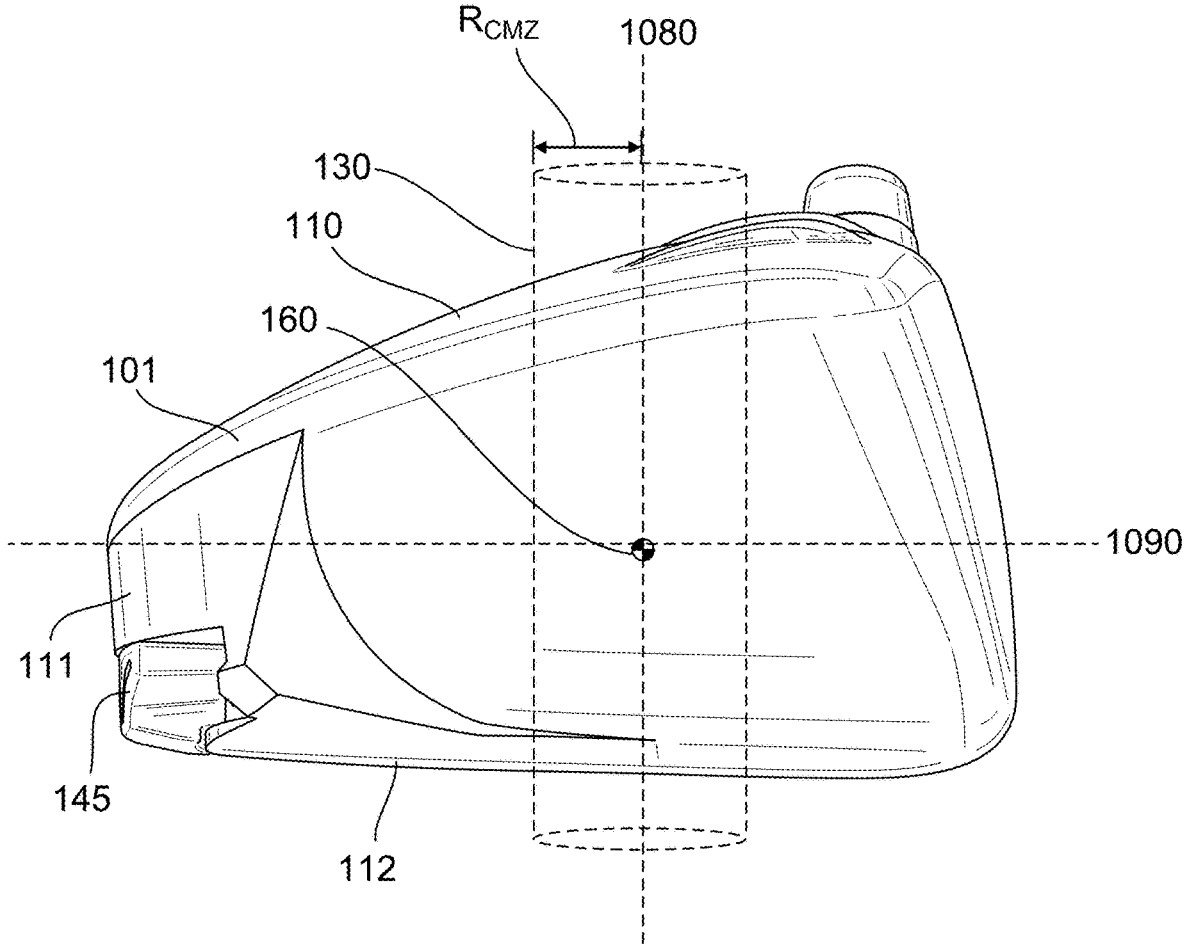
FIG. 9 illustrates a toe-side view of the golf club head of FIG. 1, highlighting imaginary central mass zone.

The club head's mass distribution may be characterized by the amount of club head mass located within a central mass zone 130. Referring to FIGS. 8 and 9, the central mass zone 130 is defined by an imaginary cylinder centered about the Y'-axis 1080 and extending through the entire club head body 101 from crown 110 to sole 112. The size of the central mass zone 130 is determined by the central mass zone radius $R_{CMZ}$. The central mass radius $R_{CMZ}$ can be between inch and 1.5 inch, measured perpendicular to the Y'-axis 1080. In some embodiments, the central mass zone radius can be 0.50 inch, 0.55 inch, 0.60 inch, 0.65 inch, 0.70 inch, 0.75 inch, inch, 0.85 inch, 0.90 inch, 0.95 inch, 1.00 inch, 1.05 inch, 1.10 inch, 1.15 inch, 1.20 inch, 1.25 inch, 1.30 inch, 1.35 inch, 1.40 inch, 1.45 inch, or 1.50 inch. In many embodiments, the central mass zone radius $R_{CMZ}$ is 0.75 inch. The greater the proportion of the club head mass is located within the central mass zone 130, the less said mass contributes to an increase in Iyy while still providing a significant increase in Ixx. The club head's effectiveness in increasing the Ixx/Iyy ratio may therefore be directly related to the amount of club head mass located within the central mass zone 130.

In many embodiments, the mass distribution of the club head 100 can be characterized by a percentage of the total club head mass that is bounded within the central mass zone 130. In some embodiments, between 10% and 50% of the total club head mass can be located within the central mass zone 130. In some embodiments, greater than 15%, greater than 20%, greater than 25%, greater than 30%, greater than 35%, greater than 40%, greater than 45%, or greater than 50% of the total club head mass can be located within the central mass zone 130. The percentage of the total club head mass located within the central mass zone 130 is highly dependent on the central mass zone radius $R_{CMZ}$ that is selected. In many embodiments, the mass percentage within the central mass zone 130 can be evaluated in view of a central mass zone radius $R_{CMZ}$ of 0.75 inch. In many embodiments, greater than 15%, greater than 20%, greater than 25%, greater than 30%, greater than 35%, or greater than 40% of the total club head mass can be located within a central mass zone 130 with a radius $R_{CMZ}$ equal to 0.75 inch.

In some embodiments, the club head's mass distribution may be further characterized by the size of a central mass zone 130 that contains a certain percentage of the total club head mass. For example, in some embodiments, 30% of the total club head mass can be located within a central mass zone 130 comprising a central mass zone radius $R_{CMZ}$ (measured perpendicular to the Y'-axis 1080) less than 1.50 inch, less than 1.45 inch, less than 1.40 inch, less than 1.35 inch, less than 1.30 inch, less than 1.25 inch, less than 1.20 inch, less than 1.15 inch, less than 1.10 inch, less than 1.05 inch, less than 1.00 inch, less than 0.95 inch, less than 0.90 inch, less than 0.85 inch, less than 0.80 inch, less than 0.75 inch, less than 0.70 inch, less than 0.65 inch, less than 0.60 inch, less than 0.55 inch, or less than 0.50 inch. The club head 100 therefore comprises a small central mass zone 130 that contains a significant proportion (30%) of the total club head mass. Thereby, a large proportion of the club head mass is located proximate the Y'-axis 1080, which increases the Ixx/Iyy ratio.

Further, the club head's mass distribution may be further characterized by a first mass distribution metric ($MD_1$). The first mass distribution metric $MD_1$ quantifies the efficiency of mass placement proximate the Y'-axis 1080 by relating the percentage of total club head mass within the central mass zone 130 to the size of the central mass zone 130. The first mass distribution metric $MD_1$ is defined as follows:

$$MD_1 = \frac{M_{CMZ}}{M_T * R_{CMZ}} * 1 \text{ in.}$$

wherein $M_{CMZ}$ is the mass within the central mass zone 130, $M_T$ is the total club head mass, and $R_{CMZ}$ is the central mass zone radius within the ranges of radii described above. In many embodiments, the club head 100 can comprise a first mass distribution metric $MD_1$ greater than 0.10. In some embodiments, the club head 100 can comprise a first mass distribution metric $MD_1$ between 0.10 and 0.15, between 0.15 and 0.20, between 0.20 and 0.25, between 0.25 and 0.30, between 0.30 and 0.35, between 0.35 and 0.40, between 0.40 and 0.45, or between 0.45 and 0.50. In some embodiments, the club head 100 can comprise a first mass distribution metric $MD_1$ greater than 0.10, greater than 0.15, greater than 0.20, greater than 0.25, greater than 0.30, greater than 0.35, greater than 0.40, greater than 0.45, or greater than 0.50. The larger the percentage of club head mass within the central mass zone 130 and the smaller the central mass zone radius $R_{CMZ}$ of said central mass zone 130, the greater the first mass distribution metric and the more efficiently the mass distribution of the club head 100 increases the Ixx/Iyy ratio.

Further, the club head's mass distribution may be further characterized by a second mass distribution metric ($MD_2$). The second mass distribution metric $MD_2$ characterizes the amount of mass placed proximate the Y'-axis 1080 relative to the volume of the club head 100. The second mass distribution metric $MD_2$ is defined as follows:

$$MD_2 = \frac{M_{CMZ}}{M_T * V} * 1000 \text{ cm}^3$$

wherein $M_{CMZ}$ is the mass within the central mass zone 130, $M_T$ is the total club head mass, and V is the club head volume. In many embodiments, the club head 100 can comprise a second mass distribution metric $MD_2$ greater than 0.5. In some embodiments, club head 100 can comprise a second mass distribution metric $MD_2$ between 0.50 and 0.55, between 0.55 and 0.60, between 0.60 and 0.65, between 0.65 and 0.70, between 0.70 and 0.75, between 0.75 and 0.80, between 0.80 and between 0.85 and 0.90, between 0.90 and 0.95, or between 0.95 and 1.00. In some embodiments, club head 100 can comprise a second mass distribution metric $MD_2$ greater than greater than 0.55, greater than 0.60, greater than 0.65, greater than 0.70, greater than 0.75, greater than 0.80, greater than 0.85, greater than 0.90, greater than 0.95, or greater than 1.00. Because the club head 100 comprises a substantially large percentage of mass within the central mass zone 130 and a substantially small volume in comparison to the prior art, the second mass distribution metric $MD_2$ will be significantly larger than that of the prior art.

Further, the club head's mass distribution may be further characterized by a third mass distribution metric ($MD_3$). The third mass distribution metric $MD_3$ characterizes the amount of mass placed proximate the Y'-axis 1080 relative to the club head Iyy. The third mass distribution metric $MD_3$ is defined as follows:

$$MD_3 = \frac{M_{CMZ}}{M_T * Iyy} * 1000 \text{ g} * \text{cm}^2$$

wherein $M_{CMZ}$ is the mass within the central mass zone 130 and $M_T$ is the total club head mass. In many embodiments, the club head 100 can comprise a third mass distribution metric $MD_3$ greater than 0.050. In some embodiments, club head 100 can comprise a third mass distribution metric $MD_3$ between 0.050 and 0.060, between 0.060 and 0.070, between 0.070 and 0.080, between 0.080 and 0.090, between 0.090 and 0.100, between 0.100 and 0.110, between 0.110 and 0.120, between 0.120 and 0.130, between 0.130 and 0.140, between 0.140 and 0.150, between 0.150 and 0.160, between 0.160 and 0.170, between 0.170 and 0.180, between 0.180 and 0.190, or between 0.190 and 0.200, In some embodiments, club head 100 can comprise a third mass distribution metric $MD_3$ greater than 0.050, greater than 0.060, greater than 0.070, greater than 0.080, greater than greater than 0.100, greater than 0.110, greater than 0.120, greater than 0.130, greater than greater than 0.150, greater than 0.160, greater than 0.170, greater than 0.180, greater than or greater than 0.200. Because the club head 100 comprises a substantially large percentage of mass within the central mass zone 130 and a substantially low Iyy target in comparison to the prior art, the third mass distribution metric $MD_3$ will be significantly larger than that of the prior art.

a. Mass Pads

Figure 10:
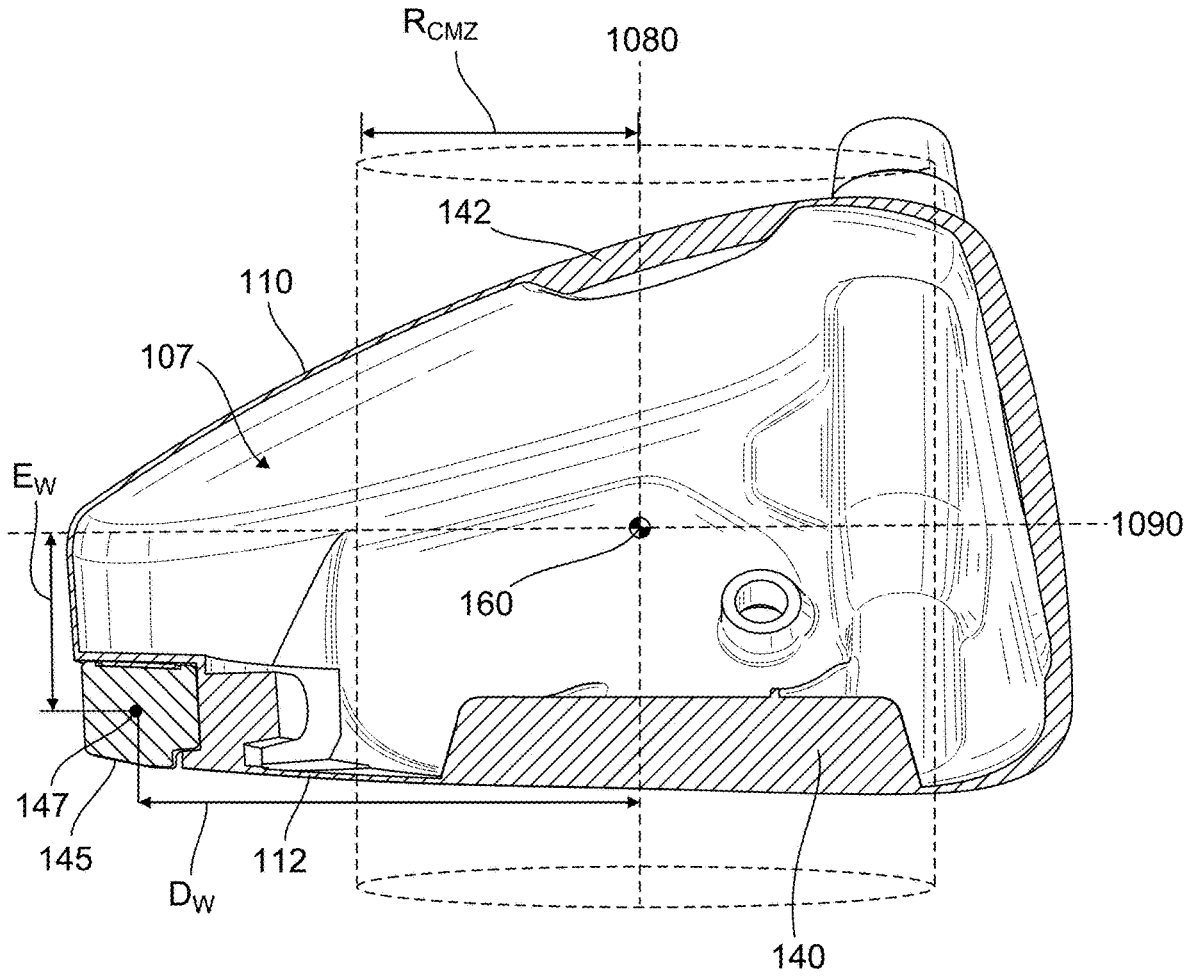
FIG. 10 illustrates a toe-side cross-sectional view of the golf club head of FIG. 1.

In many embodiments, the club head can comprise one or more mass pads strategically placed to increase the Ixx/Iyy ratio. The one or more mass pads can be integrally formed with a portion of the sole 112, a portion of the crown 110, a portion of the heel 104, a portion of the toe 106, or any combination thereof. As illustrated in FIG. 10, the club head 100 comprises a sole mass pad 140 formed integrally with an interior surface of the sole 112 and extending into the interior cavity 107. Similarly, the club head 100 illustrated in FIG. 10 comprises a crown mass pad 142 formed integrally with an interior surface of the crown 110 and extending into the interior cavity 107. In other embodiments, the club head 100 can comprise any combination of crown mass pads, sole mass pads, or other mass pads located on different portions of the body 101. While the sole mass pad 140 and the crown mass pad 142 of the present embodiment are shown and described as being integral with the body 101, in other embodiments, one or more mass pads can be a separate member that is coupled to the club head body 101 via welding, brazing, mechanical coupling, adhesive coupling, or any other suitable means.

In many embodiments, the sole mass pad 140 and the crown mass pad 142 can be located at or near the Y'-axis 1080, such that all or a majority of the sole mass pad 140 and/or crown mass pad 142 fits within the central mass zone 130. As such, the sole mass pad 140 and the crown mass pad 142 provide a significant contribution to Ixx with a negligible contribution to Iyy, thereby increasing the Ixx/Iyy ratio. In many embodiments, such as the illustrated embodiment of FIG. 10, the sole mass pad 140 and/or the crown mass pad 142 can be intersected by the Y'-axis. The proximity of any of the mass pads (i.e. the sole mass pad 140 and/or the crown mass pad 142) to the Y'-axis may be characterized by the size of a central mass zone 130 (as described above) that bounds the entirety of the mass pad. For example, in some embodiments, the sole mass pad 140 and/or the crown mass pad 142 can be entirely bounded within a central mass zone 130 having a central mass zone radius $R_{CMZ}$ less than 2.00 inches, less than 1.75 inches, less than 1.50 inches, less than 1.25 inches, less than 1.00 inch, less than 0.75 inch, less than 0.50 inch, or less than 0.25 inch. The smaller the central mass zone radius $R_{CMZ}$ that bounds the entirety of a mass pad, the more efficient said mass pad is at increasing the Ixx/Iyy ratio. A mass pad bounded within a small central mass zone 130 provides a greater contribution to Ixx than to Iyy, as compared to a similar mass pad of the same mass that does not fit within said central mass zone 130. For example, a 20 gram mass pad that fits entirely within a central mass zone 130 having a radius $R_{CMZ}$ of 0.75 inch provides a lesser Iyy contribution (and therefore a higher Ixx/Iyy ratio) than a 20 gram mass pad that only partially fits within a central mass zone 130 having a radius $R_{CMZ}$ of 0.75 inch.

The crown mass pad 140 and/or the sole mass pad 142 can be centrally located on the crown 110 and sole 112, respectively. In many embodiments, at least a portion of the crown mass pad 140 and/or the sole mass pad 142 can be intersected by the YZ plane (described above as a vertical plane aligning with both the Y-axis 1050 and the Z-axis 1060). In some embodiments, the crown mass pad 140 and/or the sole mass pad 142 can be located entirely within the middle 50% of the body depth $D_B$. In some embodiments, the crown mass pad 140 and/or sole mass pad 142 can be located entirely within the middle 45% of the $D_B$, entirely within the middle 40% of the $D_B$, entirely within the middle 35% of the $D_B$, entirely within the middle 30% of the $D_B$, entirely within the middle 25% of the $D_B$, or entirely within the middle 20% of the $D_B$. In some embodiments, the crown mass pad 140 and/or the sole mass pad 142 can be located entirely within the middle 50% of the body width $W_B$. In some embodiments, the crown mass pad 140 and/or sole mass pad 142 can be located entirely within the middle 45% of the $W_B$, entirely within the middle 40% of the $W_B$, entirely within the middle 35% of the $W_B$, entirely within the middle 30% of the $W_B$, entirely within the middle 25% of the $W_B$, or entirely within the middle 20% of the $W_B$. In many embodiments a forwardmost point of the crown mass pad 140 and/or the sole mass pad 142 can be spaced rearward of the leading edge 103 by significant percentage of the body depth $D_B$. In some embodiments, the forwardmost point of the crown mass pad 140 and/or the sole mass pad 142 can be spaced rearward of the leading edge 103 by a distance greater than or equal to 10%, greater than or equal to 15%, greater than or equal to 20%, or greater than or equal to 25% of the body depth $D_B$.

In many embodiments, the crown mass pad 140 and the sole mass pad 142 can comprise significant portions of the total club head mass. In many embodiments, the crown mass pad 140 can be larger than the sole mass pad 142 in order to keep the CG 160 position low and/or near the force line 125. In many embodiments, the crown mass pad 140 can comprise a mass between 5 and 30 grams. In some embodiments, the crown mass pad 140 can comprise a mass between 5 grams and 10 grams, between 10 grams and 15 grams, between 15 grams and 20 grams, between grams and 25 grams, or between 25 grams and 30 grams. In some embodiments, the crown mass pad 140 can comprise a mass greater than 5 grams, greater than 10 grams, greater than 15 grams, greater than 20 grams, greater than 25 grams, or greater than 30 grams.

In many embodiments, the sole mass pad 142 can comprise a mass between 10 and 60 grams. In some embodiments, the sole mass pad 142 can comprise a mass between 10 grams and grams, between 15 grams and 20 grams, between 20 grams and 25 grams, between 25 grams and 30 grams, between 30 grams and 35 grams, between 35 grams and 40 grams, between 40 grams and 45 grams, between 45 grams and 50 grams, between 50 grams and 55 grams, or between 55 grams and 60 grams. In some embodiments, the sole mass pad 142 can comprise a mass greater than 5 grams, greater than 10 grams, greater than 15 grams, greater than 20 grams, greater than 25 grams, greater than 30 grams, greater than 35 grams, greater than 40 grams, greater than 45 grams, greater than 50 grams, greater than 55 grams, or greater than 60 grams.

In many embodiments, the club head 100 can define a mass pad ratio as the mass of the sole mass pad 142 divided by the mass of the crown mass pad 140. In many embodiments, the mass pad ratio can be between 0.25 and 1.5. In some embodiments, the mass pad ratio can be between 0.25 and 0.50, between 0.50 and 0.75, between 0.75 and 1.0, between 1.0 and 1.25, or between 1.25 and 1.5. In some embodiments, the mass pad ratio can be greater than 0.25, greater than 0.50, greater than 0.75, greater than 1.0, greater than 1.25, or greater than 1.5. In some embodiments, the mass pad ratio can be less than 1.5, less than 1.4, less than 1.3, less than 1.2, less than 1.1, less than 1.0, less than 0.9, less than 0.8, less than 0.7, less than 0.6, less than 0.5, less than 0.4, less than 0.3, or less than 0.25. Providing a crown mass pad 140 and a sole mass pad 142 each with significant masses, but wherein the crown mass pad 140 is larger than the sole mass pad 142 can provide a club head 100 with a high Ixx/Iyy ratio and a desirable, low CG 160 position.

b. Weight Members

In addition to raising the Ixx/Iyy ratio by distributing a large portion of the club head mass near the Y'-axis 1080, Ixx and Iyy can be controlled through the use of one or more weight members 145. In some embodiments, the club head 100 can comprise at least one weight member 145 separately formed and attached to the body 101. The weight member 145 can be attached to any portion of the body 101, either internally or externally. The weight member 145 can be attached to the crown 110, the sole 112, the heel 104, the toe 106, on or proximate the rear end 111, proximate the front end 108, or any combination thereof. In many embodiments, the weight member 145 can be removably coupled to the body 101 via a mechanical fastening means, such as by use of threaded fastener or some other retaining means. In other embodiments, the weight member 145 can be permanently or non-removably attached to the body 101 via welding, brazing, adhesive coupling, or any other suitable means. The weight member 145 can comprise a material of a greater density than that of the material used to form the body 101. As such, the weight member 145 provides a high concentration of mass that can be located to provide the club head 100 with desirable mass properties. In many embodiments, the weight member 145 can be formed of a high-density material, such as titanium, tungsten, steel, or any suitable alloy thereof.

In some embodiments, as illustrated in FIGS. 9 and 10, the club head 100 can comprise a weight member 145 attached to the body 101 between the rear end 111 and the sole 112. The low and rearward position of the weight member 145 provides a desirable "down and back" CG position and increases the overall club head MOI. The extreme rearward location of the weight member 145 provides a significant contribution to both Ixx and Iyy as there is a large horizontal distance between the weight member 145 and both the X'-axis 1070 and the Y'-axis 1080. However, in many embodiments, the weight member 145 can be configured to provide a greater contribution to Ixx than to Iyy, thereby increasing the Ixx/Iyy ratio. In order to provide a high Ixx/Iyy ratio, the weight member 145 can also be placed as far as possible toward the bottom of the sole 112 to maximize the weight member's contribution to increasing Ixx. By lowering the weight member 145 relative to the CG 160, the weight member 145 is located further from the X'-axis 1070 in a vertical direction but is no further from the Y'-axis 1080, which extends vertically.

To characterize the relative contribution to Ixx and Iyy of the weight member 145, the club head 100 may comprise a ratio between the weight member elevation $E_W$ and weight member depth $D_W$. As illustrated in FIG. 10, the weight member elevation $E_W$ is defined as the distance between the club head CG 160 and the weight member center of gravity 147, measured parallel to the Y'-axis 1080. The weight member depth $D_W$ is defined as the distance between the club head CG 160 and the weight member center of gravity 147, measured parallel to the Z'-axis 1090.

In many embodiments, the club head 100 can comprise a ratio $E_W/D_W$ between 0.30 and 0.60. In some embodiments, the $E_W/D_W$ ratio can be between 0.30 and 0.35, or 0.35 and 0.40, 0.45 and 0.50, or 0.55 and 0.60. In some embodiments, the club head can comprise an $E_W/D_W$ ratio greater than 0.3, greater than 0.35, greater than 0.40, greater than 0.45, greater than 0.50, greater than 0.55, or greater than 0.60. As the $E_W/D_W$ ratio increases, the Ixx contribution of the weight member 145 increases relative to the Iyy contribution of the weight member 145. Therefore, the club head 100 comprising a substantially high $E_W/D_W$ ratio also comprises an increased Ixx/Iyy ratio.

Further, the MOI of the weight member 145 may be characterized by its mass relative to the total club head mass (referred to herein as the "weight member mass percentage"). A weight member 145 comprising a larger percentage of the total club head mass will have a greater impact on moment of inertia. In many embodiments, the weight member 145 may be between 10 and 30% of the total club head mass. In some embodiments, the weight member may be between 10 and 15%, or 15 and 20%, or 20 and 25%, or 25 and 30% of the total club head mass.

Figure 11:
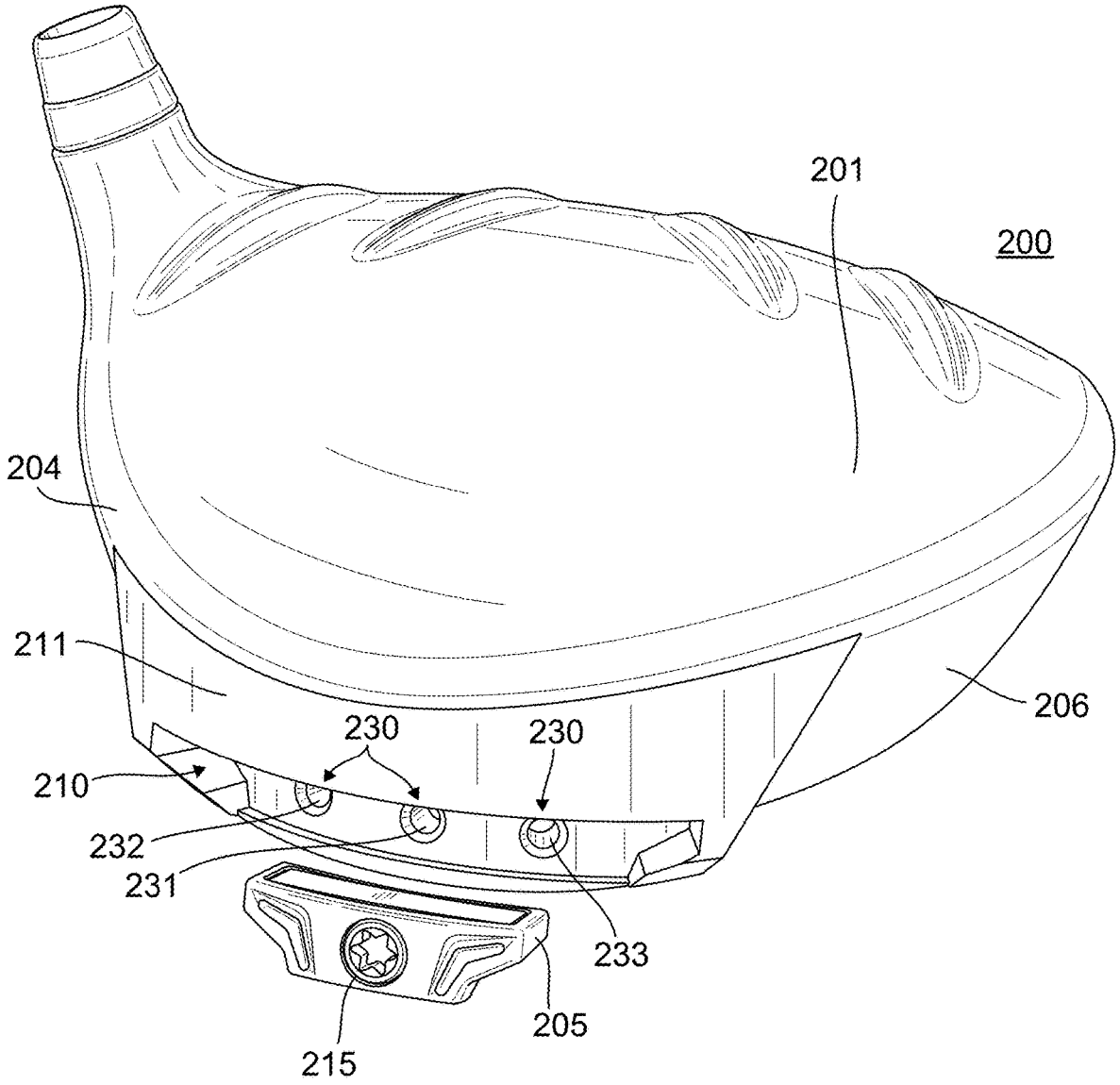
FIG. 11 illustrates a rear perspective view of a club head according to the present invention and comprising an adjustable weight member.

Together, the weight member mass percentage and the ratio between the $E_W/D_W$ ratio can characterize how the weight member 145 contributes to an increased Ixx/Iyy ratio. A heavy weight member 145 (high mass percentage) located substantially below the CG 160 and near the Y'-axis 1080 (high $E_W/D_W$ ratio) produces a higher Ixx/Iyy ratio. The sum of the weight member mass percentage and the $E_W/D_W$ ratio can be between 0.4 and 0.9. In some embodiments, the sum of the weight member mass percentage and the $E_W/D_W$ ratio can be between 0.4 and 0.45, between 0.45 and 0.50, between 0.50 and 0.55, between 0.55 and 0.60, between 0.60 and 0.65, between 0.65 and between 0.70 and 0.75, between 0.75 and 0.80, between 0.80 and 0.85, or between 0.85 and c. Adjustable Weight Member FIG. 11 illustrates a club head 200 with an adjustable weight member 205 which can be secured to any of a plurality of attachment points 230 within a channel 210, wherein each attachment point will promote a unique shot shape. The club head 200 can comprise a weight channel 210 recessed into the rear end 211 of the club head body 201, wherein the weight channel 210 is configured to receive the adjustable weight member 205. The adjustable weight member 205 is secured within the weight channel 210 by mechanical fastening means such as by a screw 215. The weight channel 210 may be recessed within the club head 200 such that a large portion of the adjustable weight member 205 is recessed within the weight channel 210 and does not extend past the perimeter of the club head 200. In many embodiments, as illustrated in FIG. 11, the weight channel 210 may comprise a generally curvilinear shape which follows the curvature of the club head 200. The weight channel 210 may also comprise a plurality of straight sections which are angled relative to each other.

The weight channel 210 further comprises a plurality of attachment points 230 for securing the adjustable weight member 205 to the weight channel 210 at discrete locations. One of the attachment points 230 may be a neutral attachment point 231 which is substantially centered about the club head 200 in a heel-to-toe direction. The neutral attachment point 231 will promote a generally straight ball flight. The club head 200 can further comprise a heel-side attachment point 232 which is located heel-ward of the neutral attachment point 231. The heel-side attachment point 232 will position the adjustable weight member 205 towards the heel 204 of club head 200 thereby moving the CG 260 heel-side and promoting a draw-type golf shot. The club head 200 can further comprise a toe-side attachment point 233 which is located toe-ward of the neutral attachment point 231. The toe-side attachment point 233 will position the adjustable weight member 205 towards the toe of club head 200, thereby moving the CG 260 toe-side and promoting a fade-type golf shot.

In many embodiments the weight member 205 may have a mass ranging between 1 g and 40 g. In some embodiments, the mass of the weight member 1090 ranges from 1 g-5 g, 5 g-10 g, 10 g-15 g, 15 g-20 g, 20 g-25 g, 25 g-30 g, 30 g-35 g, or 35 g-40 g.

Positioning the weight member 205 at the rear end 211 of the club head 200 while having attachment points 230 which are relatively close to each other means that the weight member 205 will have relatively small contributions to CG and MOI of the club head 200 when the weight member 205 mass is chosen to be on the low end of its range (for example 5 g). By selecting a heavier weight member 205 with a mass on the upper end of its range (for example 40 g) the weight member can have a relatively significant contribution to club head 200 CG and MOI while still having a relatively small distance between attachment points 230. In this manner, the design of the adjustable weight member 205 allows for weight channel 210 to remain compact while still offering significant shot shaping abilities. An additional advantage of a compact weight channel 210 is that the structure of the weight channel 210 can be light weight, leaving additional discretionary mass for placement elsewhere in the club head 200.

d. Multi-Material Construction

Figure 12:
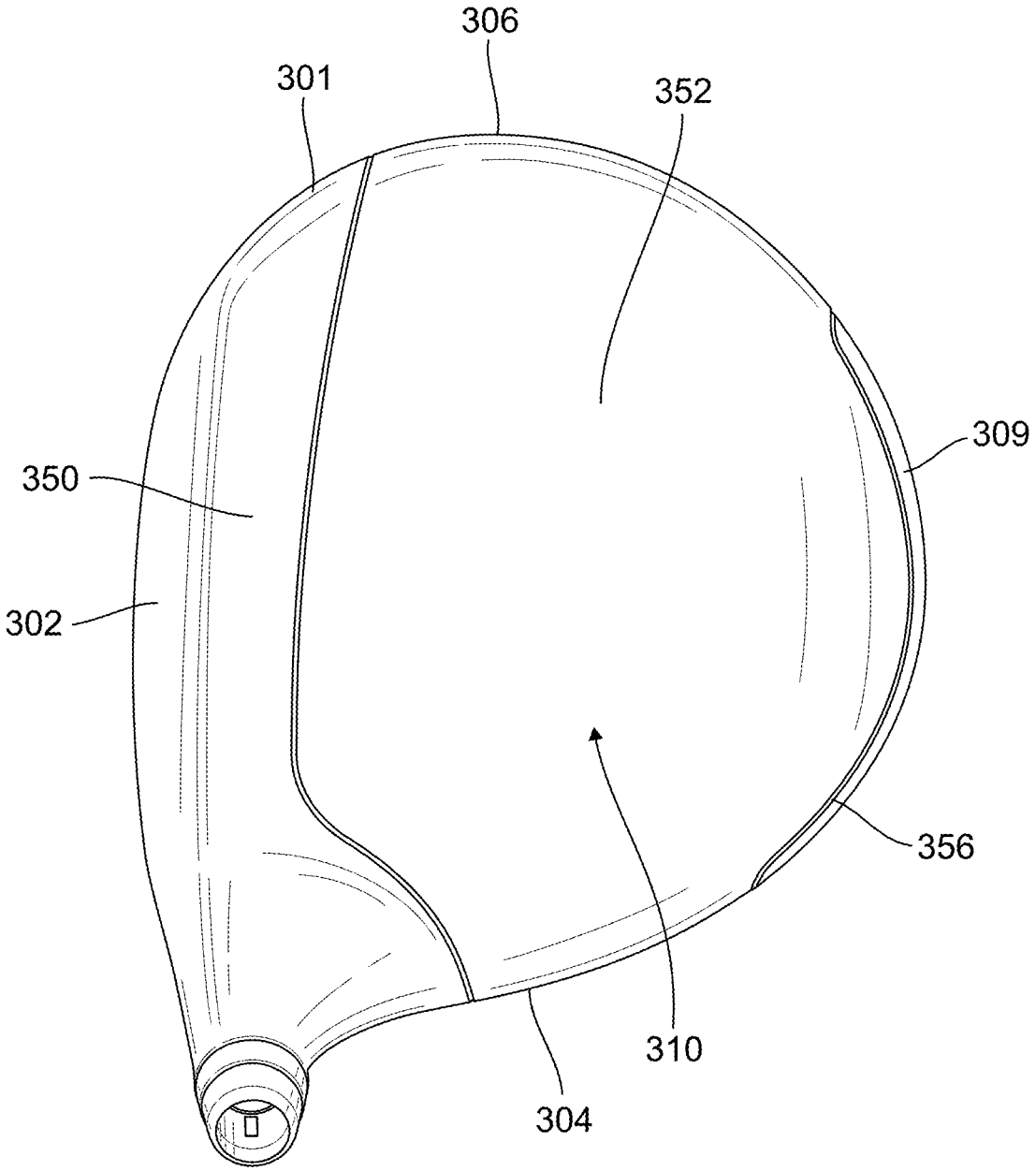
FIG. 12 illustrates a top view of a golf club head according to the present invention and further comprising a non-metal component.
Figure 13:
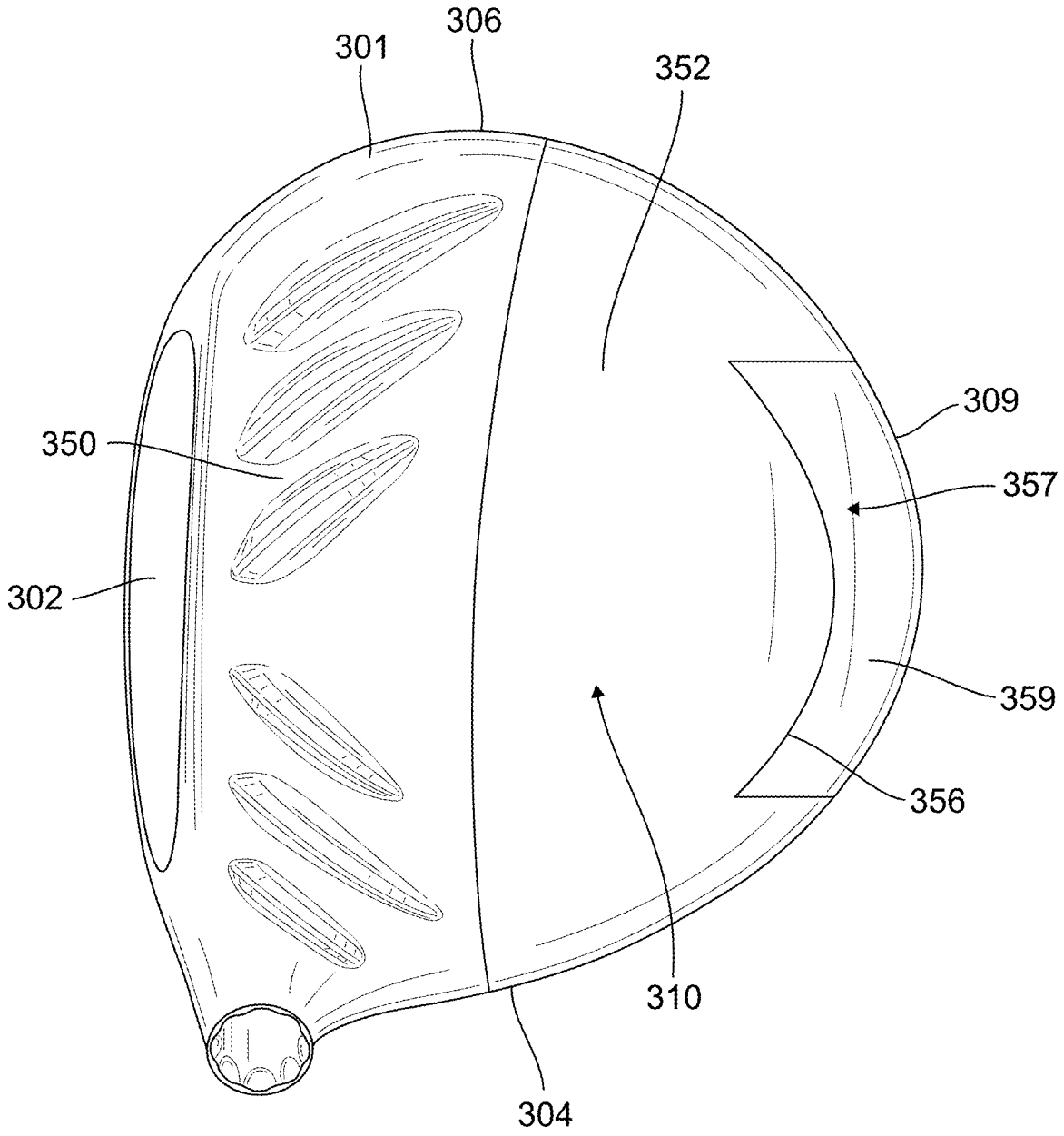
FIG. 13 illustrates a top view of a second embodiment of a golf club head according to the present invention and further comprising a non-metal component.
Figure 14:
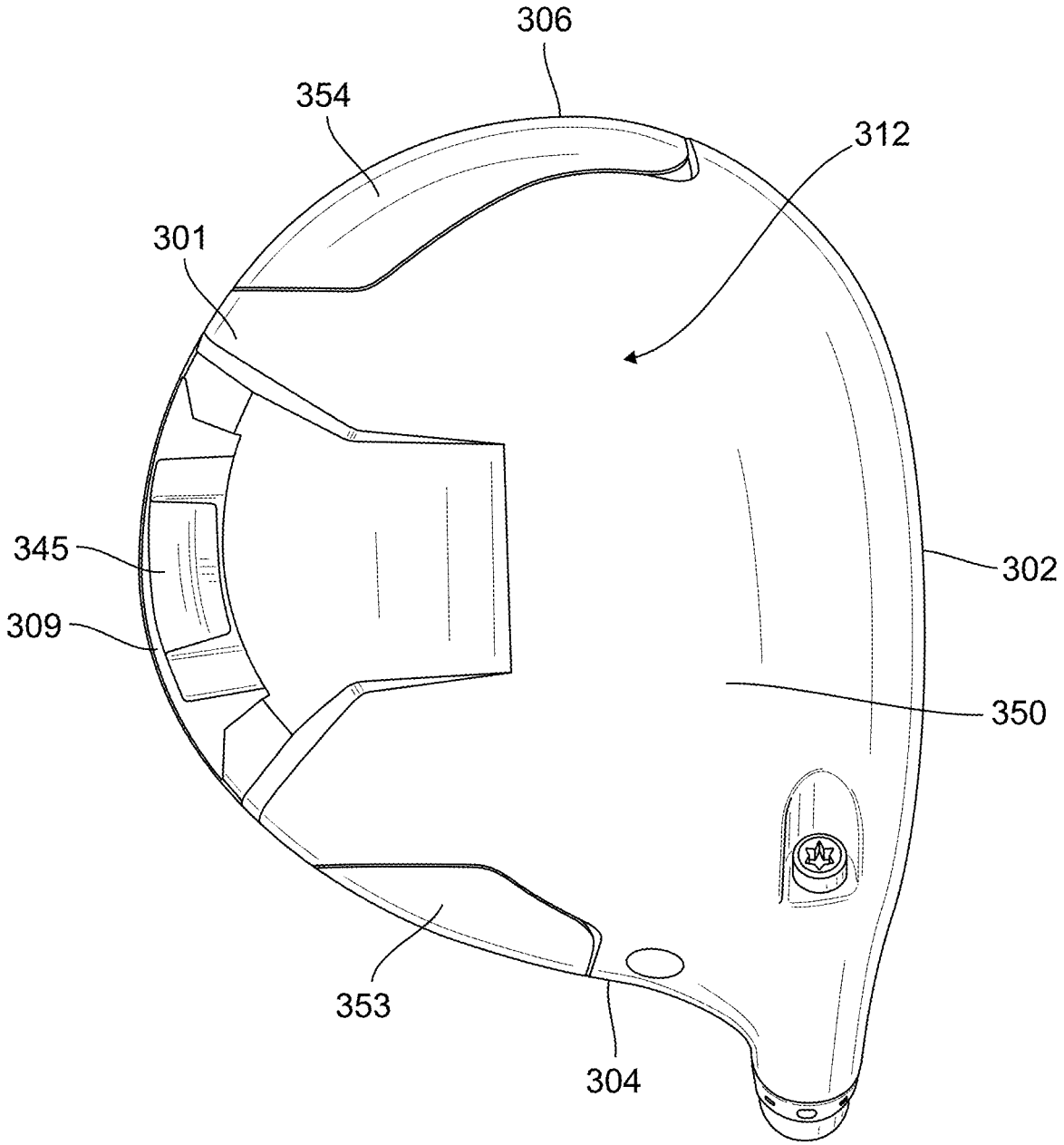
FIG. 14 illustrates a bottom view the golf club head of FIG. 13.

In some embodiments, as illustrated in FIGS. 12-14, the club head 300 can comprise a multi-material construction. In such embodiments, the body 301 can comprise at least a first component 350 formed of a metal material and a second component 352 formed of a non-metal material, such as a composite material. The non-metallic second component 352 can form at least a portion of the crown 310, at least a portion of the heel 304, at least a portion of the toe 306, at least a portion of the sole 312, or any combination thereof. Providing the club head 300 with a body 301 formed at least partially by a non-metallic component 352 can create discretionary mass that can be redistributed throughout the club head 300 to increase the Ixx/Iyy ratio. Providing at least a portion of the body 301 formed by a non-metallic second component 352 can allow extra discretionary mass to be placed within the central mass zone 330 or used to increase the mass of any mass pads or weight members described above.

As illustrated in FIG. 12, in many embodiments, the club head 300 can comprise a non-metallic second component 352 that forms a majority of the surface of the crown 310. In the illustrated embodiment, the body 301 comprises a first component 350 that forms a forward portion of the crown 310 proximate the strike face 302. The second component 352 can form the remainder of the crown. In the illustrated embodiment, the second component 352 can form a "wrap-around" design wherein the second component 352 wraps around the heel 304 and the toe 306 and onto the sole 312 (as illustrated in FIG. 14). In many embodiments, the second component 352 does not wrap over the rear edge 309 of the club head 300.

As illustrated in FIG. 12, the second component 352 comprises a second component rear edge 356 that is bounded within the perimeter of the crown 310 and does not extend over the club head rear edge 309 or onto the sole 312. In many embodiments, as illustrated by FIG. 12, the second component rear edge 356 can be located substantially near the club head rear edge 309. In other embodiments, referring to FIG. 13, the second component rear edge 356 can be spaced a substantial distance from the club head rear edge 309. In the illustrated embodiment of FIG. 13, the first component 350 forms a rear lip 359 that extends forward from the club head rear edge 309 and forms a rearward portion of the crown 310. The second component 352 can comprise a cutout portion 357 corresponding to the shape of the rear lip 359, such that the second component rearward edge 356 contacts a forward edge of the rear lip 359. This configuration spaces the rearward connection between the first component 350 and the second component 352 away from the club head rear edge 309. In many cases, doing so can provide both manufacturing and durability benefits by providing plenty of space between the non-metallic second component 352 and a weight insert 345 located proximate the club head rear end 309 (as illustrated in FIG. 14). Manufacturers often require significant clearance between such rear weight members 345 and a non-metal component to enable the geometry of the weight member supporting structure to be cast.

Referring to FIG. 14, the second component 352 wraps around the heel 304 and the toe 306 and forms a portion of the sole 312. The second component 352 can comprise a second component heel portion 353 forming at least a portion of the sole 312 near the heel 304 and a second component toe portion 354 forming at least a portion of the sole 312. In the illustrated embodiment, the first component 350 forms a majority of the sole 312. As mentioned above, the club head 300 can comprise a weight member 345 located on the sole 312 near the club head rear edge 309 to provide a down-and-back CG 360 position and increase MOI.

The amount of non-metallic material forming the body 301 may be characterized by the percentage of the crown 310 surface area that is formed by the second component 352 and/or the percentage of the sole 312 surface area that is formed by the second component 352. In some embodiments the second component 352 may form at least 50% of the surface area of the crown 310. In some embodiments the second component 352 may form at least 60%, at least 70% at least 80%, or at least 90% of the surface area of the crown 310. In some embodiments, the second component 352 may form at least 10% of the surface area of the sole 312. In some embodiments, the second component 352 may form at least 15%, at least 20%, at least 25%, or at least 30% of the surface area of the sole 312. Summing the percentage of the sole and crown that are composite defines a sole-crown composite percentage. The higher the percentage of the body 301 that is formed by a non-metal second component 352, the more discretionary mass is available to strategically distribute to increase the Ixx/Iyy ratio.

The wrap-around design of the non-metallic second component 352 can help distribute mass within the central mass zone 130, providing a higher Ixx/Iyy ratio. In many embodiments, the second component heel portion 353 and the second component toe portion 354 may form only portions of the sole 312 that are located near the perimeter of the club head, outside of the central mass zone 130. In many embodiments, the second component heel portion 353 and the second component toe portion 354 may not extend into a central mass zone 130 having a radius $R_{CMZ}$ of inch. The present configuration removes mass from portions of the sole 312 that are outside of the central mass zone 130 without removing any mass from proportions of the sole within the central mass zone 130. The discretionary mass created by removing mass from the sole 312 can be redistributed within the central mass zone 130 to increase the Ixx/Iyy ratio.

e. Lightweight Shaft-Receiving Structure

Figure 24:
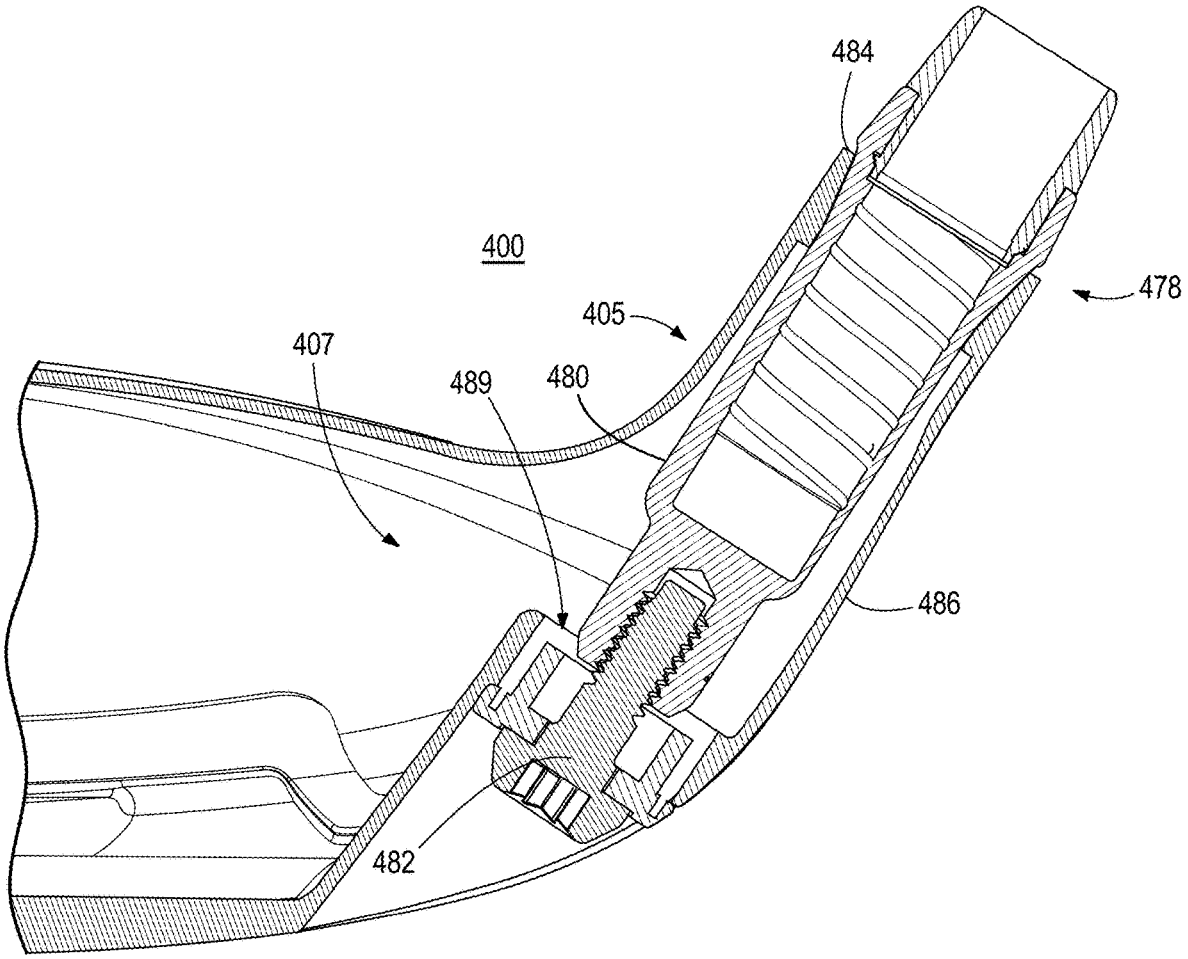
FIG. 24 illustrates a detailed, cross-sectional view of a golf club head comprising a lightweight adjustable shaft-receiving structure.

In some embodiments, referring to FIG. 24, the club head 400 can comprise a lightweight shaft-receiving structure 478 that creates discretionary mass. The discretionary mass can be allocated to portions of the club head 400 that increase the Ixx/Iyy ratio. Providing the lightweight shaft-receiving structure 478 can allow extra discretionary mass to be placed within the central mass zone 430 or used to increase the mass of any mass pads or weight members described above.

Referring to FIG. 24, in some embodiments, the club head 400 can comprise an adjustable shaft-receiving mechanism. The adjustable shaft-receiving mechanism may be used to adjust the loft angle and/or lie angle for a particular player. The adjustable shaft-receiving mechanism can be similar to those described in U.S. patent application Ser. No. 15/003,494, filed on Jan. 21, 2016, now U.S. Pat. No. 9,868,035, granted on Jan. 16, 2018; and U.S. patent application Ser. No. 17/304,836, filed on Jan. 25, 2021, now U.S. Pat. No. 11,607,590, granted on Mar. 21, 2023; which are both incorporated fully herein by reference.

The adjustable shaft-receiving mechanism comprises a shaft sleeve 480 configured to receive a golf club shaft (not shown) and retained within the hosel 405 by a fastener 482. The shaft sleeve 480 and the hosel 405 comprise corresponding geometries that allows the shaft sleeve 480 to be removably rotated into a plurality of different configurations. Rotating the shaft sleeve 480 between different configurations can provide loft angle 10 and/or lie angle 15 adjustability to the club head 400. Referring to FIG. 24, the lightweight shaft-receiving structure 478 houses the shaft sleeve 480 with a minimal amount of structural mass. At least a portion of the shaft sleeve 480 is exposed to the interior cavity 407. In the present embodiment, rather than being retained by an internal structure such as an interior hosel tube or hosel wall, the shaft sleeve 480 is retained in the club head 400 by structures that also form at least a portion of the club head body 401 exterior. In other words, the shaft sleeve 480 is primarily supported and retained by portions body 401. In many embodiments, the shaft receiving structure 478 comprises an upper end and a lower end. In the present embodiment, the shaft sleeve 480 is secured only at the upper end 488 and the lower end 489. The shaft sleeve 480 is inserted through a hosel bore opening 484 and retained at the upper end by a hosel wall 486. The shaft sleeve 480 can be secured to the club head 400 by use of a fastener 482.

The lightweight shaft-receiving structure 478 can create 3 to 12 grams of discretionary mass in comparison to a prior-art shaft-receiving structure wherein the shaft sleeve is concealed from the interior cavity by a supporting structure such as a hosel tube or an interior hosel wall. In some embodiments, the lightweight shaft-receiving structure 478 can create between 3 grams and 5 grams, between 4 grams and 6 grams, between 5 grams and 7 grams, between 6 grams and 8 grams, between 7 grams and 9 grams, between 8 grams and 10 grams, between 9 grams and 11 grams, or between 10 grams and 12 grams of discretionary mass in comparison to a prior-art shaft receiving structure. In some embodiments, the lightweight shaft-receiving structure 478 can create greater than 3 grams, greater than 4 grams, greater than 5 grams, greater than 6 grams, greater than 7 grams, greater than 8 grams, greater than 9 grams, or greater than 10 grams of discretionary mass in comparison to a prior-art shaft receiving structure. Reducing the mass of the shaft-receiving structure 478 by eliminating redundant supporting structures frees up discretionary mass to be re-allocated to other areas of the club head 400 to increase the Ixx/Iyy ratio. In particular, because the shaft-receiving structure 478 is located proximate the heel 404, the mass forming the shaft-receiving structure 478 is typically located outside of the central mass zone 430. Reducing the mass of the shaft-receiving structure 478 by eliminating redundant supporting structures is particularly effective in increasing Ixx/Iyy, because doing so removes mass that is located outside of the central mass zone 430 and allows the mass to be redistributed within the central mass zone 430.

IV. Bulge and Roll Optimization

As described above, the club head 100 can further comprise a bulge curvature and roll curvature specifically tailored to the club head properties to provide increased performance and forgiveness. Accordingly, the club head can satisfy one or more bulge radius or roll radius relations to maximize distance and forgiveness. The bulge and roll radius relations can be dependent on factors such as CG position, MOI, and coefficient of restitution (COR). The optimized bulge and roll curvatures can be particularly useful in low-MOI club heads, as the increased forgiveness provided by the bulge and roll curvatures can compensate for any losses in forgiveness associated with a low target Iyy. In some embodiments, as evidenced in the examples below, providing a low-MOI club head 100 with optimized bulge and roll radii can provide increased forgiveness in comparison to a high-MOI club head with standard bulge and roll radii (i.e. bulge and roll radii that are not optimized in view of the club head characteristics).

The strike face 102 of the present club head 100 comprises a bulge radius that provides forgiveness for toe-ward and heel-ward mis-hits. When a golf ball is mis-hit near the heel 104 or toe 106, the club head 100 rotates about the Y'-axis 1080. The rotation about the Y'-axis 1080 creates a gearing effect between the strike face 102 and the golf ball that imparts sidespin on the golf ball. For a toe-ward mis-hit, the gearing sidespin causes the golf ball to draw in a toe-ward to heel-ward direction. Conversely, for a heel-ward mis-hit, the gearing sidespin causes the golf ball to fade in a heel-ward to toe-ward direction. The bulge curvature counteracts the effects of the gearing sidespin by 1) altering the starting direction of the golf shot and 2) altering the severity of the gearing effect. For example a tighter bulge radius will start the golf ball further offline and will reduce the gearing effect, while a flatter bulge radius will start the golf ball closer to center and increase the gearing effect.

The club head's Iyy and CG position each influence the amount of rotation at impact and gearing effect for a heelward or toeward mis-hit. Therefore, each must be factored into determining the optimal bulge radius. The lower the Iyy, the greater the club head's tendency to twist in a heel-toe direction, which increases the gearing sidespin. A more rearward CG position also increases the club head's heel-to-toe rotation on mis-hits away from the geometric center 120. The club head 100 comprises a bulge radius that appropriately accounts for Iyy and CG position. The optimal bulge radius balances the start line and the gearing effect, providing the correct amount of sidespin to bring the golf ball back to the target line. Further, the club head's coefficient of restitution (hereafter "COR") can play a role in the optimal bulge radius determination. A club head with a lower COR will experience reduced ball speed on mis-hits. It may be desirable to provide a flatter bulge radius in such low-COR club heads. A flatter bulge radius provides less oblique impact between the strike face 102 and the golf ball on heelward or toeward mis-hits, thereby retaining more ball speed. In higher-COR club heads, the bulge radius may be tighter to prioritize correction of gearing spin over retention of ball speed, because the high COR naturally retains ball speed on mis-hits.

In many embodiments, the bulge radius can be determined by computer simulations that factor in ranges or values for club head MOI (both Ixx and Iyy) and CG position. In many embodiments, the computer simulations can be performed over a variety of swing speeds, face delivery angles, and/or impact locations on the strike face 102. In many embodiments, an Ixx range and Iyy range can be selected, and the bulge radius can be calculated as a function of the CG position of the club head 100 within the Ixx and Iyy ranges. In some embodiments, the club head 100 satisfies Relation 1 for an Iyy ranging between 2000 g*cm$^2$ and 3200 g*cm$^2$, and an Ixx ranging between 1480 g*cm$^2$ and 2370 g*cm$^2$.

$$10.73-2.93+CG_z+CG_y<\text{Bulge Radius}<16.06-4.71*CG_z+CG_y \qquad \text{Relation 1}$$

For example, in many embodiments, the club head 100 can satisfy Relation 1 and have an Iyy less than 3500 g*cm$^2$, less than 3200 g*cm$^2$, less than 3000 g*cm$^2$, less than 2800 g*cm$^2$, or less than 2600 g*cm$^2$. For example, in many embodiments, the club head 100 can satisfy Relation 1 and have an Ixx less than 2600 g*cm$^2$, less than 2500 g*cm$^2$, less than 2400 g*cm$^2$, less than 2200 g*cm$^2$, less than 2000 g*cm$^2$, less than 1800 g*cm$^2$, or less than 1500 g*cm$^2$.

Further, the strike face 102 of the present club head 100 comprises a roll radius that provides forgiveness for crown-ward and sole-ward mis-hits. When a golf ball is mis-hit near the crown 110 or the sole 112, the club head 100 rotates about the X'-axis 1080. The rotation about the X'-axis 1070 creates a gearing effect between the strike face 102 and the golf ball that alters the natural backspin of the golf ball. For a crown-ward mis-hit, the gearing effect reduces the backspin of the golf ball. Conversely, for a sole-ward mis-hit, the gearing effect increases the backspin of the golf ball. The roll curvature counteracts the gearing effect on backspin by 1) altering the launch angle of the golf shot and 2) altering the severity of the gearing effect. For example a tighter roll radius will launch the golf ball higher on crown-ward mis-hits and lower on sole-ward mis-hits and will reduce the gearing effect, while a flatter roll radius will launch the golf ball closer the launch angle on center strikes and increase the gearing effect.

The club head's Ixx and CG position each influence the amount of rotation at impact and gearing effect for a crown-ward or sole-ward mis-hit. Therefore, each must be factored into determining the optimal roll radius. The lower the Ixx, the greater the club head's tendency to twist about the X'-axis 1070, which increases the gearing effect on backspin. A more rearward CG position also increases the club head's rotation about the X'-axis 1070 on mis-hits away from the geometric center 120. The club head 100 comprises a roll radius that appropriately accounts for Ixx and CG position. The optimal roll radius balances the launch angle and the gearing effect, providing the correct combination of launch angle and backspin rate to maximize the distance of the golf shot.

For example, on a sole-ward mis-hit, the gearing effect increases the backspin of the golf ball, which can lift the ball to high in the air such that it flies high but not far. The roll radius compensates for this increase in backspin by lowering the launch angle on a sole-ward mis-hit. In general, a lower Ixx increases the gearing effect on sole-ward mis-hits and a tighter roll radius is desired to more aggressively lower the launch angle. On a crown-ward mis-hit, the gearing effect increases the backspin of the golf ball, which can hamper the golf ball's ability to lift and stay in the air, thereby reducing distance. The roll radius compensates for this decrease in backspin by increasing the launch angle on a crown-ward mis-hit, such that the trajectory of the golf ball allows it to fly further.

The club head COR can also factor into the optimization of the roll radius for similar reasons as described above. A flatter roll radius provides less oblique impact between the strike face 102 and the golf ball on crown-ward or sole-ward mis-hits, thereby retaining more ball speed. In higher-COR club heads, the roll radius may be tighter to prioritize launch angle and backspin rate over retention of ball speed, because the high COR naturally retains ball speed on mis-hits.

In many embodiments, the roll radius can be determined by computer simulations that factor in ranges or values for club head MOI (both Ixx and Iyy) and CG position. In many embodiments, the computer simulations can be performed over a variety of swing speeds, face delivery angles, and/or impact locations on the strike face 102. In many embodiments, an Ixx range and Iyy range can be selected, and the roll radius can be calculated as a function of the CG position of the club head 100 within the Ixx and Iyy ranges. In some embodiments, the club head 100 satisfies Relation 2 for an Iyy ranging between 2000 g*cm$^2$ and 3200 g*cm$^2$, and an Ixx ranging between 1480 g*cm$^2$ and 2370 g*cm$^2$.

$$6.60-1.57*CG_z+CG_y<\text{Roll Radius}<11.19-3.41*CG_z+CG_y \qquad \text{Relation 2}$$

For example, in many embodiments, the club head 100 can satisfy Relation 2 and have an Iyy less than 3500 g*cm$^2$, less than 3200 g*cm$^2$, less than 3000 g*cm$^2$, less than 2800 g*cm$^2$, or less than 2600 g*cm$^2$. For example, in many embodiments, the club head 100 can satisfy Relation 2 and have an Ixx less than 2600 g*cm$^2$, less than 2500 g*cm$^2$, less than 2400 g*cm$^2$, less than 2200 g*cm$^2$, less than 2000 g*cm$^2$, less than 1800 g*cm$^2$, or less than 1500 g*cm$^2$.

Relations 1 and 2 above can be used to determine the bulge radius and roll radius independently from one another. However, for a particular club head 100, the bulge and roll radii must be complementary to one another. The computer simulation results discussed above were further leveraged to determine the club head bulge radius and roll radius in view of the one another. Thus, in some embodiments, the club head 100 satisfies Relations 3 and/or Relation 4 for an Iyy between 2000 g*cm$^2$ and 3200 g*cm$^2$, and an Ixx between 1480 g*cm$^2$ and 2370 g*cm$^2$.

$$-0.125+0.575*(10.73-2.93*CG_z+CG_y)<\text{Roll Radius}<0.918+0.648*(16.06-4.71*CG_z+CG_y) \qquad \text{Relation 3}$$

$$0.217\pm1.739*(6.60-1.57*CG_z+CG_y)<\text{Bulge Radius}<-1.416\pm1.543*(11.19-3.41*CG_z+CG_y) \qquad \text{Relation 4}$$

For example, in many embodiments, the club head 100 can satisfy Relation 3 and Relation 4, and can have a Iyy less than 3500 g*cm$^2$, less than 3200 g*cm$^2$, less than 3000 g*cm$^2$, less than 2800 g*cm$^2$, less than 2600 g*cm$^2$, less than 2600 g*cm$^2$, less than 2500 g*cm$^2$, less than 2400 g*cm$^2$, less than 2200 g*cm$^2$, less than 2000 g*cm$^2$, less than 1800 g*cm$^2$, or less than 1500 g*cm$^2$. In many embodiments, a club head 100 comprising an Iyy between 2000 g*cm$^2$ and 3200 g*cm$^2$, and an Ixx between 1480 g*cm$^2$ and 2370 g*cm$^2$ can satisfy any one or combination of Relation 1, Relation 2, Relation 3, or Relation 4 to produce optimized bulge and roll curvatures based on the characteristics of the club head 100.

As described above, many of the club head embodiments described herein are directed to low Iyy targets. In general, the optimized bulge and roll curvatures for a low-MOI club head can be substantially tighter than the bulge and roll curvatures for a high-MOI club head. In many of the embodiments described herein, the club head 100 can comprise an Iyy target between 2000 g*cm$^2$ and 3200 g*cm$^2$ and a bulge radius between 5 inches and 11 inches. In some embodiments, the club head 100 can comprise an Iyy target between 2000 g*cm$^2$ and 3200 g*cm$^2$ and a bulge radius less than 11 inches, less than 10.5 inches, less than 10 inches, less than 9.5 inches, less than 9.0 inches, less than 8.5 inches, less than 8.0 inches, less than 7.5 inches, less than 7.0 inches, less than 6.5 inches, less than 6.0 inches, less than 5.5 inches, or less than 5.0 inches. In some embodiments, the club head 100 can comprise an Iyy target between 2000 g*cm$^2$ and 3200 g*cm$^2$ and a roll radius between 4 inches and 9 inches. In some embodiments, the club head 100 can comprise an Iyy target between 2000 g*cm$^2$ and 3200 g*cm$^2$ and a roll radius less than 9.0 inches, less than 8.5 inches, less than 8.0 inches, less than 7.5 inches, less than 7.0 inches, less than 6.5 inches, less than 6.0 inches, less than 5.5 inches, less than 5.0 inches, or less than 4.5 inches, less than 4.0 inches. In many embodiments, the club head 100 comprises a bulge radius and/or roll radius that is significantly lower than those of prior-art club heads. Traditionally, for a prior-art driver-type club head, the bulge and roll radii are approximately 12 inches each, and typically range between 10-14 inches.

The optimized bulge and roll curvatures can be applied to the strike face 102 of a club head 100 comprising any one or combination of the features above. In particular, in many embodiments, the optimized bulge and roll curvatures are applied to a club head 100 comprising a cube-like body shape and a large proportion of mass distributed near the X'-axis (i.e. a large percentage of the total club head mass distributed within a small central mass zone 130). In such embodiments, the club head 100 comprises a high Ixx/Iyy ratio and, combined with the optimized bulge and roll curvatures, provides maximum performance within the context of a specific Iyy target.

V. Adjustable Swing Weight System

In some embodiments, Referring to FIGS. 15-22, the club head may comprise an adjustable swing weight system which allows for several club head builds of different swing weights, all at a consistent Iyy target. The adjustable swing weight system provides a plurality of weight inserts which are interchangeable and/or removable and each provide a consistent Iyy contribution. "Swing weighting" refers to the process of building out a club head to a specific total mass to correspond to the needs of a particular player. For example, certain players are suited to a greater total club head mass, while others are more suited to a club head with a lower total mass. Generally, the desired swing weight is achieved by adding one or more interchangeable and/or removable weight inserts of varying mass to the club head. However, in doing so, the mass properties of the club head (including Iyy) will vary from build to build. The adjustable swing weight system described herein allows for a plurality of club head builds of varying mass with little to no variation in the club head Iyy. Such an adjustable swing weight system may be useful for when designers desire to achieve a target Iyy for all club head builds while allowing for different swing weights.

The adjustable swing weight system described herein comprises a plurality of weight inserts wherein at least one of the plurality of weight inserts may be selected to be coupled to the club head to adjust the swing weight. The plurality of weight inserts may be designed such that, when inserted into the club head, each of the plurality of weight inserts will yield club head builds with substantially identical club head Iyy values, yet substantially different club head masses. In particular, the adjustable swing weight system described in further detail below allows for a variation in a club head mass by more than 26 grams with negligible (or zero) variation in clubhead Iyy. In some embodiments the adjustable swing weight system can allow for a variation in club head mass between builds by more than 1 gram, 2 grams, 3 grams, 4 grams, 5 grams, 6 grams, 7 grams, 8 grams, 9 grams, 10 grams, 11 grams, 12 grams, 13 grams, 14 grams, 15 grams, 16 grams, 17 grams, 18 grams, 19 grams, 20 grams, 21 grams, 22 grams, 23 grams, 24 grams, or 25 grams. In some embodiments, the adjustable swing weight system provides a variation in Iyy between builds of less than 10%, less than 9%, less than 8%, less than 7%, less than 6%, less than 5%, less than 4%, less then 3%, less than 2%, less than 1%, or approximately 0%.

To provide a plurality of club head builds, each build having different swing weights while maintaining a constant Iyy, the adjustable swing weight system described herein comprises a plurality of interchangeable and/or removable weight inserts of differing mass. Each of the plurality of interchangeable and/or removable weight inserts can be respectively positioned within the club head such that the weight inserts all have the same contribution to Iyy. The relationship between the mass, position, and Iyy contribution of the weight inserts is described in detail below.

In view of Equation 2 (defined in the definitions section above), the Iyy contribution of each weight insert can be determined, with the weight inserts being treated as point masses of some mass, m, and being offset a perpendicular distance, r (also referred to as $O_w$ below), from the Y'-axis 1080. A consistent Iyy target may be achieved for all available club head builds if the Iyy contributions of the weight inserts are equal between builds. There are two ways to achieve the same Iyy contribution from all the weight inserts. Either 1) as the mass of the weight inserts increases between builds, the offset of the weight insert CG from the Y'-axis 1080 decreases quadratically; or 2) the offset of the weight inserts from the Y'-axis 1080 is made to be negligible or zero (i.e. the weight insert CG is located at the club head CG). In the first method, the $mr^2$ value of the weight insert with respect to the Y'-axis 1080 is held constant between builds, whereas the second method sets the $mr^2$ value equal to 0 for all builds. The various embodiments described in detail below identify club head designs which allow for weight insert configurations with substantially identical Iyy contributions.

Figure 15:
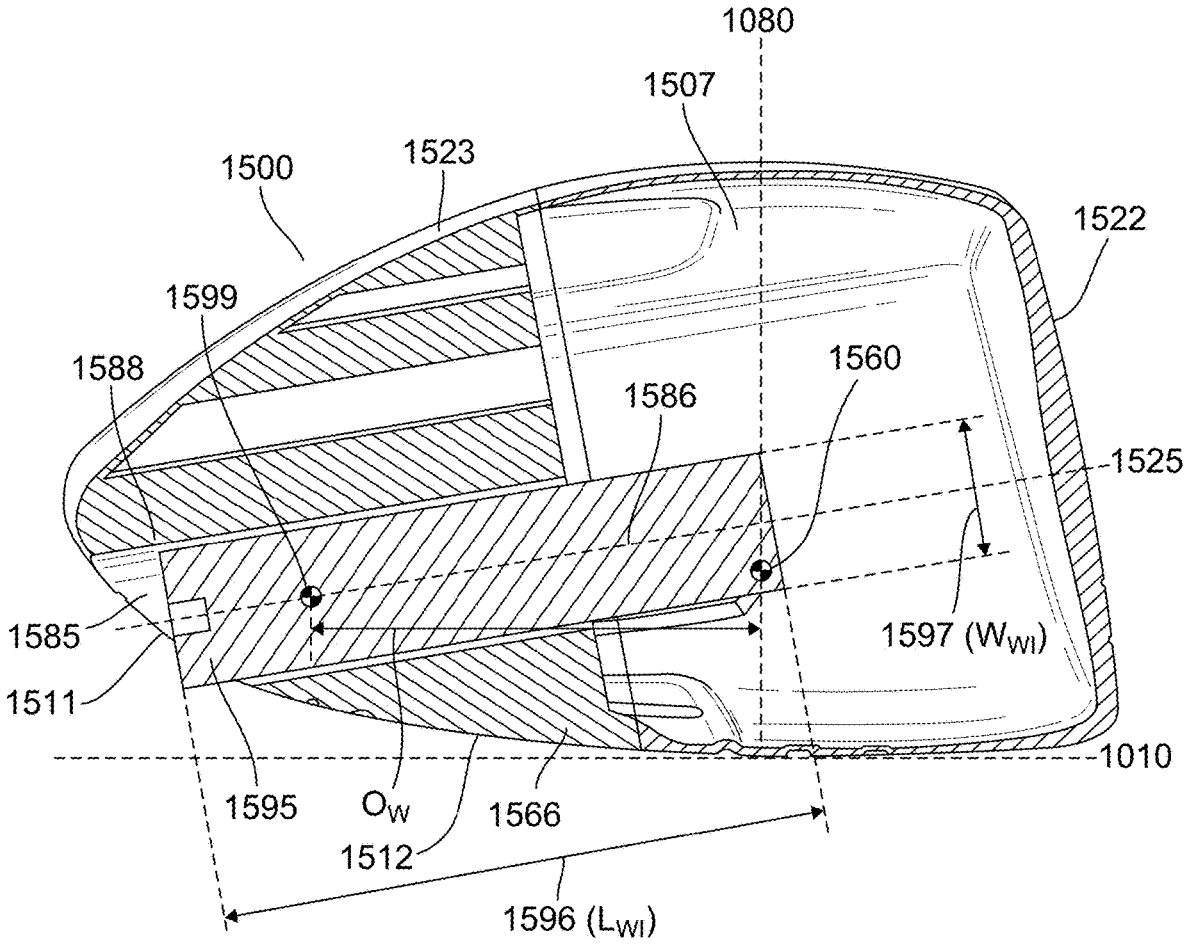
FIG. 15 illustrates a toe-side cross-sectional view of a golf club head comprising an adjustable swing weight system according to a first embodiment.

FIGS. 15-17C illustrate a two-piece club head 1500 configured with a tubular recess 1585 for receiving any of a plurality of weight inserts 1595 of an adjustable swing weight system. The plurality of weight inserts 1595 can comprise different masses and different weight insert center of gravity 1599 locations that provide consistent Iyy contributions. Referring to FIG. 15, the club head 1500 can comprise two bodies; a front portion 1522 and a rear portion 1523. The front portion 1522 and the rear portion 1523 are permanently joined, by a method such as welding or adhesive coupling, to form the club head 1500. In some embodiments, the front portion 1522 and the rear portion 1523 can be separate components formed of different materials. In many embodiments, the rear portion 1523 can be a lightweight, non-metallic material, whereas the front portion 1522 can be metallic. In other embodiments, the front portion 1522 and the rear portion 1523 can both be formed of a metallic material.

The front portion 1522 is comprised of a generally hollow concave structure which forms the interior cavity 1507 of the club head 1500. The rear portion 1523 can be a generally solid structure with a bore through it which forms a tubular recess 1585. The tubular recess 1585 can extend from the sole 1512 or the rear end 1511 of the club head 1500 into the interior cavity 1507. The tubular recess 1585 is configured to receive a weight insert 1595 corresponding to a club head build. The weight inserts 1595 will be locked into place in the tubular recess 1585 by implementing any combination or one of a variety of retaining mechanisms. Said retaining mechanisms may include a threaded engagement, locking via posts, securing with pins, or any other non-permanent retaining mechanisms known in the art. The tubular recess 1585 is surrounded by a cylindrical shell 1588. The cylindrical shell 1588 is a generally cylindrical barrier which separates the tubular recess 1585 from the interior cavity 1507 of the club head 1500. In some embodiments, once the weight insert 1595 is locked into place within the tubular recess 1585, the cylindrical shell 1588 may be capped to seal the tubular recess 1585. The cylindrical shell 1588 can be permanently or non-permanently sealed using a cap, plug, or a variety of other known methods in the art. The club head 1500 further comprises a support member 1566 which connects the cylindrical shell 1588 to the sole 1512 of the clubhead 1500. The tubular recess 1585 further comprises a tube axis 1586 which extends through the center of the cylindrical shell 1588 and runs along the length of the tubular recess 1585 as shown in FIG. 15. The tubular recess 1585 is positioned such that the tube axis 1586 aligns with the force line 1525 of the club head 1500. By aligning the tube axis 1586 with the force line 1525 of the club head 1500 launch conditions will be consistent between builds, regardless of which weight insert 1595 is received by the tubular recess 1585.

Figure 16:
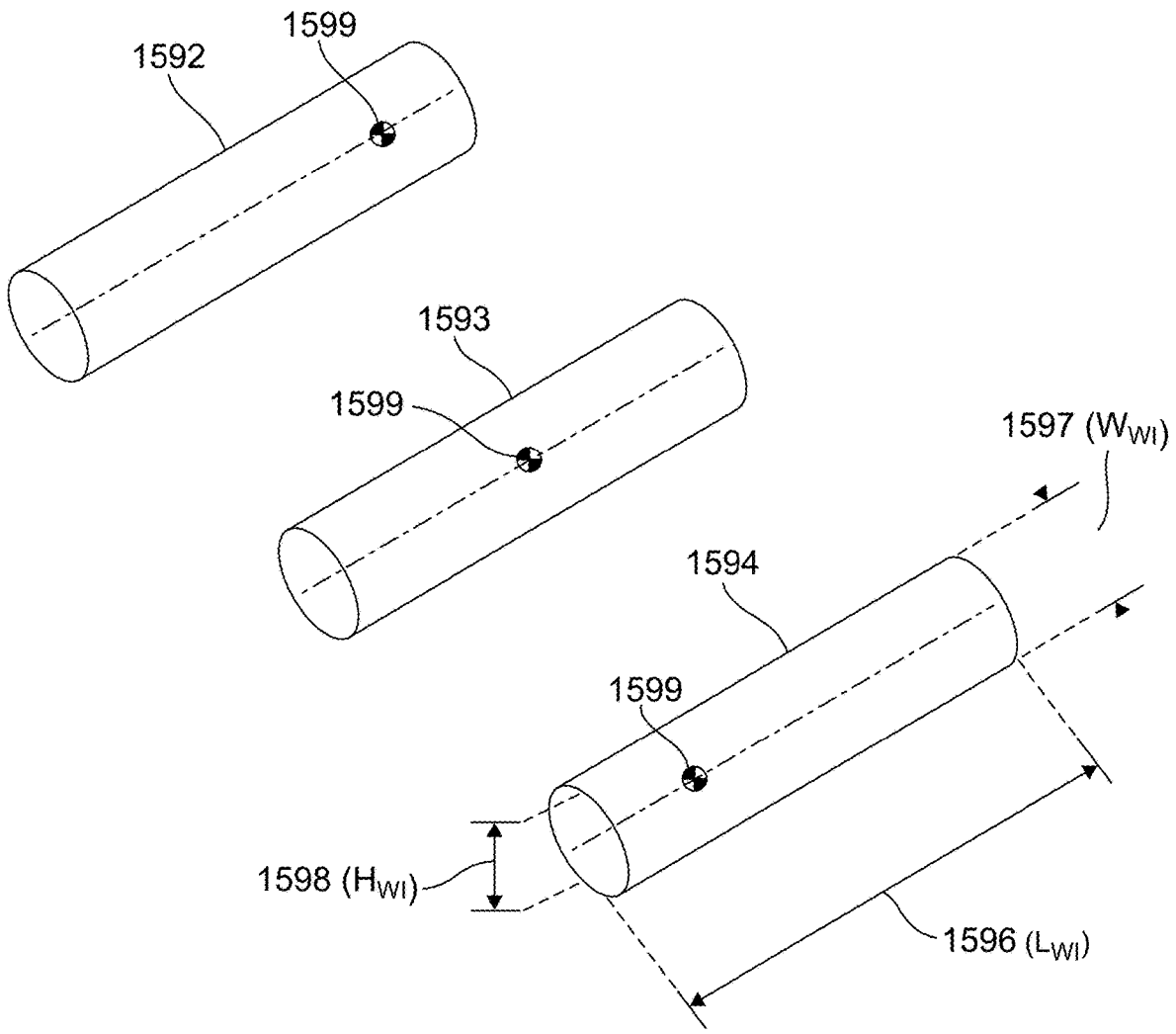
FIG. 16 illustrates a plurality of weight inserts configured to be received within the club head of FIG. 15.

As discussed above, the weight inserts 1595 are designed to each have a unique weight insert Center of Gravity 1599 (hereafter "$CG_{wi}$") location, wherein each weight insert 1595 corresponds to a unique club head build. Different $CG_{wi}$ 1599 locations can be provided by varying any combination of the size, shape, or density of each of the plurality of weight inserts 1595. In the illustrated embodiment, each of the plurality of weight inserts 1595 have the same dimensions and comprise a generally cylindrical shape. However, in other embodiments, the weight inserts 1595 can have different dimensions and be any shape including trapezoidal, elliptical, conical, cubic, or hexagonal. In the present embodiment, different $CG_{wi}$ 1599 positions are provided by varying the density of the weight inserts 1595 along the weight insert length 1596 (hereafter "$L_{wi}$"). In some embodiments, the weight inserts 1595 can be made of a composite material with a density which varies along the $L_{wi}$ 1596. Alternative embodiments can vary the $CG_{wi}$ 1599 location by other means. For example, in some embodiments, the weight insert 1595 can comprise a hollow core wherein a separate weight or multiple weights of varying mass are positioned along the length of the core to provide a particular $CG_{wi}$ 1599 location. In some embodiments, the $CG_{wi}$ 1599 location can be manipulated by forming a weight insert 1595 comprised of multiple materials or a composite material. In the present embodiment, the density of the weight inserts 1595 does not need to vary along the weight insert width 1597 (or $W_{wi}$) or the weight insert height 1598 (or $H_{wi}$). Varying the density of different weight inserts 1595 along their respective lengths allows the $CG_{wi}$ 1599 to be moved to any location along the length $L_{wi}$, as shown in FIG. 16. The unique $CG_{wi}$ 1599 positions between weight inserts 1595 allow for a variation in weight offset (hereafter "$O_w$") between builds. $O_w$ is defined as the distance between the CG 1560 of the club head 1500 and the $CG_{wi}$ 1599 measured perpendicular to the Y'-axis 1080 and is interchangeable with the term "r" of Equation 2. When the weight inserts 1595 are all installed at the same position, such being the case for the current embodiment, designing the plurality of weight inserts 1595 to unique $CG_{wi}$ 1599 locations allows each weight insert 1595 to have a unique $O_w$.

FIG. 16 illustrates a plurality of weight inserts 1592, 1593, 1594 each having a unique $CG_{wi}$ location. The adjustable swing weight system described herein comprises a plurality of cylindrical weight inserts constructed according to the embodiment of FIG. 15. Referring to FIG. 16, the plurality of weight inserts 1595 comprises two or more weight inserts 1595 wherein each of the weight inserts 1595 comprise a unique $CG_{wi}$ 1599 location and a unique mass, as discussed above. The present example comprises a light weight insert 1592, a medium weight insert 1593, and a heavy weight insert 1594. The three weight inserts 1592, 1593, 1594 of the present embodiment are the same size and shape but have different masses and $CG_{wi}$ positions, as discussed in further detail above. In other embodiments the plurality of weight inserts 1595 can comprise any number of weight inserts including 2 weight inserts, 3 weight inserts, 4 weight inserts, 5 weight inserts, 6 weight inserts, 7 weight inserts, 8 weight inserts, 9 weight inserts, 10 weight inserts, 11 weight insert, 12 weight inserts, 13 weight inserts, 14 weight inserts, 15 weight inserts, 16 weight inserts, 17 weight inserts, 18 weight inserts, 19 weight inserts, or 20 weight inserts.

Figure 17A:
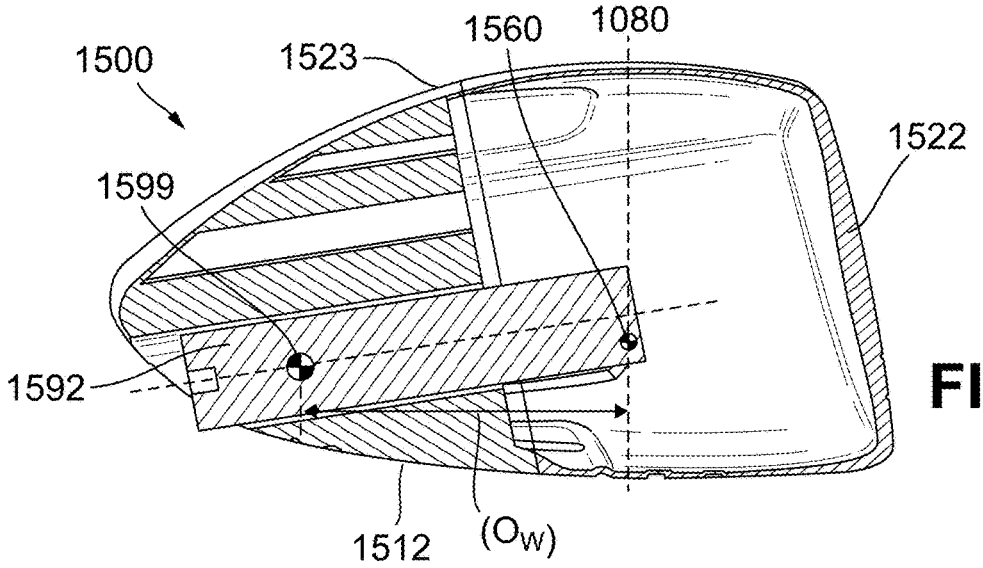
FIGS. 17A-17C illustrate toe-side cross sectional views of the club head of FIG. 15 with respect to a plurality of weight insert configurations.
Figure 17B:
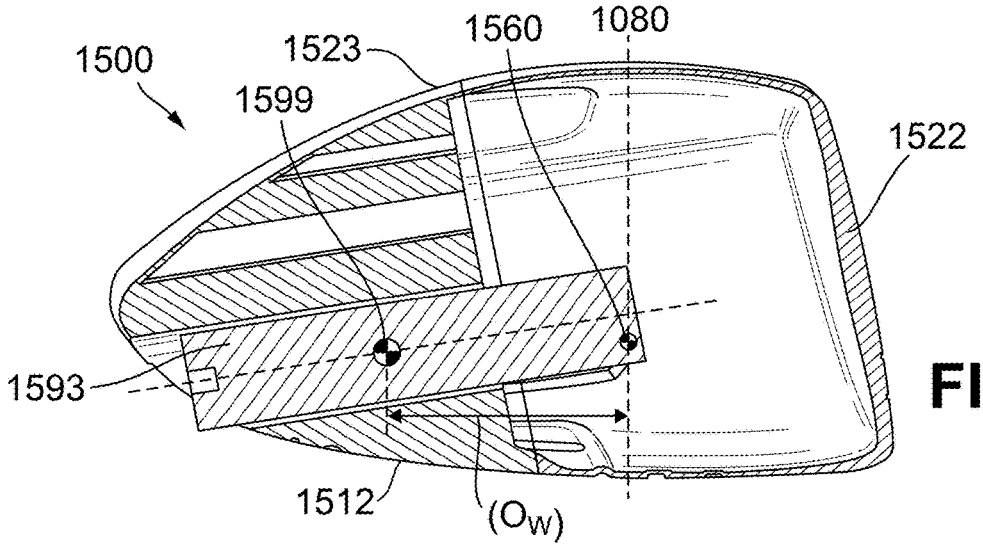
Figure 17C:
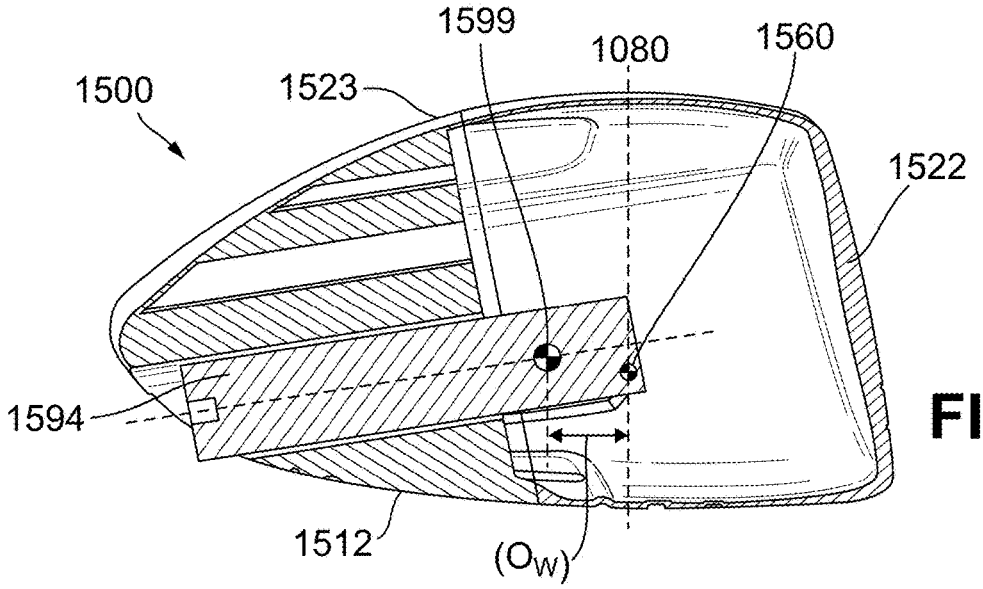

FIGS. 17A, 17B, and 17C illustrate how each of the plurality of weight inserts 1595 can be received by the club head 1500 such each comprises a unique $O_w$ value. The weight inserts 1595 of this embodiment will be offset a distance $O_w$ which increases quadratically as the weight insert mass decreases in order to achieve identical Iyy contributions For example, a light weight insert 1592, as illustrated in FIG. 17A will have a $O_w$ which is greater than that of a medium weight insert 1593 (illustrated in FIG. 17B) or a heavy weight insert 1594 (illustrated in FIG. 17C). The offset along the Y'-axis 1080 by a distance $O_w$ of the light weight insert 1592 will yield an Iyy value for the clubhead 1500 that is greater than that of the club head 1500 when no weight insert 1595 is received by tubular recess 1585. The medium weight insert 1593 of FIG. 17B will have a which is less than that of the light weight insert 1592 and an Iyy contribution identical to that of the light weight insert 1592. An identical Iyy contribution of the medium weight insert 1593 and light weight insert 1592 is achieved by providing an $O_w$ for the medium weight insert 1593 which decreases quadratically in proportion to the increase in mass between the medium insert 1593 and the light weight insert 1592. Finally, in this example the heavy weight insert 1594 of FIG. 17C will have a $O_w$ which is less than that of both the light weight insert 1592 and the medium weight insert 1593. The mass of the heavy weight insert 1594 will also be such that it also yields an identical Iyy contribution as the light weight insert 1592 and medium weight insert 1593. An identical Iyy contribution of the heavy weight insert will be achieved by providing an $O_w$ for the heavy weight insert 1594 which decreases quadratically in proportion to the increase in mass between the heavy weight insert 1594 and the light weight insert 1592.

The adjustable swing weight system described above allows for varying the swing weight of club heads with a negligible (or zero) variation in clubhead Iyy. Further, in many embodiments, each of the weight inserts 1595 will be at least partially inserted into the clubhead 1500 such that its $CG_{wi}$ 1599 location will be along the force line 1525 of the club head 1500. Providing the $CG_{wi}$ 1599 along the force line 1525 ensures consistent launch characteristics between club head builds, because the relative distance between the club head CG 1560 and the force line 1525 will remain consistent between builds.

Figure 18:
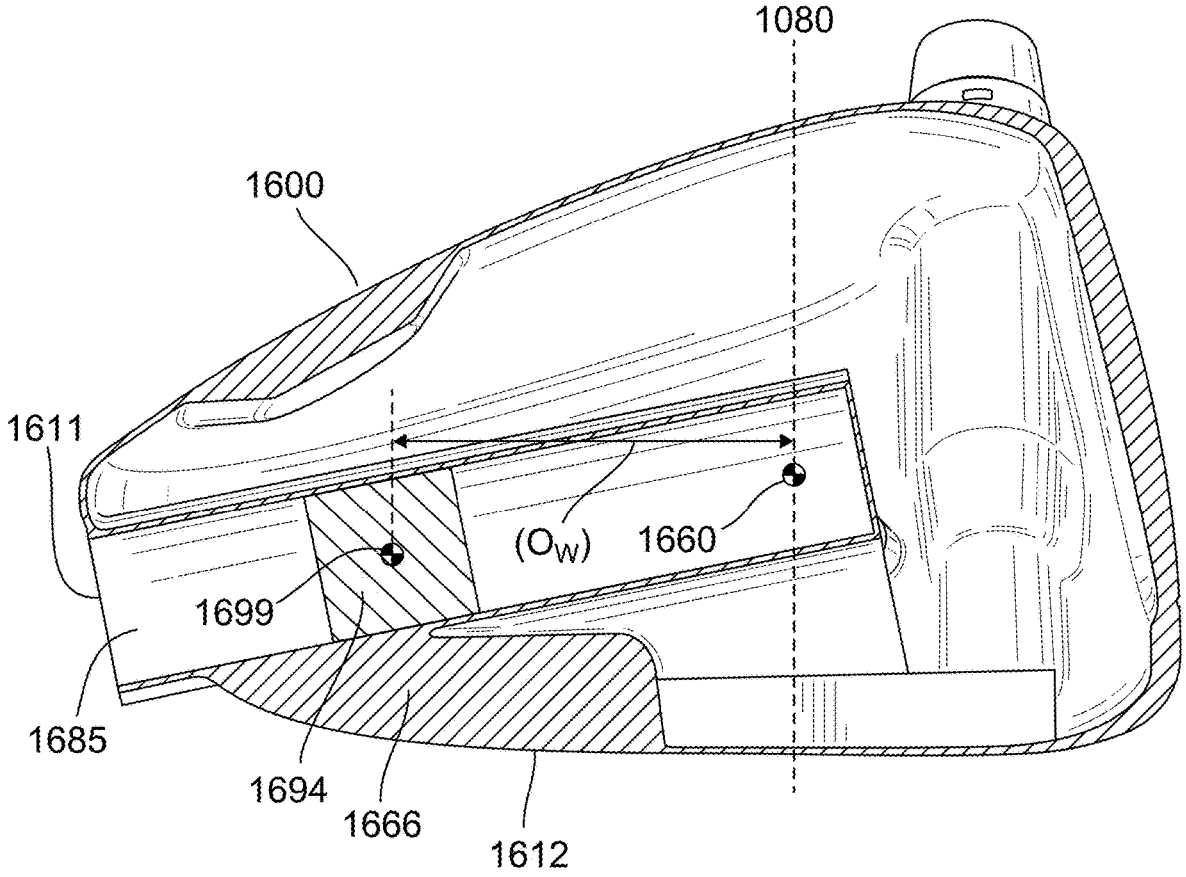
FIG. 18 illustrates a toe-side cross-sectional view of a golf club head comprising an adjustable swing weight system according to a second embodiment, in a first configuration.
Figure 19:
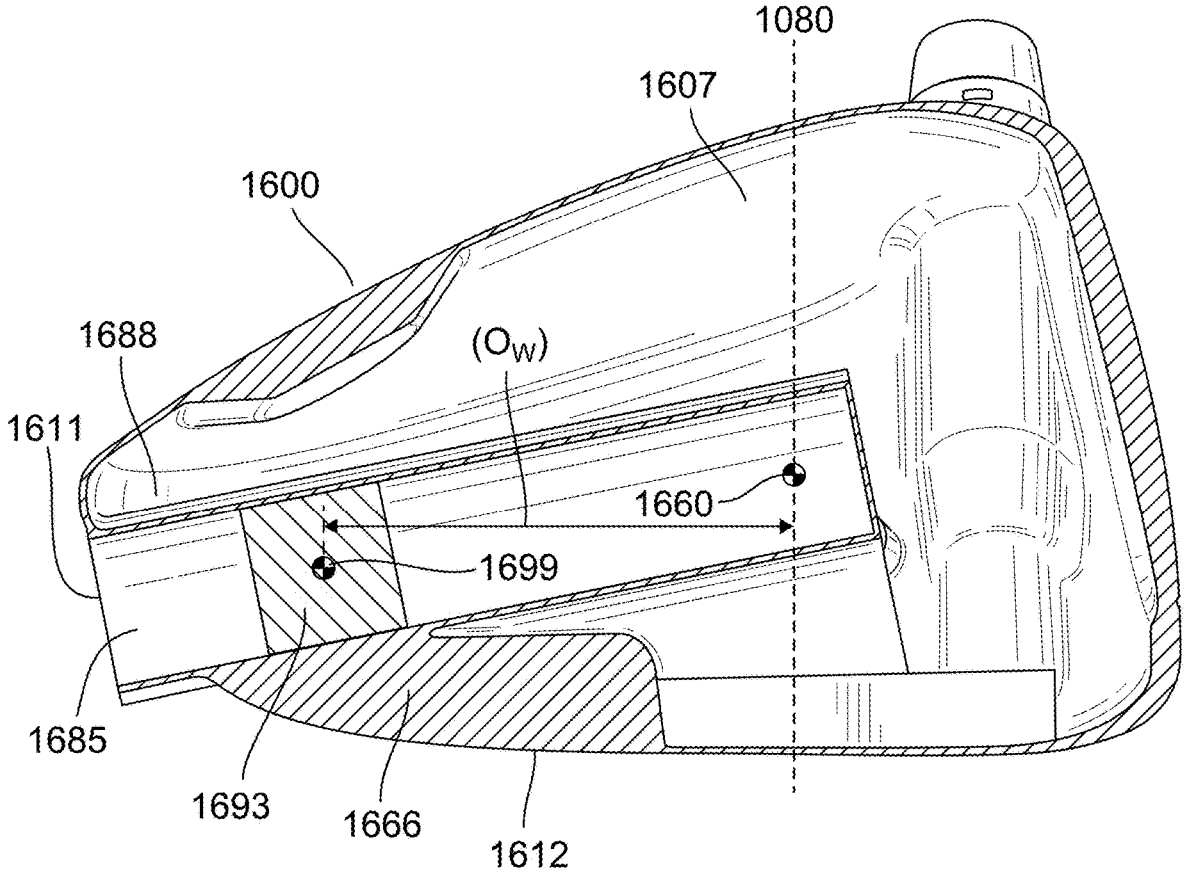
FIG. 19 illustrates a toe-side cross-sectional view of the golf club head of FIG. 18, in a second configuration.
Figure 20:
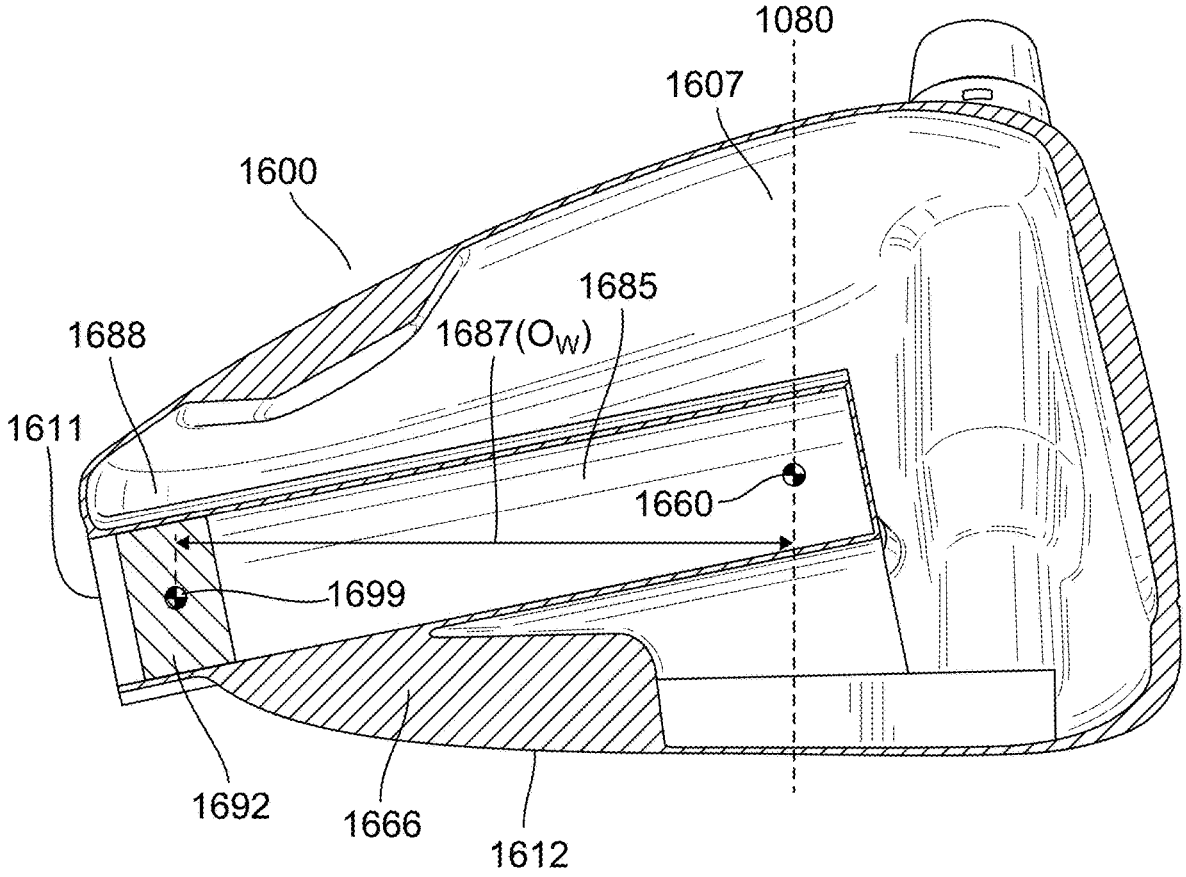
FIG. 20 illustrates a toe-side cross-sectional view of the golf club head of FIG. 18, in a third configuration.
Figure 21:
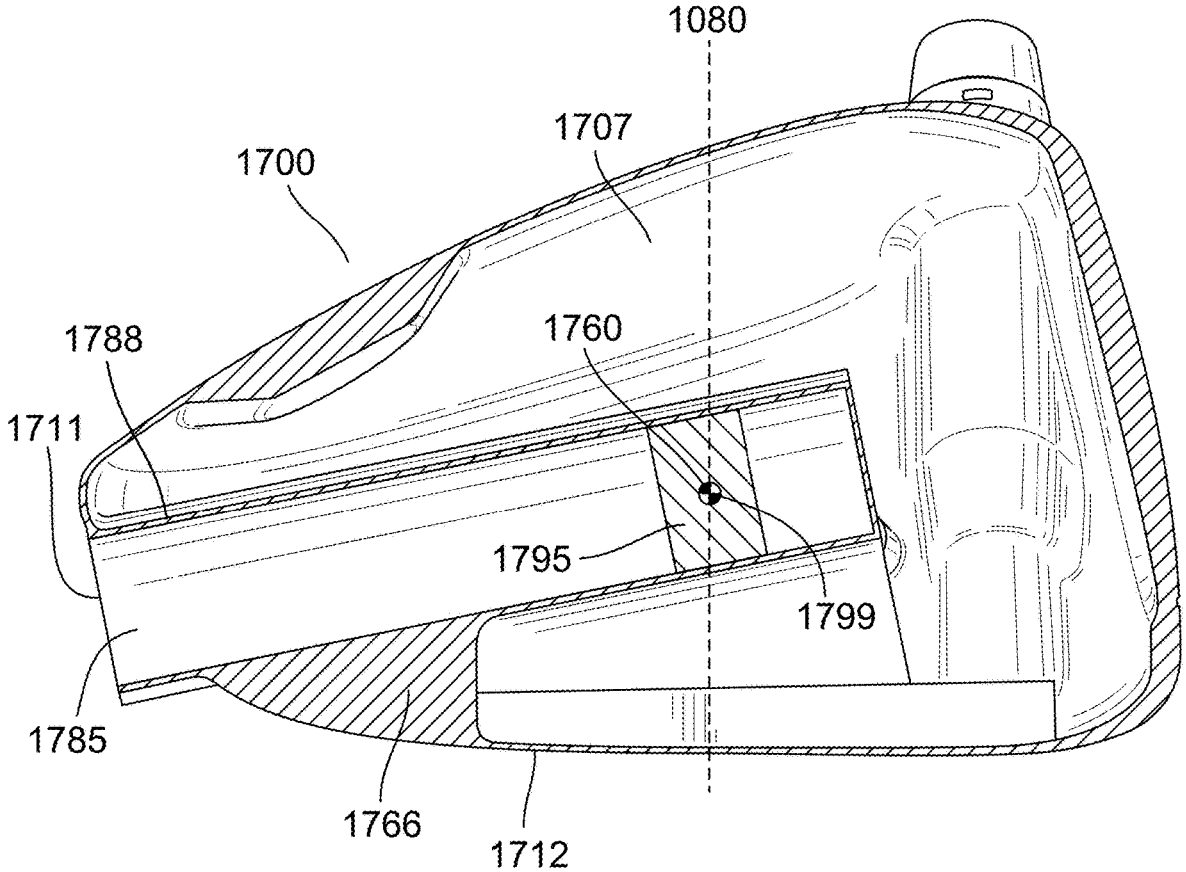
FIG. 21 illustrates a toe-side cross-sectional view of a golf club head comprising an adjustable swing weight system according to a third embodiment.

FIGS. 18-20 illustrate an alternative embodiment of a club head 1600 the adjustable swing weight system. The present embodiment contains all the same features of the adjustable swing weight system of FIGS. 15-17C, but comprises an alternate design for the weight inserts 1695. The clubhead 1600 includes an adjustable swing weight system comprising a plurality of weight inserts 1695 wherein at least one of the plurality of weight inserts 1695 may be selected to be at least partially inserted into the club head 1600 at different positions to adjust the swing weight of the club head 1600. The embodiment of FIGS. 18-20 takes advantage of the fact that the weight inserts 1695 can be treated as point masses. In particular, since the weight inserts 1695 can be treated as point masses according to Equation 2, the shape and size of the weight inserts 1695 does not need to be held constant. Therefore, instead of having weight inserts 1695 of identical size and shape, weight inserts 1695 of clubhead 1600 can be cylindrical weights of varying dimension. Varying the dimensions of weight inserts 1695 for different club head builds allows for a difference in weight insert 1695 mass. To achieve a constant Iyy of the clubhead 1600 when any of the plurality of weight inserts 1695 are at least partially inserted into the clubhead 1600, the weight inserts 1695 are all secured at different discrete locations within tubular recess 1685 corresponding to different $O_w$ values. Similar to the embodiment shown in FIGS. 17A, 17B, and 17C, the distinct discrete position of the weight inserts 1695 allows for varying club head 1600 weights while maintaining substantially identical club head 1600 Iyy values. As discussed above, a consistent Iyy contribution from a plurality of weight inserts having different masses can be achieved by placing the weight insert near or directly at the club head CG location. A further alternative embodiment of the adjustable swing weight system is shown in FIG. 21. This alternative embodiment contains all the same features of the adjustable swing weight systems described above and introduces an alternate design for tubular recess 1785. Tubular recess 1785 is a recess extending from the rear 1711 of the club head 1700. The tubular recess 1785 is surrounded by a cylindrical shell 1788. The cylindrical shell 1788 is a generally thin-walled cylindrical barrier which separates the tubular recess 1785 from the interior cavity 1707 of the club head 1700. The club head 1700 further comprises a support member 1766 which connects the cylindrical shell 1788 to the sole 1712 of the clubhead 1700. Any of the plurality of weight inserts 1795 may be inserted into the tubular recess 1785 and are configured to lock into place when the $CG_{wi}$ 1799 is in alignment with the CG 1760 of club head 1700. The $CG_{wi}$ 1799 may be aligned with the CG 1760 of club head 1700 such that the $O_w$ is negligible or zero for every build. By aligning the $CG_{wi}$ 1799 with the CG 1760 of club head 1700, the plurality weight inserts 1795 will all have zero or negligible contribution to the club head 1700 Iyy and, therefore, yield a substantially identical club head 1700 Iyy for every build. By providing a substantially zero Ow value, the Iyy contribution of the weight insert 1795 is substantially zero, regardless of the mass of the weight insert 1795. The present embodiment allows for a large variation in total club head mass between builds with negligible variation in Iyy. In the present embodiment, the weight inserts 1795 may be comprised of varying materials, shapes, and or sizes as long as each of the plurality of weight inserts has a zero or negligible $O_w$ value.

Figure 22:
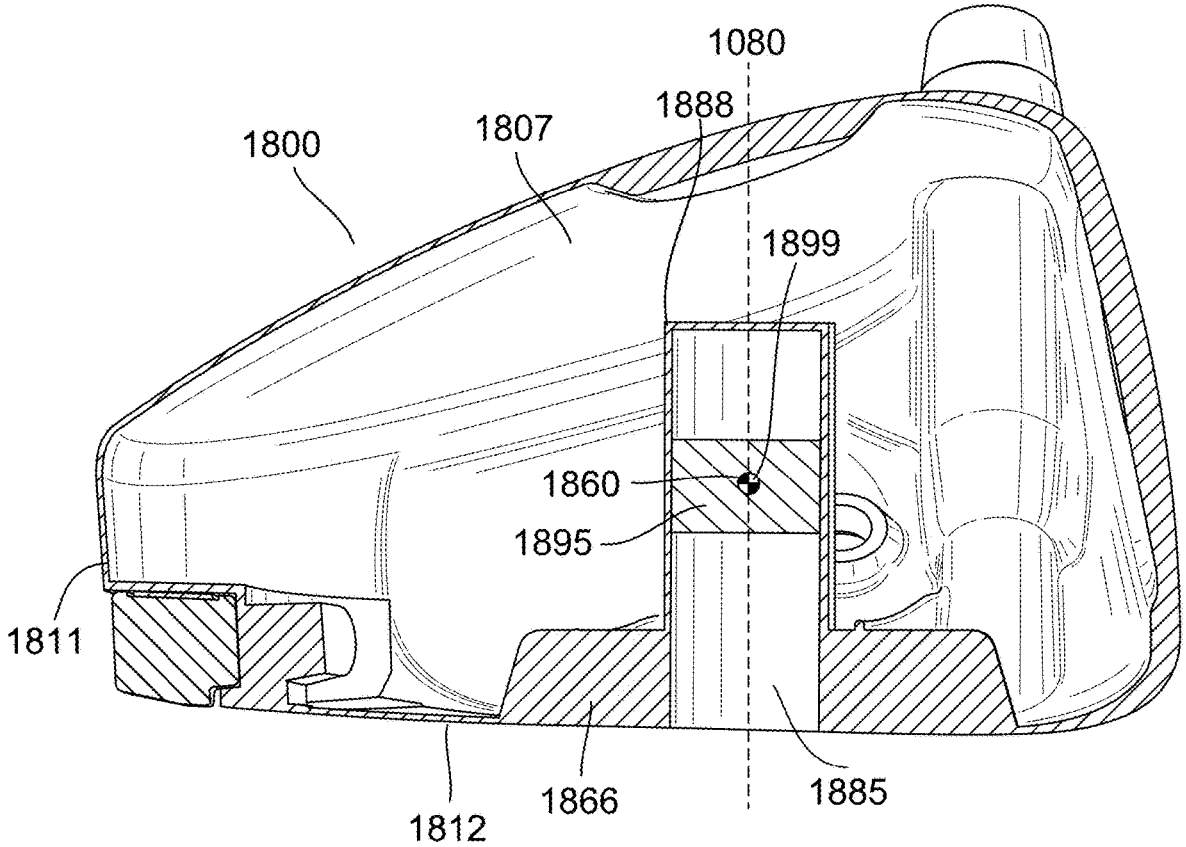
FIG. 22 illustrates a toe-side cross-sectional view of a golf club head comprising an adjustable swing weight system according to a fourth embodiment.

Another embodiment of the adjustable swing weight system is shown in FIG. 22. The adjustable swing weight system of FIG. 22 is similar to the embodiment of FIG. 21, except the tubular recess 1885 extends from the sole 1812 of club head 1800. For this embodiment any of the plurality of weight inserts 1895 may be inserted into tubular recess 1885 and are configured wherein the $CG_{wi}$ 1899 is in alignment with the CG 1860 of club head 1800. The club head 1800 further comprises a support member 1866 which adds support to the base of the cylindrical shell 1888. In many embodiments, the support member 1866 can take the form of a mass pad, similar to the sole mass pad described above.

VI. Additional Features

The various embodiments of the club head comprising a high Ixx/Iyy ratio, optimized bulge and roll curvatures, and/or an adjustable swing weight system described herein can comprise one or more additional features that provide increased performance. The various features described below can be provided in any combination and can be applied to the club heads described in any of the various embodiments described above.

a. Internal Ribs

Figure 23:
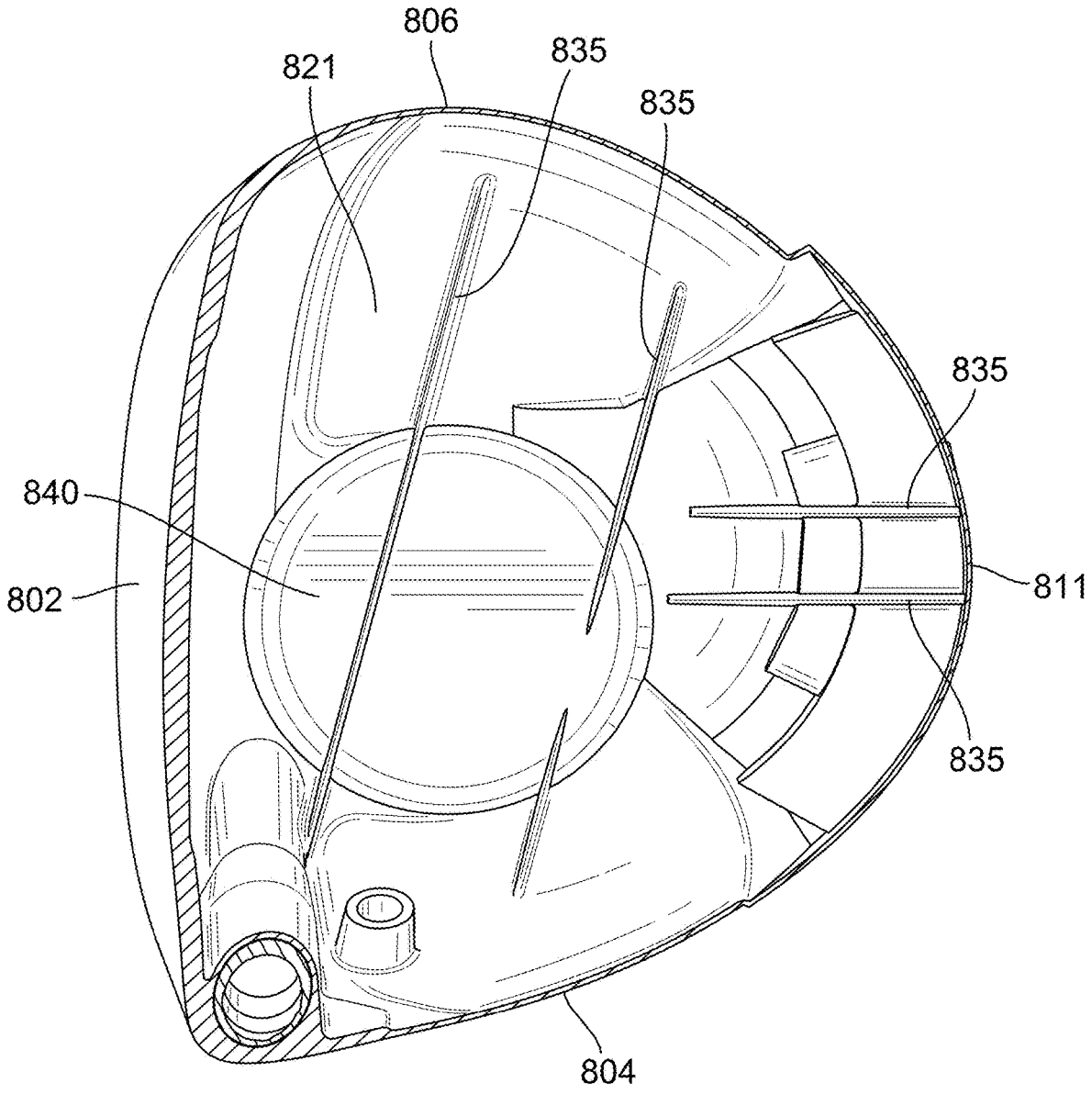
FIG. 23 illustrates a top cross-sectional view of a golf club head according to the present invention and comprising a plurality of internal ribs.

In many embodiments, as illustrated in FIG. 23, the club head 800 can comprise a plurality of ribs located on an interior surface of the body 801 and configured to damp vibrations and/or structurally reinforce portions of the club head 800. Generally, the sound and feel response of a golf club head is highly dependent on the club head's body shaping. The cube-like body shaping of the club heads described herein may, in some cases, introduce dominant vibrations at impact that lead to a harsh sound or feel at impact. The ribs can be provided to damp the dominant vibrations and providing a more desirable, muted sound and feel response.

In various embodiments, the club head 800 can comprise any number of ribs and any one or more of the plurality of ribs may extend along interior surfaces of the sole 812, crown 810, skirt 814, or any combination thereof. In the illustrated embodiment of FIG. 23, the club head 800 comprises a pair of central ribs 835 that extend across a large portion of the sole interior surface 821. The central ribs 835 each extend diagonally across the sole interior surface 821, from substantially near the heel 804 to substantially near the toe 806. In many embodiments, the central ribs 835 can be substantially parallel to each other. The central ribs provide a damping effect across a large portion of the sole 812, which is a common area for dominant vibrations to occur. The club head 800 further comprises a pair of rear ribs 836 located proximate the rear end 811 and extending in a substantially front-to-back rear direction. The rear ribs 836 can be particularly useful in embodiments comprising a weight member (as described above) coupled to a low and rearward portion of the body 801. In such embodiments, the rear ribs 836 are effective in damping vibrations that are caused by providing a heavy weight member in a rearward portion of the club head 800. The club head 800 of the illustrated embodiment further comprises a sole mass pad 840, as described in detail above. One or more of the central ribs 835 and/or rear ribs 836 can contact or intersect the sole mass pad 840.

Vibration control in golf club head design is highly dependent on localized reinforcement of high-vibration areas. Therefore, any of the central ribs 835 and or rear ribs 836 can be provided in any location or orientation, such as a heel-toe orientation, a front-back orientation, a diagonal orientation, or any combination thereof. As discussed above, the ribs provide vibration control to compensate for any dominant vibrations associated with the unique body shaping and mass distribution of the club heads described herein. The ribs allow for a club head that achieves a high Ixx/Iyy ratio while also providing a desirable sound and feel response.

b. Aerodynamic Features

As discussed above, the club head may comprise several features to maximize aerodynamic properties, while still balancing the Ixx/Iyy ratio. Specifically, the club head may at least comprise turbulators, a sole transition profile, a crown transition profile, a rear transition profile, and a back cavity. Generally, golf club head aerodynamic drag is dominated by body shape causing flow separation (i.e., pressure drag/form drag). Relative to modern, "flattened" clubs, the club head of the present invention may produce less drag during a swing due to a smaller surface area or volume, wherein the smaller surface area or volume may be introduced to achieve a target Iyy, value. Relative to more bulbous prior-art club heads, the club head of the present invention may produce less drag during a swing because of the integrated aerodynamic features.

In some embodiments, the club head can include a plurality of turbulators as described in U.S. patent application Ser. No. 13/536,753, filed on Jun. 28, 2021, now U.S. Pat. No. 8,608,587, granted on Dec. 17, 2013, entitled "Golf Club Heads with Turbulators and Methods to Manufacture Golf Club Heads with Turbulators," Which is incorporated fully herein by reference. Turbulators on the crown are known in the art to reduce drag. Turbulators disrupt airflow, thereby energizing the flow and delaying flow separation. Therefore, turbulators reduce drag produced by the club head during a swing and increase ball speed.

The club head can further comprise a crown transition profile, a sole transition profile, and/or a rear transition profile similar to the crown transition, sole transition, and rear transition profiles described in U.S. patent application Ser. No. 15/233,486, filed on Aug. 10, 2016, now U.S. Pat. No. 10,035,048 granted on Jul. 31, 2018, entitled "Golf Club Head with Transition Profiles to Reduce Aerodynamic Drag." The club head can comprise a front radius of curvature, a sole radius of curvature and/or a rear radius of curvature that can be similar to the first crown radius of curvature, the first sole radius of curvature, and/or the rear radius of curvature described in U.S. patent application Ser. No. 15/233,486, filed on Aug. 10, 2016, now U.S. Pat. No. 10,035,048 granted on Jul. 31, 2018, entitled "Golf Club Head with Transition Profiles to Reduce Aerodynamic Drag."

The front radius of curvature may be between 0.18 to 0.30 inches (0.46 to 0.76 cm). Further, in other embodiments, the front radius of curvature 392 can be less than 0.40 inches (1.02 cm), less than 0.375 inches (0.95 cm), less than 0.35 inches (0.89 cm), less than 0.325 inches (0.83 cm), or less than 0.30 inches 0.76 cm).

The sole radius of curvature can range from approximately 0.25 to 0.50 inches (0.76 to 1.27 cm). In some embodiments, the sole radius of curvature can be less than 0.5 inches (1.27 cm), less than 0.475 inches (1.21 cm), less than 0.45 inches (1.14 cm), or less than 0.40 inches (1.02 cm).

The rear radius of curvature can range from 0.10 to 0.25 inches (0.25 to 0.64 cm). In some embodiments, the rear radius of curvature can be less than 0.3 inches (0.76 cm), less than 0.275 inches (0.70 cm), less than 0.25 inches (0.64 cm), less than 0.225 inches (0.57 cm), or less than inches (0.51 cm).

Additionally, the club head can further include a cavity located at the rear end and in the rear edge of the club head, similar to the cavity described in U.S. patent application Ser. No. 14/882,092, now U.S. Pat. No. 9,492,721 granted on Nov. 15, 2016, entitled "Golf Club Heads with Aerodynamic Features and Related Methods," Which is incorporated fully herein by reference. In many embodiments, the cavity 420 can break the vortices generated behind golf club head 300 into smaller vortices to reduce the size of the wake and/or reduce drag.

EXAMPLES

VII. Example 1: 3700 g*cm$^2$ Iyy Target

A first exemplary club head was designed to maximize performance within the context of an Iyy target. The first exemplary club head comprised a cube-like body shaping and a large portion of the club head mass distributed near the Y'-axis. The first exemplary club head was designed to an Iyy target value of 3700 g*cm$^2$. The first exemplary club head comprised a body width $W_B$ of 4.4 inches, a body height $H_B$ of 2.31 inches, a body depth $D_B$ of 4.31 inches, and a volume of 446 cm$^3$. These body dimensions resulted in a $H_B/W_B$ ratio of 0.53 and a $H_B/D_B$ ratio of 0.54. The club head further comprised a mass pad covering a large portion of the interior surface of the sole. The mass pad comprised a mass of 24 grams and was located in a central portion of the sole, such that it was intersected by the Y'-axis. Further, 11.2% of the exemplary club head total mass was located within a central mass zone comprising a radius $R_{CMZ}$ of 0.75 inch. The exemplary club head further comprised a removable weight member coupled to the body between the rear end and the sole in an extreme low and rearward position, comprising a mass of 32 grams. The club head further comprised a multi-material body construction with a non-metal component forming a large portion of the crown, and portions of the heel, toe, and sole.

The body shaping, mass distribution, weight member placement, and multi-material construction of the first exemplary club head resulted in an Ixx of 3051 g*cm$^2$ and an Iyy of 3650 g*cm$^2$. Therefore, the first exemplary club head comprised an Ixx/Iyy ratio of 0.84.

VIII. Example 2: 2600 g*cm$^2$ Iyy Target with Crown and Sole Mass Pads

A second exemplary club head was designed to maximize performance within the context of an Iyy target. The second exemplary club head comprised a cube-like body shaping and a large portion of the club head mass distributed near the Y'-axis. The second exemplary club head was designed to an Iyy target value of 2600 g*cm$^2$. The second exemplary club head comprised a body width $W_B$ of 3.95 inches, a body height $H_B$ of 2.44 inches, a body depth $D_B$ of 3.85 inches, and a volume of 332 cm$^3$. These body dimensions resulted in a $H_B/W_B$ ratio of 0.62 and a $H_B/D_B$ ratio of 0.63. The second exemplary club head further comprised a first mass pad located on an interior surface of the sole. The first mass pad was located in a central portion of the sole and was intersected by the Y'axis and the YZ plane. The first mass pad was spaced rearward of the leading edge by more than 10% of the body depth. The first mass pad was entirely contained within a central mass zone having a radius $R_{CMZ}$ of 0.75 inch. The club head further comprised a second mass pad located on an interior surface of the crown. The second mass pad was located in a central portion of the crown and was intersected by the Y'axis and the YZ plane. The second mass pad was spaced rearward of the leading edge by more than 10% of the body depth. The second mass pad also was entirely contained within the same central mass zone. The first mass pad and second mass pad comprised a combined mass of 22.3 grams. The club head further comprised a third mass pad located on an interior surface of the sole, rearward of the first mass pad. The third mass pad covered a majority of the interior surface of the sole between the first mass pad and the rear end of the club and comprised a mass of 46 grams. Further, 21% of the exemplary club head total mass was located within the central mass zone. The second exemplary club head was devoid of any additional weight members and comprised a single-material body construction devoid of any non-metal components.

The body shaping, mass pad placement, and mass distribution of the second exemplary club head resulted in an Ixx of 2077 g*cm$^2$ and an Iyy of 2568 g*cm$^2$. Therefore, the second exemplary club head comprised an Ixx/Iyy ratio of 0.81. Unlike exemplary club head 1, exemplary club head 2 was able to achieve an Ixx/Iyy ratio without the use of any additional weight members attached to the body. Exemplary club head 2 provided a high Ixx/Iyy ratio through centrally located mass pads and higher $H_B/W_B$ and $H_B/D_B$ ratios.

IX. Example 3: 2600 g*cm$^2$ Iyy Target with Rear Weight

A third exemplary club head was designed to maximize performance within the context of an Iyy target. The third exemplary club head comprised a cube-like body shaping and a large portion of the club head mass distributed near the Y'-axis. The third exemplary club head was designed to an Iyy target value of 2600 g*cm$^2$. The third exemplary club head comprised a body width $W_B$ of 3.6 inches, a body height $H_B$ of 2.4 inches, a body depth $D_B$ of 3.5 inches, and a volume of 280 cm$^3$. These body dimensions resulted in a $H_B/W_B$ ratio of 0.67 and a $H_B/D_B$ ratio of 0.69. The third exemplary club head further comprised a first mass pad located on an interior surface of the sole, proximate the rear end. The first mass pad covered a majority of the rearward half of the sole interior surface and was spaced from the leading edge by more than 40% of the body depth. The first mass pad was provided in an extreme sole-ward position. The first mass pad comprised a mass of 33 grams. The club head further comprised a second mass pad located on an interior surface of the crown. The second mass pad was located in a central portion of the crown and was intersected by the Y'axis and the YZ plane. The second mass pad was spaced rearward of the leading edge by more than 10% of the body depth. The second mass pad was entirely contained within a central mass zone having a radius $R_{CMZ}$ of 0.75 inch. Further, 20.8% of the exemplary club head total mass was located within the central mass zone. The third exemplary club head further comprised a weight member coupled to the rear exterior of the club head, in an extreme low and rearward position, and comprising a mass of 30 grams. The third exemplary club head comprised a single-material body construction devoid of any non-metal components.

The body shaping, mass pad placement, mass distribution, and weight member of the third exemplary club head resulted in an Ixx of 2258 g*cm$^2$ and an Iyy of 2475 g*cm$^2$. Therefore, the second exemplary club head comprised an Ixx/Iyy ratio of 0.88. The third exemplary club head achieved a high Ixx/Iyy ratio, in comparison to exemplary club heads 1 and 2, by providing a combination of extremely high $H_B/W_B$ and $H_B/D_B$ ratios, a heavy mass pad in an extreme low position on the interior sole surface, a second mass pad located centrally on the crown, and a heavy rear weight in an extreme low and rearward position.

X. Example 4: 2700 g*cm$^2$ Iyy Target with Rear Weight, Crown, and Sole Mass Pad A fourth exemplary club head was designed to maximize performance within the context of an Iyy target. The fourth exemplary club head comprised a cube-like body shaping and a large portion of the club head mass distributed near the Y'-axis. The fourth exemplary club head was designed to an Iyy target value of 2700 g*cm$^2$. The fourth exemplary club head comprised a body width $W_B$ of 3.96 inches, a body height $H_B$ of 2.23 inches, a body depth $D_B$ of 3.74 inches, and a volume of 291 cm$^3$. These body dimensions resulted in a $H_B/W_B$ ratio of 0.56 and a $H_B/D_B$ ratio of 0.69. The fourth exemplary club head further comprised a first mass pad located on an interior surface of the sole, wherein the first mass pad was 50 grams The first mass pad was located in a central portion of the sole and was intersected by the Y'axis and the YZ plane. The first mass pad was spaced rearward of the leading edge by more than 10% of the body depth. The first mass pad was located entirely within a first central mass zone having a first radius $R_{CMZ1}$ of 0.825 inch. The club head further comprised a second mass pad located on an interior surface of the crown, wherein the second mass pad was approximately 6 grams. The second mass pad was located in a central portion of the crown and was intersected by the Y' axis and the YZ plane. The second mass pad was spaced rearward of the leading edge by more than 10% of the body depth. The second mass pad was located entirely within a second central mass zone having a second radius $R_{CMZ2}$ of 0.50 inch. Further, 25% of the exemplary club head total mass was located within a third central mass zone having a third radius $R_{CMZ3}$ of 0.75 inch. The fourth exemplary club head further comprised a weight member coupled to the rear exterior of the club head in an extreme low and rearward position, comprising a mass of 16 grams. The fourth exemplary club head comprised a single-material body construction devoid of any non-metal components.

The body shaping, mass pad placement, mass distribution, and weight member of the fourth exemplary club head resulted in an Ixx of 2161 g*cm$^2$ and an Iyy of 2679 g*cm$^2$. Therefore, the second exemplary club head comprised an Ixx/Iyy ratio of 0.80. The fourth exemplary club head comprises a high Ixx/Iyy ratio due to a large proportion of mass located within the central mass zone, provided by the centrally located first and second mass pads. However, in comparison to exemplary club heads 1-3, exemplary club head 4 exhibited a slightly lower Ixx/Iyy ratio, likely due to its relatively low $H_B/W_B$ ratio.

XI. Example 5: Comparison of Ixx/Iyy Ratios

The club head body dimensions (body height $H_B$, body width $W_B$, and body depth $D_B$) and moments of inertia of the first, second, third, and fourth exemplary clubs described above were compared to a plurality of control club heads that represent that prior art. The control club heads were designed to maximize Iyy rather than to maximize the Ixx/Iyy ratio. Control club head 1 is representative of a "modern" prior art club head, comprising a generally flat club head shape. Control club head 1 was designed to maximize Iyy through high perimeter weighting and a multi-material body structure comprising a non-metallic component forming a large portion of the crown. Control club head 2, control club head 3, and control club head 4 are representative of older prior art club heads, which tend to comprise a more bulbous club head shaping, but are devoid of specific weight structures, weight members, or mass distributions designed to increase the Ixx/Iyy ratio. The dimensions of each club head are presented in Table 1 below.

TABLE 1

| Club Head | Volume (cm$^3$) | $H_B$ (in.) | $W_B$ (in.) | $D_B$ (in.) | $H_B/W_B$ | $H_B/D_B$ | Ixx (g*cm$^2$) | Iyy (g*cm$^2$) | Ixx/Iyy |
|---|---|---|---|---|---|---|---|---|---|
| Control 1 | 450 | 2.38 | 4.93 | 4.87 | 0.48 | 0.49 | 4500 | 5850 | 0.77 |
| Control 2 | 455 | 2.57 | 4.78 | 4.19 | 0.53 | 0.61 | 2477 | 4216 | 0.59 |
| Control 3 | 455 | 2.56 | 4.70 | 4.19 | 0.54 | 0.61 | 2459 | 4090 | 0.60 |
| Control 4 | 455 | 2.60 | 4.75 | 4.32 | 0.55 | 0.60 | 2589 | 4333 | 0.60 |
| Exemplary 1 | 446 | 2.31 | 4.4 | 4.31 | 0.53 | 0.54 | 3051 | 3650 | 0.84 |
| Exemplary 2 | 332 | 2.44 | 3.95 | 3.85 | 0.62 | 0.63 | 2077 | 2568 | 0.81 |
| Exemplary 3 | 280 | 2.4 | 3.6 | 3.5 | 0.67 | 0.69 | 2258 | 2574 | 0.88 |
| Exemplary 4 | 291 | 2.23 | 3.96 | 3.74 | 0.56 | 0.60 | 2161 | 2697 | 0.80 |

As evidenced in Table 1 above, the exemplary club heads exhibited increased Ixx/Iyy ratios over both the flatter and more modern control club head 1 as well as the more bulbous and more traditional control club heads 2-4. Regarding control club head 1, the exhibited increase in Ixx/Iyy ratios in the exemplary club heads is attributed to club head shaping. The exemplary club heads comprised a significantly more cube-like body shape than control club head 1. The exemplary club heads exhibited increases in the $H_B/W_B$ ratio by between 10% to 40% and increases in the $H_B/D_B$ ratio by between 10% and 41% in comparison to control club head 1. The increased $H_B/W_B$ and $H_B/D_B$ ratios resulted in an increased Ixx/Iyy ratio between 4% and 14% greater than control club head 1.

Regarding control club heads 2-4, the exemplary club heads exhibited a Ixx/Iyy ratios that were increased by between 33% and 49%. Although control club heads 2-4 exhibited $H_B/W_B$ and $H_B/D_B$ ratios greater than 0.50, the control club heads did not comprise the weighting features or mass distribution near the Y'-axis described above in reference to the exemplary club heads. Despite the bulbous shaping of control club heads 2-4, the lack of any mass pads, weight members, or placement of mass near the Y'-axis provided substantially low Ixx values. The present example illustrates that a high Ixx/Iyy ratio is achieved through a combination of a cube-like body shaping and discretionary mass placement near the Y'-axis.

XII. Example 6: Offline Distance vs. Deviation from Optimal Bulge Radius (Iyy Target: 2000 g*cm$^2$)

Figure 25:
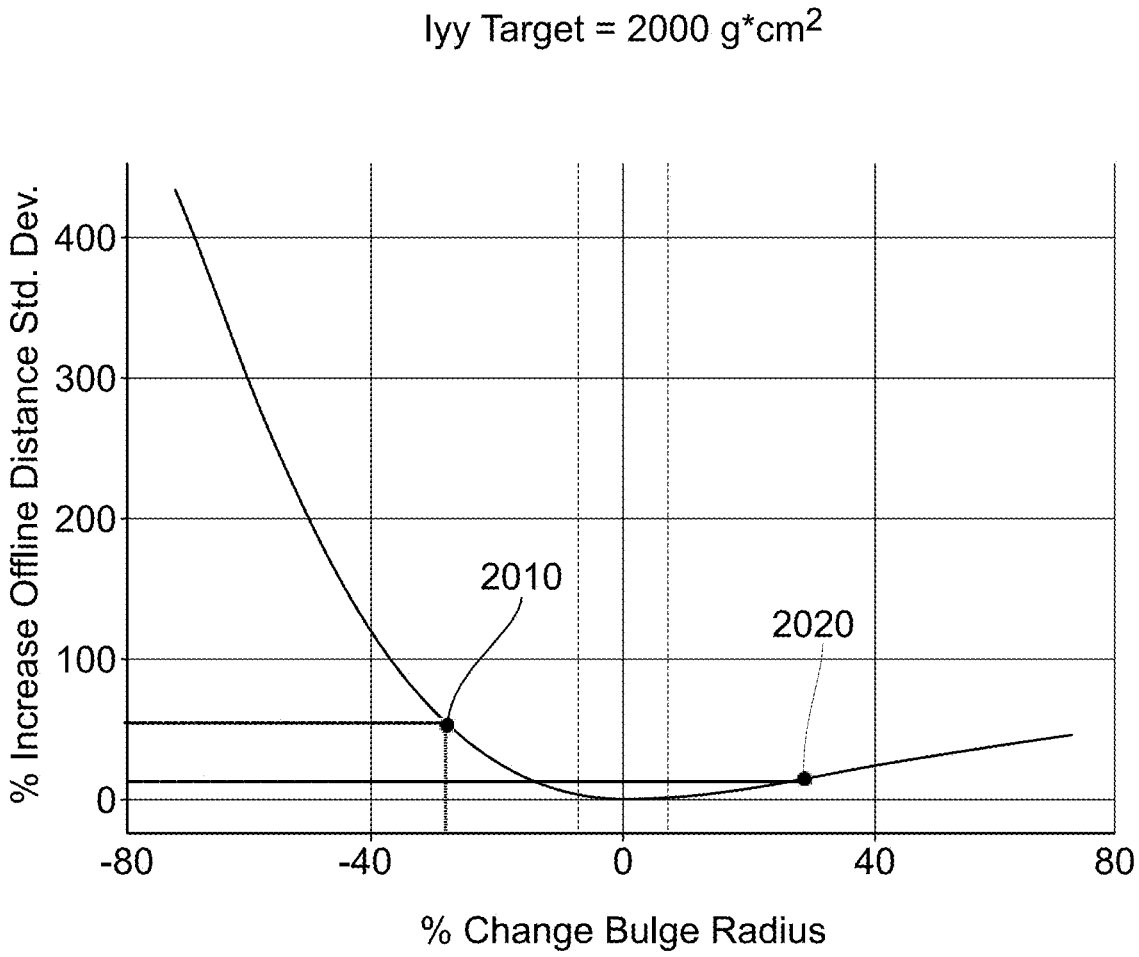
FIG. 25 illustrates a graphical representation of the relationship between bulge radius and offline distance, according to a first embodiment.

The present example illustrates the significance of providing an optimal bulge radius for a given club head, as described in the embodiments above. Referring to FIG. 25, an exemplary golf club head was configured to a target Iyy of 2000 g*cm$^2$, and further comprised an Ixx of 1480 g*cm$^2$, and a COR of 0.785. Based on relations 1-4 described in detail above, the club head comprised a strike face with optimal bulge and roll curvatures. The optimal bulge radius was provided at 6.77 inches and the optimal roll radius was provided at 4.59 inches. FIG. 25 illustrates a percentage increase in offline distance standard deviation would result from a deviation from the optimal bulge radius ("% Change Bulge Radius") for the exemplary club head. The graph illustrates the detrimental effects of providing a sub-optimal bulge radius to the exemplary club head. As shown in FIG. 25, as bulge radius deviates from the optimal value, the club head exhibits a substantial decrease in accuracy occurs (i.e. increased offline distance from target line).

As illustrated by points 2010 and 2020, even a small deviation from the optimal bulge curvature can lead to a significant loss of accuracy. Point 2010 illustrates a bulge radius that is 2 inches less (29.5% less) than the optimal bulge radius, which results in an increase in offline distance standard deviation of 54.3%. Point 2020 illustrates a bulge radius that is 2 inches greater (29.5% greater) than the optimal bulge radius, which results in an increase in offline distance standard deviation of 15.1%. The example illustrates that deviating from the optimal bulge radius by a only a small amount (i.e. only 2 inches) is detrimental to accuracy. Therefore, providing a bulge curvature that is optimized for a particular club head in accordance with the present invention is critical in maximizing club head forgiveness. This is especially true for a club head with a low Iyy target, as the optimized bulge and roll curvatures compensate for any forgiveness lost by providing a low Iyy.

XIII Example 7: Offline Distance vs. Deviation from Optimal Bulge Radius (Iyy Target: 3200 g*cm$^2$)

Figure 26:
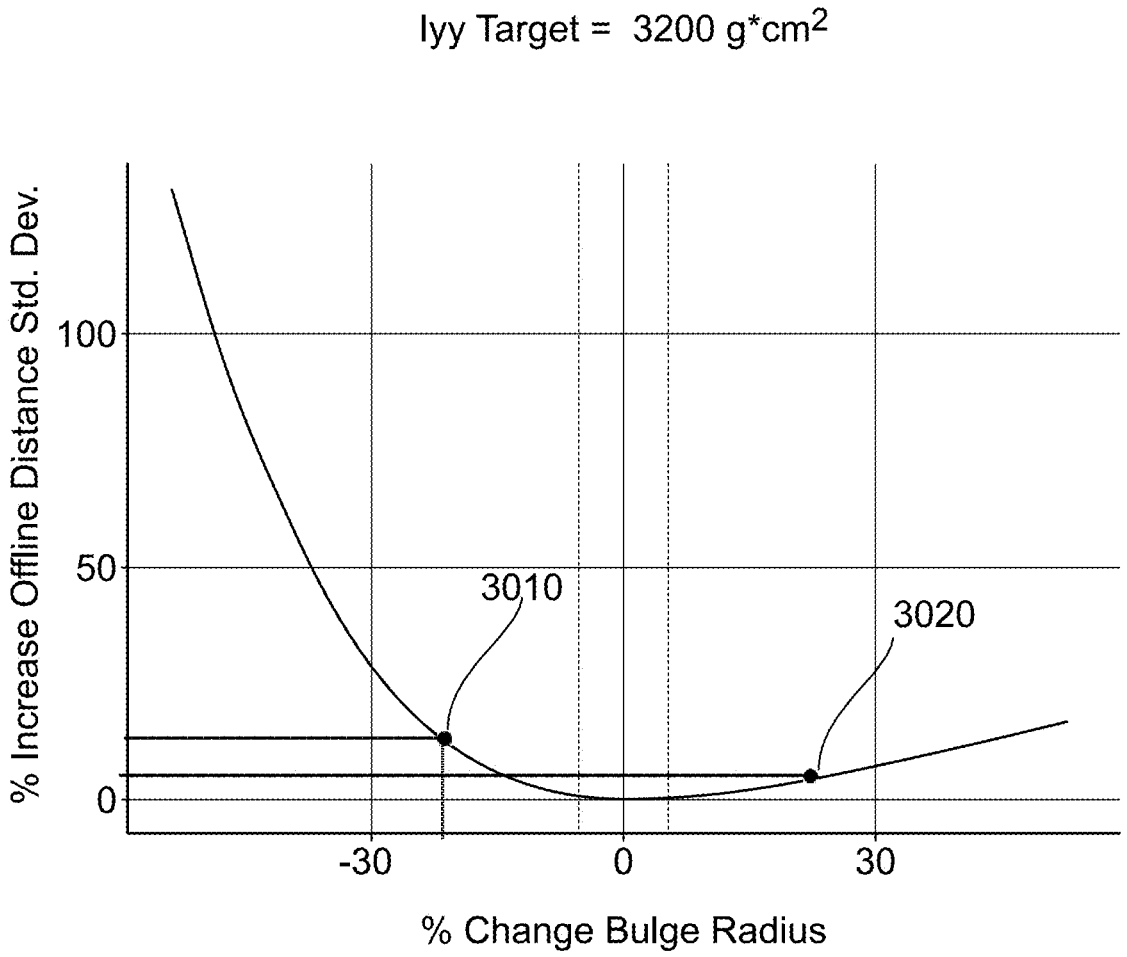
FIG. 26 illustrates a graphical representation of the relationship between bulge radius and offline distance, according to a second embodiment.

The present example further illustrates the significance of providing an optimal bulge radius for a given club head, as described in the embodiments above. Referring to FIG. 26, an exemplary golf club head was configured to a target Iyy of 3200 g*cm$^2$ and further comprised an Ixx of 2368 g*cm$^2$ and a COR of 0.814. Based on relations 1-4 described in detail above, the club head comprised a strike face with optimal bulge and roll curvatures. The optimal bulge radius was provided at 9.34 inches and the optimal roll radius was provided at 6.31 inches. FIG. 26 illustrates a percentage increase in offline distance standard deviation would result from a deviation from the optimal bulge radius ("% Change Bulge Radius") for the exemplary club head. The graph illustrates the detrimental effects of providing a sub-optimal bulge radius to the exemplary club head. As shown in FIG. 26, as bulge radius deviates from the optimal value, the club head exhibits a substantial decrease in accuracy occurs (i.e. increased offline distance from target line).

As illustrated by points 3010 and 3020, even a small deviation from the optimal bulge curvature can lead to a significant loss of accuracy. Point 3010 illustrates a bulge radius that is 2 inches less (21.4% less) than the optimal bulge radius, which results in an increase in offline distance standard deviation of 12.97%. Point 3020 illustrates a bulge radius that is 2 inches greater (21.4% greater) than the optimal bulge radius, which results in an increase in offline distance standard deviation of 4.32%. The example illustrates that deviating from the optimal bulge radius by a only a small amount (i.e. only 2 inches) is detrimental to accuracy. Therefore, providing a bulge curvature that is optimized for a particular club head in accordance with the present invention is critical in maximizing club head forgiveness.

XIV. Example 8: Standard Bulge and Roll Radii Vs. Optimized Bulge and Roll Radii A plurality of exemplary club heads comprising strike faces with optimized bulge and roll curvatures in accordance with the present invention were compared to a plurality of corresponding control club heads comprising standard bulge and roll curvatures that were not optimized for the club head's particular characteristics. Each exemplary club head corresponded to a control club head comprising identical characteristics, but for the differences in bulge and roll curvatures. Each control club head comprised a bulge radius of 12 inches and a roll radius of 12 inches, which are typical prior-art curvatures for a driver-type club head. The optimized bulge and roll radii of the exemplary club heads were in accordance with the ranges specified in the description above and were significantly lower than the standard bulge and roll radii of the control club heads. Table 2 below compares the average carry distance and offline distance standard deviation for a plurality of exemplary club head and control club head pairings, wherein each pairing comprised a different combination of Iyy target and COR.

TABLE 2

| Target Iyy (g*cm$^2$) | COR | Ixx/Iyy Ratio | Control Carry (Yards) | Exemplary Carry (Yards) | Control Offline SD (Yards) | Exemplary Offline SD (Yards) |
|---|---|---|---|---|---|---|
| 2000 | 0.785 | 0.74 | 263.82 | 274.73 | 22.63 | 12.60 |
| 2000 | 0.814 | 0.74 | 268.79 | 280.35 | 23.90 | 13.04 |
| 2600 | 0.785 | 0.74 | 269.28 | 275.12 | 18.39 | 12.85 |
| 2600 | 0.814 | 0.74 | 274.58 | 280.91 | 19.42 | 13.32 |
| 2600 | 0.785 | 0.82 | 270.27 | 275.31 | 18.50 | 12.87 |
| 2600 | 0.814 | 0.82 | 275.58 | 280.93 | 19.53 | 13.33 |
| 3200 | 0.785 | 0.74 | 272.21 | 275.46 | 15.78 | 13.02 |
| 3200 | 0.814 | 0.74 | 277.56 | 281.12 | 16.61 | 13.50 |

As shown (above), the exemplary club heads provide significant increases in both carry distance and offline distance in comparison to their control club head counterparts. The exemplary club heads exhibited significant increases in carry distance between 3.25 yards (a 1.2% increase) and 11.56 yards (a 4.3% increase) over the corresponding control club heads. Further, the exemplary club heads exhibited significant decreases in the standard deviation of offline distance between 2.76 yards (a 17% decrease) and 10.86 yards (a 45% decrease). The results indicate that applying an industry standard bulge and roll radius (12 inches) fails to maximize both carry distance and offline accuracy. In comparison, the exemplary club heads, which include optimized bulge and roll curvatures, improve distance and accuracy by significant amounts.

Optimizing the bulge and roll curvatures according to the present invention and the relations discussed in the description above provide a golf club head that hits the ball further and is drastically more forgiving. Further, while all exemplary club heads exhibited improvements over the control club heads, regardless of the Iyy target, the improvements tended to be more significant for lower MOI club heads. The results indicate that the bulge and roll radius of the present invention offers performance improvements for any MOI. Nevertheless, the optimized bulge and roll curvatures of the present invention are uniquely beneficial for low-MOI club heads. The optimization of bulge and roll curvatures can compensate for the natural losses in forgiveness associated with a low-MOI club head.

XV. Example 9: High MOI Club Head Vs. Low MOI Club Head with Bulge Radius and Roll Radius Obtained from Center of Gravity Location An exemplary club head comprising a low-MOI target and a strike face with optimized bulge and roll curvatures was compared to a prior-art high-MOI club head (hereafter the "control club head") with standard bulge and roll curvatures that that were not optimized for the club head's particular characteristics. The exemplary club head comprised a, Iyy of 2600 g*cm$^2$, an Ixx of 1924 g*cm$^2$, and a COR of 0.785. The control club head comprised an Iyy of 5700 g*cm$^2$, an Ixx of 4,218 g*cm$^2$, and a COR of 0.83. The control club head further comprised a bulge and roll radii of approximately 12 inches each. Table 3 below compares the average carry distance and offline distance standard deviation for the control club head and the exemplary club head.

TABLE 3

| | Control Club Head | Exemplary Club Head |
|---|---|---|
| Average Carry Distance (Yards) | 288.21 | 275.12 |
| Offline Distance Standard Deviation (Yards) | 14.42 | 12.85 |

As illustrated by Table 3, the exemplary club head exhibited a decrease in carry distance. However, the decrease in carry distance can be attributed to the difference in COR, rather than the bulge and roll curvatures. Despite an exceptionally lower moment of inertia, the exemplary club head exhibits an improvement in accuracy over the high-MOI golf club head. Although the exemplary club head comprised an Iyy that was reduced by 54%, the exemplary club head exhibited a 10.9% decrease in offline distance standard deviation. The results demonstrate that optimized bulge and roll curvatures overcome deficiencies introduced by reducing club head moment of inertia, and can even provide improved accuracy relative high-MOI club heads.

XVI. Example 10: Club Head with Adjustable Swing Weight and Constant Iyy

An exemplary club head was designed with an adjustable swing weight system which allowed the club head to achieve a variation in total club head mass of 26 grams with less than a 0.1 g*cm$^2$ variation in clubhead Iyy. The exemplary club head comprising the adjustable swing weight system was substantially similar to the embodiment illustrated in FIGS. 18-20. The adjustable swing weight system of the exemplary club head comprised a plurality of interchangeable and/or removable weight inserts including a light weight insert, a medium weight insert, and a heavy weight insert. Each of the plurality of weight inserts corresponded to an exemplary club head build including a light club head build (associated with the light weight insert), a medium club head build (associated with the medium weight insert), and a heavy club head build (associated with the heavy weight insert). Each of the plurality of weight inserts was associated with a unique discrete position within the tubular recess and a weight insert offset (Ow) value.

The tubular recess of the exemplary club head was 2.25 inches long. The light weight insert was positioned toward the rear of the tubular recess, providing an offset value Ow of 2.20 inches along the force line from the club head center of gravity. The medium weight insert was positioned further toward the center of the tubular recess and comprised offset value Ow of 1.63 inches. The heavy weight insert was position furthest toward the front of the tubular recess and the heavy weight insert and comprised an offset value $O_W$ of 1.38 inches. The light weight insert of the exemplary club head comprised a mass of 14.87 grams, the medium weight insert comprised a mass of 27.87 grams, and the heavy weight insert comprised a mass of 40.87 grams. The mass of the club head with no weight insert was held to a constant value of 175.20 grams. Because the interchangeable and/or removable weight inserts were configured within the same club head body, any variation in club head Iyy could only be attributed to varying the weight inserts and their positions. The different masses of the weight inserts were varied by providing different shapes and the densities for each weight insert. The density of the light weight insert was 9.44 g/cm$^3$, the density of the medium weight insert was 12.59 g/cm$^3$, and the density of the heavy weight insert was 17.31 g/cm$^3$. The selected values for the club head mass, mass of the weight inserts, the weight insert offset, and the resulting Iyy values for each build are summarized in Table 4 below. The example illustrates the ability of the adjustable swing weight system to provide a consistent Iyy between builds to match a desired Iyy target. Therefore, Ixx values are not reported in Table 4.

TABLE 4

| | Mass of Club Head (g) | Mass of Weight Insert (g) | Total Assembly Mass (g) | Weight Insert Offset Ow (in) | Weight Insert Density (g/cm$^3$) | Iyy (g*cm$^2$) |
|---|---|---|---|---|---|---|
| Light Club Head Build | 175.20 | 14.87 | 190.07 | 2.20 | 9.44 | 2667.21 |
| Medium | 175.20 | 27.87 | 203.07 | 1.63 | 12.59 | 2667.21 |

TABLE 4-continued

| | Mass of Club Head (g) | Mass of Weight Insert (g) | Total Assembly Mass (g) | Weight Insert Offset Ow (in) | Weight Insert Density (g/cm$^3$) | Iyy (g*cm$^2$) |
|---|---|---|---|---|---|---|
| Club Head Build | | | | | | |
| Heavy Club Head Build | 175.20 | 40.87 | 216.07 | 1.38 | 17.31 | 2667.21 |

As shown in Table 4, the exemplary adjustable swing weight system allows the total club head mass to be varied by 26 grams while maintaining a constant clubhead Iyy.

The configurations shown in Table 4 for the light club head build, medium club head build, and heavy club head build were determined based on an Iyy target of 2667 g*cm$^2$, a minimum desired club head build mass of 190 grams, and a desired maximum club head build mass of 216 grams. The Iyy target, number of weight inserts, and desired swing weights chosen were meant to be illustrative and are not indicative of limits of the adjustable swing weight system described herein. For example, should it be found desirable to achieve a greater value for the Iyy target with the total club head masses, one could design the club head to have a greater tubular recess length, thereby enabling the weights to be positioned farther from the club head CG and achieving greater Iyy values. Similarly, should it be found desirable to achieve a greater variation in swing weights across the different club head builds one could select a plurality of weight inserts with a greater variation in mass and position said weight inserts accordingly.

Clauses

Clause 1. A golf club head comprising a strike face comprising a geometric center and a leading edge, a body, a center of gravity, a ground plane, and a total club head mass; wherein the body comprises a crown, a sole, a heel, a toe, and a rear end; a primary coordinate system centered about the geometric center, the coordinate system defining: an X-axis extending in a heel-to-toe direction, parallel to the ground plane; a Y-axis extending in a crown-to-sole direction, orthogonal to the X-axis and the ground plane; a Z-axis extending in a strike face-to-rear direction, orthogonal to both the X-axis and the Y-axis; a secondary coordinate system centered about the center of gravity, the secondary coordinate system defining: an X'-axis extending in a heel-to-toe direction, parallel to the ground plane; a Y'-axis extending in a crown-to-sole direction, orthogonal to the X'-axis and the ground plane; a Z'-axis extending in a strike face-to-rear direction, orthogonal to both the X'-axis and the Y'-axis; wherein the body comprises: a body width measured parallel to the X-axis between the heel and the toe; a body depth measured parallel to the Z-axis between the leading edge and a rearward-most point of the body; a body height measured parallel to the Y-axis between the ground plane and a highest point of the crown; wherein the club head comprises a ratio $H_B/W_B$ defined as the body height divided by the body width; wherein the ratio $H_B/W_B$ is greater than 0.6; a moment of inertia about the X'-axis, Ixx; a moment of inertia about the Y'-axis, Iyy; a moment of inertia about the Z'-axis, Izz; wherein the club head comprises an Ixx/Iyy ratio greater than 0.8; a central mass zone defined by an imaginary cylinder centered about the Y'-axis, wherein the central mass zone defines a central mass zone radius of 0.75 inch; and wherein greater than 20% of the total club head mass is located within the central mass zone.

Clause 2. The golf club head of clause 1, further comprising a crown mass pad located on a crown interior surface and a sole mass pad located on a sole interior surface; wherein the crown mass pad and the sole mass pad are each intersected by the Y'-axis.

Clause 3. The golf club head of clause 2, wherein at least one of the crown mass pad and the sole mass pad is entirely bounded within the central mass zone.

Clause 4. The golf club head of clause 2, wherein the sole mass pad comprises a mass greater than 5 grams.

Clause 5. The golf club head of clause 2, wherein the crown mass pad comprises a mass greater than 25 grams.

Clause 6. The golf club head of clause 1, wherein the body width is less than 4.0 inches.

Clause 7. The golf club head of clause 1, wherein the body height is greater than 2.2 inches.

Clause 8. The golf club head of clause 1, wherein the club head comprises a volume less than 350 cm$^3$.

Clause 9. The golf club head of clause 1, wherein the Ixx/Iyy ratio is greater than 0.85.

Clause 10. The golf club head of clause 1, further comprising: a YZ plane extending along the Y-axis and the Z-axis; a crown transition point located at a forwardmost point of the crown within the YZ plane; a rear transition point located at a rearmost point of the crown within the YZ plane; a crown axis extending between the crown transition point and the rear transition point; a crown angle measured as an acute angle between the crown axis and the Y'-axis; and wherein the crown angle is greater than 75 degrees.

Clause 11. The golf club head of clause 10, wherein the crown angle is greater than 85 degrees.

Clause 12. The golf club head of clause 1, further comprising a weight member attached to the body proximate the rear end and the sole; wherein the weight member defines a weight member center of gravity; wherein the weight member comprises a weight member elevation defined as a distance between the center of gravity of the club head and the weight member center of gravity, measured parallel to the Y'-axis; wherein the weight member further comprises a weight member depth defined as a distance between the center of gravity of the club head and the weight member center of gravity, measured parallel to the Y'-axis; wherein the club head defines an $E_W/D_W$ ratio defined as the weight member elevation divided by the weight member depth; and wherein the $E_W/D_W$ ratio is greater than 0.3.

Clause 13. A golf club head comprising; a strike face comprising a geometric center and a leading edge, a body, a center of gravity, a ground plane, and a total club head mass; wherein the body comprises a crown, a sole, a heel, a toe, and a rear end; a primary coordinate system centered about the geometric center, the coordinate system defining: an X-axis extending in a heel-to-toe direction, parallel to the ground plane; a Y-axis extending in a crown-to-sole direction, orthogonal to the X-axis and the ground plane; a Z-axis extending in a strike face-to-rear direction, orthogonal to both the X-axis and the Y-axis; a secondary coordinate system centered about the center of gravity, the secondary coordinate system defining: an X'-axis extending in a heel-to-toe direction, parallel to the ground plane; a Y'-axis extending in a crown-to-sole direction, orthogonal to the X'-axis and the ground plane; a Z'-axis extending in a strike face-to-rear direction, orthogonal to both the X'-axis and the Y'-axis; wherein the body comprises: a body width measured parallel to the X-axis between the heel and the toe; a body depth measured parallel to the Z-axis between the leading edge and a rearward-most point of the body; a body height measured parallel to the Y-axis between the ground plane and a highest point of the crown; wherein the club head comprises a ratio $H_B/W_B$ defined as the body height divided by the body width; wherein the ratio $H_B/W_B$ is greater than 0.6; a moment of inertia about the X'-axis, Ixx; a moment of inertia about the Y'-axis, Iyy; a moment of inertia about the Z'-axis, Izz; wherein the club head comprises an Ixx/Iyy ratio greater than 0.8; a central mass zone defined by an imaginary cylinder centered about the Y'-axis, wherein the central mass zone defines a central mass zone radius of 0.75 inch; and wherein the club head defines a mass distribution metric $MD_1$ according to equation 1:

$$MD_1 = \frac{M_{CMZ}}{M_T * R_{CMZ}} * 1 \text{ in.} \quad (1)$$

wherein $M_{CMZ}$ is the amount of mass within the central mass zone, $M_T$ is the total club head mass, and $R_{CMZ}$ is the central mass zone radius; and wherein the mass distribution metric $MD_1$ is greater than 0.1.

Clause 14. The golf club head of clause 13, further comprising a crown mass pad located on a crown interior surface and a sole mass pad located on a sole interior surface; wherein the crown mass pad and the sole mass pad are each intersected by the Y'-axis.

Clause 15. The golf club head of clause 14, wherein at least one of the crown mass pad and the sole mass pad is entirely bounded within the central mass zone.

Clause 16. A golf club head comprising; a strike face comprising a geometric center and a leading edge, a body, a center of gravity, a ground plane, and a total club head mass; wherein the body comprises a crown, a sole, a heel, a toe, and a rear end; a primary coordinate system centered about the geometric center, the coordinate system defining: an X-axis extending in a heel-to-toe direction, parallel to the ground plane; a Y-axis extending in a crown-to-sole direction, orthogonal to the X-axis and the ground plane; a Z-axis extending in a strike face-to-rear direction, orthogonal to both the X-axis and the Y-axis; a secondary coordinate system centered about the center of gravity, the secondary coordinate system defining: an X'-axis extending in a heel-to-toe direction, parallel to the ground plane; a Y'-axis extending in a crown-to-sole direction, orthogonal to the X'-axis and the ground plane; a Z'-axis extending in a strike face-to-rear direction, orthogonal to both the X'-axis and the Y'-axis; wherein the body comprises: a body width measured parallel to the X-axis between the heel and the toe; a body depth measured parallel to the Z-axis between the leading edge and a rearward-most point of the body; a body height measured parallel to the Y-axis between the ground plane and a highest point of the crown; wherein the club head comprises a ratio $H_B/W_B$ defined as the body height divided by the body width; wherein the ratio $H_B/W_B$ is greater than 0.6; a moment of inertia about the X'-axis, Ixx; a moment of inertia about the Y'-axis, Iyy; a moment of inertia about the Z'-axis, Izz; wherein the club head comprises an Ixx/Iyy ratio greater than 0.8; a central mass zone defined by an imaginary cylinder centered about the Y'-axis, wherein the central mass zone defines a central mass zone radius of 0.75 inch; and wherein the club head defines a mass distribution metric $MD_3$ according to equation 1:

$$MD_3 = \frac{M_{CMZ}}{M_T * Iyy} * 1000 \text{ g} * \text{cm}^2 \quad (1)$$

wherein $M_{CMZ}$ is the amount of mass within the central mass zone and $M_T$ is the total club head mass; and wherein the mass distribution metric $MD_3$ is greater than 0.050.

Clause 17. The golf club head of clause 16, further comprising a crown mass pad located on a crown interior surface and a sole mass pad located on a sole interior surface; wherein the crown mass pad and the sole mass pad are each intersected by the Y'-axis.

Clause 18. The golf club head of clause 17, wherein at least one of the crown mass pad and the sole mass pad is entirely bounded within the central mass zone.

Clause 19. The golf club head of clause 16, wherein Iyy is less than 3200 g*cm$^2$.

Clause 20. The golf club head of clause 16, wherein Iyy is less than 2800 g*cm$^2$.

Clause 21. The golf club head of clause 16, wherein the strike face further comprises a bulge curvature and a roll curvature; wherein the bulge curvature comprises a bulge radius that satisfies relation 1:

$$10.73-2.93*CG_z+CG_y<\text{Bulge Radius}<16.06-4.71*CG_z+CG_y \quad \text{Relation 1}$$

wherein $CG_y$ is a location of the center of gravity with respect to the Y-axis and $CG_z$ is a location of the center of gravity along the Z-axis.

Clause 22. The golf club head of clause 16, wherein the club head comprises a plurality of interchangeable weight inserts; wherein each of the plurality of interchangeable weight inserts is associated with a different club head build; wherein each club head build is associated with a different total club head mass; and wherein Iyy is constant between each club head build.

The invention claimed is:

1. A golf club head comprising;

a strike face comprising a geometric center and a leading edge, a body, a center of gravity, a ground plane, and a total club head mass;

wherein the body comprises a crown, a sole, a heel, a toe, and a rear end;

a primary coordinate system centered about the geometric center, the primary coordinate system defining:

an X-axis extending in a heel-to-toe direction, parallel to the ground plane;

a Y-axis extending in a crown-to-sole direction, orthogonal to the X-axis and the ground plane;

a Z-axis extending in a strike face-to-rear direction, orthogonal to both the X-axis and the Y-axis;

a secondary coordinate system centered about the center of gravity, the secondary coordinate system defining:

an X'-axis extending in a heel-to-toe direction, parallel to the ground plane;

a Y'-axis extending in a crown-to-sole direction, orthogonal to the X'-axis and the ground plane;

a Z'-axis extending in a strike face-to-rear direction, orthogonal to both the X'-axis and the Y'-axis;

wherein the body comprises:

a body width measured parallel to the X-axis between the heel and the toe;

a body depth measured parallel to the Z-axis between the leading edge and a rearward-most point of the body;

a body height measured parallel to the Y-axis between the ground plane and a highest point of the crown;

wherein the club head comprises a ratio HB/WB defined as the body height divided by the body width;

wherein the ratio HB/WB is greater than 0.6;

a YZ plane extending along the Y-axis and the Z-axis;

a crown transition point located at a forwardmost point of the crown within the YZ plane;

a rear transition point located at a rearmost point of the crown within the YZ plane;

a crown axis extending between the crown transition point and the rear transition point;

a crown angle greater than 75 degrees, measured as an acute angle between the crown axis and the Y'-axis;

a moment of inertia about the X'-axis, Ixx;

a moment of inertia about the Y'-axis, Iyy;

a moment of inertia about the Z'-axis, Izz;

wherein the club head comprises an Ixx/Iyy ratio greater than 0.8;

a central mass zone defined by an imaginary cylinder centered about the Y'-axis, wherein the central mass zone defines a central mass zone radius of 0.75 inch; and wherein greater than 20% of the total club head mass is located within the central mass zone.

2. The golf club head of claim 1, further comprising a crown mass pad located on a crown interior surface and a sole mass pad located on a sole interior surface;

wherein the crown mass pad and the sole mass pad are each intersected by the Y'-axis.

3. The golf club head of claim 2, wherein at least one of the crown mass pad and the sole mass pad is entirely bounded within the central mass zone.

4. The golf club head of claim 2, wherein the sole mass pad comprises a mass greater than 5 grams.

5. The golf club head of claim 2, wherein the crown mass pad comprises a mass greater than 25 grams.

6. The golf club head of claim 1, wherein the body width is less than 4.0 inches.

7. The golf club head of claim 1, wherein the body height is greater than 2.2 inches.

8. The golf club head of claim 1, wherein the club head comprises a volume less than 350 $cm^3$.

9. The golf club head of claim 1, wherein the Ixx/Iyy ratio is greater than 0.85.

10. The golf club head of claim 1, wherein the crown angle is greater than 85 degrees.

11. The golf club head of claim 1, further comprising a weight member attached to the body proximate the rear end and the sole;

wherein the weight member defines a weight member center of gravity;

wherein the weight member comprises a weight member elevation defined as a distance between the center of gravity of the club head and the weight member center of gravity, measured parallel to the Y'-axis;

wherein the weight member further comprises a weight member depth defined as a distance between the center of gravity of the club head and the weight member center of gravity, measured parallel to the Y'-axis;

wherein the club head defines an Ew/Dw ratio defined as the weight member elevation divided by the weight member depth; and wherein the $E_W/D_W$ ratio is greater than 0.3.

12. A golf club head comprising;

a strike face comprising a geometric center and a leading edge, a body, a center of gravity, a ground plane, and a total club head mass;

wherein the body comprises a crown, a sole, a heel, a toe, and a rear end;

a primary coordinate system centered about the geometric center, the primary coordinate system defining:

an X-axis extending in a heel-to-toe direction, parallel to the ground plane;

a Y-axis extending in a crown-to-sole direction, orthogonal to the X-axis and the ground plane;

a Z-axis extending in a strike face-to-rear direction, orthogonal to both the X-axis and the Y-axis;

a secondary coordinate system centered about the center of gravity, the secondary coordinate system defining:

an X'-axis extending in a heel-to-toe direction, parallel to the ground plane;

a Y'-axis extending in a crown-to-sole direction, orthogonal to the X'-axis and the ground plane;

a Z'-axis extending in a strike face-to-rear direction, orthogonal to both the X'-axis and the Y'-axis;

wherein the body comprises:

a body width measured parallel to the X-axis between the heel and the toe;

a body depth measured parallel to the Z-axis between the leading edge and a rearward-most point of the body;

a body height measured parallel to the Y-axis between the ground plane and a highest point of the crown;

wherein the club head comprises a ratio $H_B/W_B$ defined as the body height divided by the body width;

wherein the ratio $H_B/W_B$ is greater than 0.6;

a moment of inertia about the X'-axis, Ixx;

a moment of inertia about the Y'-axis, Iyy;

a moment of inertia about the Z'-axis, Izz;

wherein the club head comprises an Ixx/Iyy ratio greater than 0.8;

a central mass zone defined by an imaginary cylinder centered about the Y'-axis, wherein the central mass zone defines a central mass zone radius of 0.75 inch; and wherein the club head defines a mass distribution metric $MD_1$ according to equation 1:

$$MD_1 = \frac{M_{CMZ}}{M_T * R_{CMZ}} * 1 \text{ in.} \quad (1)$$

wherein $M_{CMZ}$ is the amount of mass within the central mass zone, $M_T$ is the total club head mass, and $R_{CMZ}$ is the central mass zone radius; and wherein the mass distribution metric $MD_1$ is greater than 0.1.

13. The golf club head of claim 12, further comprising a crown mass pad located on a crown interior surface and a sole mass pad located on a sole interior surface;

wherein the crown mass pad and the sole mass pad are each intersected by the Y'-axis.

14. The golf club head of claim 13, wherein at least one of the crown mass pad and the sole mass pad is entirely bounded within the central mass zone.

15. A golf club head comprising;

a strike face comprising a geometric center and a leading edge, a body, a center of gravity, a ground plane, and a total club head mass;

wherein the body comprises a crown, a sole, a heel, a toe, and a rear end;

a primary coordinate system centered about the geometric center, the primary coordinate system defining:

an X-axis extending in a heel-to-toe direction, parallel to the ground plane;

a Y-axis extending in a crown-to-sole direction, orthogonal to the X-axis and the ground plane;

a Z-axis extending in a strike face-to-rear direction, orthogonal to both the X-axis and the Y-axis;

a secondary coordinate system centered about the center of gravity, the secondary coordinate system defining:

an X'-axis extending in a heel-to-toe direction, parallel to the ground plane;

a Y'-axis extending in a crown-to-sole direction, orthogonal to the X'-axis and the ground plane;

a Z'-axis extending in a strike face-to-rear direction, orthogonal to both the X'-axis and the Y'-axis;

wherein the body comprises:

a body width measured parallel to the X-axis between the heel and the toe;

a body depth measured parallel to the Z-axis between the leading edge and a rearward-most point of the body;

a body height measured parallel to the Y-axis between the ground plane and a highest point of the crown;

wherein the club head comprises a ratio $H_B/W_B$ defined as the body height divided by the body width;

wherein the ratio $H_B/W_B$ is greater than 0.6;

a moment of inertia about the X'-axis, Ixx;

a moment of inertia about the Y'-axis, Iyy;

a moment of inertia about the Z'-axis, Izz;

wherein the club head comprises an Ixx/Iyy ratio greater than 0.8;

a central mass zone defined by an imaginary cylinder centered about the Y'-axis, wherein the central mass zone defines a central mass zone radius of 0.75 inch; and wherein the club head defines a mass distribution metric $MD_3$ according to equation 1:

$$MD_3 = \frac{M_{CMZ}}{M_T * Iyy} * 1000 \text{ g} * \text{cm}^2 \quad (1)$$

wherein $M_{CMZ}$ is the amount of mass within the central mass zone and $M_T$ is the total club head mass; and wherein the mass distribution metric $MD_3$ is greater than 0.050.

16. The golf club head of claim 15, further comprising a crown mass pad located on a crown interior surface and a sole mass pad located on a sole interior surface;

wherein the crown mass pad and the sole mass pad are each intersected by the Y'-axis.

17. The golf club head of claim 16, wherein at least one of the crown mass pad and the sole mass pad is entirely bounded within the central mass zone.

18. The golf club head of claim 15, wherein Iyy is less than 3200 g*cm$^2$.

19. The golf club head of claim 15, wherein Iyy is less than 2800 g*cm$^2$.

* * * * *